US005405735A

United States Patent [19]

Ogawa

[11] Patent Number: 5,405,735

[45] Date of Patent: Apr. 11, 1995

[54] SILVER HALIDE COLOR PHOTOGRAPHIC LIGHT-SENSITIVE MATERIALS

[75] Inventor: Tadashi Ogawa, Kanagawa, Japan

[73] Assignee: Fuji Photo Film Co., Ltd., Kanagawa, Japan

[21] Appl. No.: 123,043

[22] Filed: Sep. 20, 1993

Related U.S. Application Data

[63] Continuation of Ser. No. 921,362, Jul. 28, 1992, abandoned, which is a continuation of Ser. No. 758,545, Sep. 9, 1991, abandoned, which is a continuation of Ser. No. 436,860, Nov. 15, 1989, abandoned.

[30] Foreign Application Priority Data

Nov. 16, 1988 [JP] Japan ..... 63-289704

[51] Int. Cl.[6] ..... G03C 1/46; G03C 7/32

[52] U.S. Cl. ..... 430/505; 430/551; 430/554; 430/558

[58] Field of Search ..... 430/504, 505, 551, 554, 430/558

[56] References Cited

U.S. PATENT DOCUMENTS

| | | | |
|---|---|---|---|
| 4,540,653 | 9/1985 | Nishijima et al. | 430/372 |
| 4,587,210 | 5/1986 | Ono et al. | 430/555 |
| 4,748,100 | 5/1988 | Umemoto et al. | 430/505 |
| 4,910,127 | 3/1990 | Sakaki et al. | 430/546 |

FOREIGN PATENT DOCUMENTS

| | | |
|---|---|---|
| 0255402A2 | 2/1988 | European Pat. Off. . |
| 0273430A2 | 7/1988 | European Pat. Off. . |

*Primary Examiner*—Janet C. Baxter

*Attorney, Agent, or Firm*—Sughrue, Mion, Zinn, Macpeak & Seas

[57] ABSTRACT

A silver halide color photographic material light-sensitive having a photographic layer constitution on a support is provided. The photographic layer constitution is comprised of at least one yellow coupler-containing silver halide emulsion layer, at least one magenta coupler-containing silver halide emulsion layer and at least one cyan coupler-containing silver halide emulsion layer formed on the support in this order. The magenta coupler is a 2-equivalent 5-pyrazolone coupler or a 2-equivalent pyrazoloazole coupler. A non-light-sensitive layer is provided between the yellow coupler-containing silver halide emulsion layer and the magenta coupler-containing silver halide emulsion layer and it contains a compound of formula (I) in an amount of from $2.75\times10^{-4}$ to $1.5\times10^{-3}$ mol/m$^2$. The molar ratio of the silver halide in the yellow coupler-containing silver halide emulsion layer to the yellow coupler therein is from 1.5 to 3.5.

(I)

wherein the variables are as defined in the specification. The material has excellent rapid processability and color reproducibility, and the color image formed has high color-fastness. The material is free from color-mixing.

13 Claims, No Drawings

SILVER HALIDE COLOR PHOTOGRAPHIC LIGHT-SENSITIVE MATERIALS

This is a continuation of application Ser. No. 07/921,362 filed Jul. 28, 1992 (abandoned), which is a continuation of application Ser. No. 07/758,545 filed Sep. 9, 1991 (abandoned), which is a continuation of application Ser. No. 07/436,860 filed Nov. 15, 1989 (abandoned).

FIELD OF THE INVENTION

The present invention relates to a silver halide photographic light-sensitive material and, more particularly, to a silver halide color photographic light-sensitive material having excellent rapid processability, color reproducibility and color image storage stability.

BACKGROUND OF THE INVENTION

Recently, silver halide color photographic materials which can be processed in a rapid processing system and which have excellent color reproducibility, color image quality and color image storage stability have been sought.

In particular, the rapid processability of the materials is important. The materials exposed are continuously processed in an automatic developing machine as installed in laboratories, and it is requested that the materials are developed within the day to deliver the finished prints to the user, as part of improvement of the services to users. In these days, it is further requested to deliver the finished prints to the user within several hours after receipt of the photographic materials to be processed, and such request is increasingly augmented.

In addition, reduction of the processing time may bring about improvement of the production efficiently and may facilitate reduction of the production cost, and therefore, development of rapid processing systems is earnestly required.

Various approaches have heretofore been made to the success of satisfactory rapid processing means from both the aspects of the photographic materials and the processing solutions. Regarding color development, various means of elevating the temperature of the processing solution, elevating the pH value of the solution or adding a color developing agent of high concentration have been tried and proposed. In addition, it is also known to add various additives such as a development accelerator to the processing solution.

As the development accelerator for this purpose, there are mentioned, for example, 1-phenyl-3-pyrazolidone described in British Patent 811,185, N-methyl-p-aminophenyl described in U.S. Pat. No. 2,417,514, and N,N,N',N'-tetramethyl-p-phenylenediamine described in JP-A-50-15554. (The term "JP-A" as referred to herein means an "unexamined published Japanese patent application".)

However, sufficient rapid processing could not be attained by the above means, which would rather cause deterioration of the photographic characteristics, for example, elevation of fog of the materials.

On the other hand, it is known that the shape, size and composition of the silver halide grains in the silver halide emulsions to be used in preparing photographic materials have a great influence on the developing speed of the photographic materials. In particular, the halogen composition has a significant influence thereon, and it is known that photographic materials containing a silver halide emulsion having a high silver chloride content have an extremely high developing speed.

Formation of color images in silver halide color photographic materials is generally effected by a system in which the silver halide grains in the exposed silver halide color photographic material are reduced by an aromatic primary amine developing agent whereupon the developing agent is thereby oxidized, and the oxidation product of the developing agent is coupled with the coupler which is previously contained in the silver halide color photographic material to form a color image. Generally, three couplers for forming the three colors of yellow, magenta and cyan, respectively, are employed as the couplers in the system, as the color reproduction is effected by a subtractive color photographic process.

In order to perform a better color reproduction, satisfaction of extremely numerous elements and conditions is necessary. Specifically, such elements and conditions include the color sensitivity and interlayer effect of picture-taking photographic materials, the matching balance between the spectral sensitivity of the printing photographic material and the color formed on the picture-taking photographic material, the overlapping of the spectral sensitivity between the light-sensitive layers each having a different color sensitivity, the spectral absorption characteristics of the colored dyes, and the color mixing (during processing) between the light-sensitive layers each having a different colored dye. All of such elements and conditions have influences on the level of the color reproducibility of photographic materials.

Recently, a new system has been developed and is being put to practical use in order to meet the above-mentioned request for rapid processing, in which the above-mentioned emulsion having a high silver chloride content is employed in preparing a photographic material and the material is processed with a processing solution not containing a sulfite and benzyl alcohol which are contained in the color developer for the conventional color paper. However, the new system has a serious drawback in the point of the above-mentioned color-mixing. That is, it has been found that the color-mixing is extremely noticeable in the process of the new system, as compared with the conventional processing system.

The fundamental properties which are essential to couplers include not only a high solubility in high boiling point organic solvents, a high dispersibility and dispersion-stability in silver halide emulsions without easy precipitation and the favorable photographic characteristics, but also a pertinent spectral absorption characteristic of the colored dye which is favorable to the color reproducibility and a sufficient fastness of the colored dye to light, heat and moisture. In particular, the spectral absorption characteristic of the colored dye is extremely important for color photographs. Even though couplers capable of forming color dyes having a favorable spectral absorption characteristic are incorporated into photographic materials, the meaning of use the coupler would remarkably lower if the above-mentioned color-mixing occurs in the processed photographic materials.

In color photographs, the color image fastness is also as important theme. Above all, the color image fastness to light is more important. In the color papers which are presently used, fading of magenta dyes and formation of brown stains to be caused by photo-reaction of the non-colored magenta couplers are significant problems to be solved. As a means of improving magenta couplers so as to overcome the problems, a technique of using 2-equivalent 5-pyrazolone couplers in place of the conventional 4-equivalent 5-pyrazolone couplers is known. Such magenta couplers include, for example, the nitrogen atom-releasing type magenta couplers described in U.S. Pat. No. 4,310,619 and the sulfur atom-releasing type magenta couplers described in U.S. Pat. No. 4,351,897. In particular, the arylthio group-releasing type magenta couplers described in the latter have many practically excellent aspects including the stability of the couplers themselves.

As magenta couplers other than 5-pyrazolone couplers, there are known pyrazoloazole magenta couplers. The couplers of this type are known to form color dyes having a better spectral absorption characteristic than 5-pyrazolone couplers and additionally having an excellent light-fastness. Further, it is also known that thsee couplers themselves do not cause stains so much. Accordingly, couplers of this type are also practically useful. They are described for example in U.S. Pat. Nos. 3,369,879 and 3,725,067, *Research Disclosure*, Item No. 24220 (June, 1984), ibid., Item No. 24230 (June, 1984), U.S. Pat. Nos. 4,500,630 and 4,540,654, JP-A-61-65245 (corresponding to EP 177765), JP-A-61-65246 ( corresponding to U.S. Pat. No. 4,822,730), and JP-A-61-147254 and European Patent 0,226,849. Among the pyrazoloazole magenta couplers, pyrazolo [5,1-c][1,2,4]triazoles and pyrazolo[1,5-b][1,2,4]triazoles are preferred in view of the total properties of the color forming property, the spectral absorption characteristic of the colored dyes formed therefrom and the color image fastness of the dyes. In particular, the pyrazolo[1,5-b][1,2,4]triazoles described in U.S. Pat. No. 4,540,654 are preferably employed. Further, derivatives of such couplers, for example, those formed by combining a branched alkyl group as the substituent (described in JP-A-61-65245), those formed by introducing a sulfonamido group into the molecule (described in JP-A-61-65246 ) , those formed by introducing an alkoxysulfonamido group (described in JP-A-61-147254), and those formed by introducing an alkoxy group or an aryloxy group into the 6-position (described in European Patent 0,226,849), are more preferred.

However, when so-called 2-equivalent couplers having a releasing group other than hydrogen atom in the coupling position, which are among the couplers having various advantages as mentioned above, are used in a green-sensitive silver halide emulsion layer, it has been found that color-mixing is unfavorably noticeable in the processing mentioned above.

SUMMARY OF THE INVENTION

An object of the present invention is to provide a silver halide color photographic light-sensitive material which has excellent color reproducibility and color image storage stability and which may be processed by high-speed processing.

A further object of the present invention is to provide a silver halide color photographic light-sensitive material which inhibits color mixing which often occurs in processing a silver halide color photographic material having excellent color reproducibility and color image storage stability to thereby provide a technique of noticeably improving the quality of the photographic material.

The above and other objects of the present invention have been attained by a silver halide color photographic light-sensitive material having a photographic layer constitution on a support, the photographic layer constitution being composed of at least one yellow coupler-containing silver halide emulsion layer, at least one magenta coupler-containing silver halide emulsion layer and at least one cyan coupler-containing silver halide emulsion layer as formed on the support in this order, wherein the magenta coupler is a 2-equivalent 5-pyrazolone coupler or a 2-equivalent pyrazoloazole coupler, a non-light-sensitive layer is provided between the yellow coupler-containing silver halide emulsion layer and the magenta coupler-containing silver halide emulsion layer and it contains a compound as represented by the following formula (I) in an amount of from $2.75\times10^{-4}$ to $1.5\times10^{-3}$ mol/m$^2$, and the molar ratio of the silver halide in the yellow coupler-containing silver halide emulsion layer to the yellow coupler contained in the yellow coupler-containing silver halide emulsion layer is from 1.5 to 3.5:

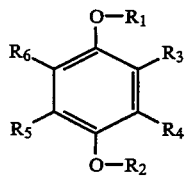

(I)

where $R_1$ and $R_2$ each represents a hydrogen atom, a precursor which is cleaved under alkaline conditions to form a hydrogen atom, or $R_1$ and $R_3$, and/or $R_2$ and $R_4$ are combined to form a closed ring by bonding —$OR_1$ with $R_3$ and/or —$OR_2$ with $R_4$, respectively, to form —$OCOCH_2CH_2$—; $R_3$, $R_4$, $R_5$ and $R_6$ each represents a hydrogen atom, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxy group, a substituted or unsubstituted alkylthio group, a substituted or unsubstituted arylthio group, a substituted or unsubstituted nitrogen-containing heterocyclic thio group, a substituted or unsubstituted aryloxy group, a substituted or unsubstituted acyl group, a substituted or unsubstituted acylamino group, a substituted or unsubstituted alkylamino group, a substituted or unsubstituted alkoxycarbonyl group, a substituted or unsubstituted aryloxycarbonyl group, a carbamoyl group, a sulfamoyl group or a sulfonic acid or carboxylic acid group which may be in a form of a salt thereof; provided that when $R_3$, $R_4$, $R_5$ and $R_6$ are all hydrogen atoms at the same time, $R_1$ and $R_2$ must not be hydrogen atoms at the same time.

As one preferred embodiment of the present invention, silvar halide in each silver halide emulsion present in the yellow-coupler-containing silver halide emulsion layer, the magenta coupler-containing silver halide emulsion layer and the cyan coupler-containing silver halide emulsion layer contains 90 mol % or more silver chloride.

The material has excellent rapid processability and color reproducibility, and the color image formed has high color-fastness. The material is free from color-mixing.

DETAILED DESCRIPTION OF THE INVENTION

In formula (I), $R_1$ and $R_2$ each represents a hydrogen atom or a precursor which is cleaved under an alkaline condition to form a hydrogen atom. Examples of such a precursor include a substituted or unsubstituted aliphatic or aromatic acyl group (e.g., acetyl, octanoyl). When —$OR_2$ is combined with $R_4$, a closed ring as shown in formula (I) is formed.

(I)

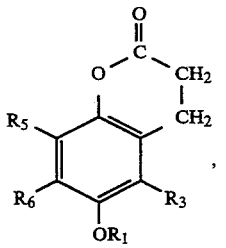

wherein $R_1$, $R_3$, $R_5$ and $R_6$ have the same meaning as in formula (I). The compound represented by formula (I)' is also cleaved at the closed ring to form a hydrogen atom at the position of $R_2$. $R_1$ and $R_3$ may also be combined to form the same closed ring.

$R_3$, $R_4$, $R_5$ and $R_6$ each represents a hydrogen atom, a halogen atom (e.g., fluorine, chlorine, bromine), a substituted or unsubstituted alkyl group (e.g., methyl, ethyl, n-propyl, i-propyl, n-butyl, t-butyl n-amyl, i-amyl, n-octyl, t-octyl, n-dodecyl, n-octadecyl, 2-methoxyethyl, 2-ethoxyethyl, 2-phenylethyl, benzyl, 3-cyanopropyl), a substituted or unsubstituted alkenyl group (e.g., allyl, octenyl), a substituted or unsubstituted aryl group (e.g., phenyl, tolyl, naphthyl, methoxyphenyl), a substituted or unsubstituted cycloalkyl group (e.g., cyclohexyl, cyclopentyl ), a substituted or unsubstituted alkoxy group (e.g., methoxy, ethoxy , dodecyloxy, ethoxyethoxy, phenoxymethoxy), a substituted or unsubstituted alkylthio group (e.g. , methylthio, n-butylthio, n-dodecylthio), a substituted or unsubstituted arylthio group (e.g., phenylthio, dimethylphenylthio), a substituted or unsubstituted heterocyclic thio group (e.g., tetrazolyl, thiazolyl, oxazolyl ), a substituted or unsubstituted aryloxy group (e.g., phenoxy, methylphenoxy ), a substituted or unsubstituted acyl group (e.g., acetyl, octanoyl), a substituted or unsubstituted acylamino group (e.g., acetylamino octanoylamino, benzoylamino), a substituted or unsubstituted alkylamino group (e.g., methylamino, diethylamino, n-octylamino, dodecylamino), a substituted or unsubstituted alkoxycarbonyl group (e.g., methoxycarbonyl, benzyloxycarbonyl ), a substituted or unsubstituted aryloxycarbonyl group (e.g., phenoxycarbonyl, ethylphenoxycarbonyl), a carbamoyl group (e.g., methylcarbamoyl, octadecylcarbamoyl, phenylcarbamoyl), a sulfamoyl group (e.g., methylsulfamoyl, octadecylsulfamoyl), or a sulfonic acid or carboxylic acid group (these acid groups may be in the form of salts thereof). Where $R_3$, $R_4$, $R_5$ and $R_6$ are all hydrogen atoms at the same time, $R_1$ and $R_2$ must not be hydrogen atoms at the same time. The total carbon number of $R_3$ to $R_6$ is preferably 12 or more, and more preferably 14 or more.

Specific examples of the compounds of the formula (I) are mentioned below.

(H-1)

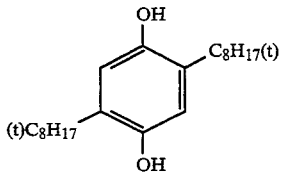

(H-2)

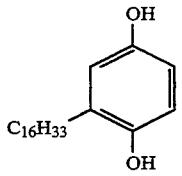

(H-3)

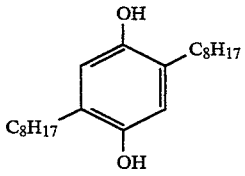

(H-4)

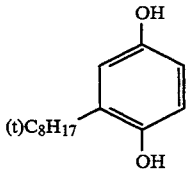

(H-5)

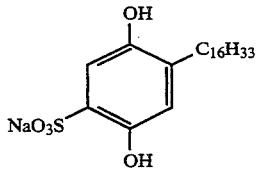

(H-6)

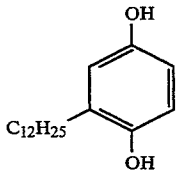

(H-7)

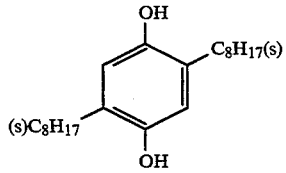

(H-8)

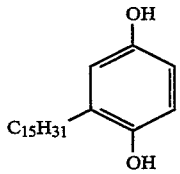

(H-9)

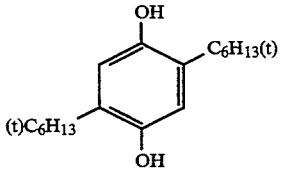

-continued (H-10)

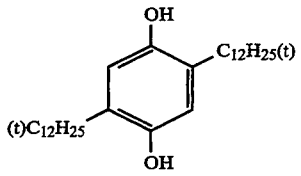

(H-11)

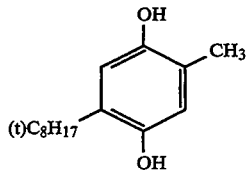

(H-12)

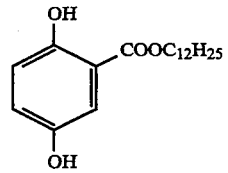

(H-13)

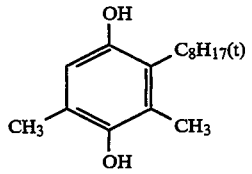

(H-14)

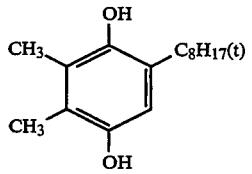

(H-15)

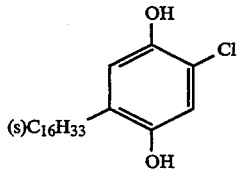

(H-16)

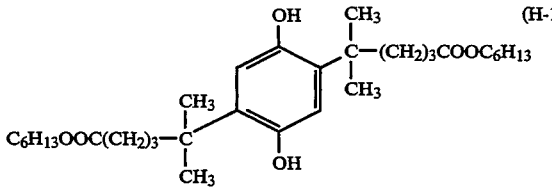

In the above-shown compounds (t)$C_8H_{17}$- and (t) $C_6H_{13}$-show

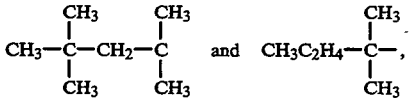

respectively.

Other compounds having a (t)alkyl group or a (s)alkyl group each represents a mixture of compounds having different types of (t)alkyl group or (s)alkyl group, respectively.

The compounds of formula (I) are disclosed in, for example, U.S. Pat. Nos. 2,360,290, 2,419,613, 2,728,659, 2,732,300, 3,960,570 and 3,700,453.

The compound of formula (I) is added to the light-insensitive hydrophilic colloidal layer as provided between the yellow coupler-containing silver halide emulsion layer and the magenta coupler-containing silver halide emulsion layer, in an amount of from $2.75\times10^{-4}$ mol/m$^2$ to $1.5\times10^{-3}$ mol/m$^2$. If the amount of the compound is less than $2.75\times10^{-4}$ mol/m$^2$, the effect of the present invention would be insufficient, but if it is more than $1.5\times10^{-3}$ mol/m$^2$, the excess compound would inconveniently cause not only lowering the color density in the adjacent yellow coupler-containing silver halide emulsion layer and magenta coupler-containing silver halide emulsion layer and retardation of the development of the emulsion layers provided nearer to the support, but also inteference with the fastness of the colored dye in the adjacent yellow coupler-containing silver halide emulsion layer and, as the case may be, additionally the colored dye in the adjacent magenta coupler-containing silver halide emulsion layer.

The compound of formula (I) in the past has been used in commercial color papers and other materials in a light-insensitive laeyr. In the past, the amount of the compound of formula (I) to be added to the light-insensitive layer is generally approximately $1\times10^{-4}$ mol/m$^2$ or less when used in commercial color papers or when used in the materials described in JP-A-61-267050, and the amount does not exceed $2.75\times10^{-4}$ mol/m$^2$. As opposed to this, the amount of the compound of formula (I) to be added to the light-insensitive layer in the photographic material of the present invention is more than that added to such commercial products or known materials, and addition of such large amount of the compound of the formula (I) is one characteristic aspect of the present invention.

The compound of formula (I) may be added to the hydrophilic colloidal layer by adding a solution of the compound in a high boiling point organic solvent (disclosed hereinafter), a low boiling point organic solvent (e.g., methanol, acetone) or water into an aqueous solution of a hydrophilic colloid, and coating the solution.

The effect of the present invention can be attained when the molar ratio of the silver halide to be contained in the yellow coupler-containing silver halide emulsion layer to the yellow coupler in this emulsion layer is from 1.5 to 3.5, in addition to the above condition relating to the amount of the compound of formula (I). The molar ratio of the silver halide to the yellow coupler, is preferably from 1.8 to 3.2, more preferably from 2.0 to 2.8. If the molar ratio of the silver halide to the yellow coupler is less than 1.5, color mixing during processing would be fairly inhibited, but a sufficient color formation could not be effected since the coupler could not be efficiently utilized. However, if it is more than 3.5, the effect of inhibiting color mixing would be insufficient. Anyway, the effect of the present invention could not be attained sufficiently when the molar ratio is outside the defined scope.

In accordance with the present invention, 2-equivalent pyrazolone couplers or 2-equivalent pyrazoloazole couplers are employed as the magenta couplers.

Any known 2-equivalent pyrazolone coupler can be used in the present invention, but those represented by the following formula (II) where the 3-position has an arylamino group are preferred for the present invention:

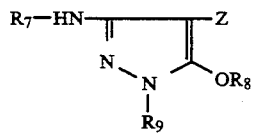

(II)

where $R_7$ and $R_9$ each represents a substituted or unsubstituted phenyl group; $R_8$ represents a hydrogen atom, or an aliphatic or aromatic acyl group; and Z represents a group capable of being released by coupling with an oxidation product of a color developing agent.

As the releasing group, the nitrogen atom-releasing groups as described in U.S. Pat. No. 4,310,619 and the arylthio-releasing groups as described in U.S. Pat. No. 4,351,897 and WO 88/04795 are preferred. The descriptions in U.S. Pat. No. 4,351,897, columns 3 to 6 and WO 88/04795, pages 6–9 may be applied in this invention as a description for $R_7$ and $R_9$.

In accordance with the present invention, pyrazoloazole couplers are also employed. As the pyrazoloazole couplers, various compounds are known as mentioned above and, for example, there are pyrazolobenzimidazole couplers described in U.S. Pat. No. 3,369,879. In the present invention, the pyrazolo[5,1-c][1,2,4]triazole couplers described in U.S. Pat. No. 3,725,067 as well as the pyrazolotetrazole couplers and pyrazolopyrazole couplers described in *Research Disclosure*, Item No. 24220 (June, 1984) and ibid., Item No. 24230 (June, 1984) are preferably employed.

In particular, the imidazo[1,2-b ]pyrazole couplers described in European Patent 199,741 are especially preferred, as they may form colored dyes having preferred spectral absorption characteristics and having an excellent light-fastness and the effect of the present invention is noticeable when they are used. Most preferred are the pyrazolo[5,1-b][1,2,4]triazole couplers described in the aforesaid U.S. Pat. No. 4,540,654.

The above-mentioned pyrazoloazole couplers are represented by the following formula (III):

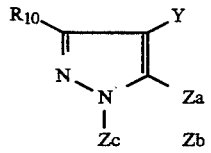

(III)

In formula (III), $R_{10}$ represents a hydrogen atom or a substituent and is preferably a substituted or unsubstituted alkyl group (e.g., methyl, ethyl, n-butyl, i-propyl, i-butyl, t-butyl), a substituted or unsubstituted alkoxy group (e.g., methoxy, ethoxy, butoxy, ethoxyethoxy, phenoxyethoxy), a substituted or unsubstituted aryloxy group (e.g., phenoxy, naphthoxy, o-methylphenoxy, o-chlorophenoxy), or a ureido group. Especially preferably, it is methyl group or a branched alkyl group such as i-propyl or t-butyl group, or an alkoxy group or a substituted phenoxy group such as an o-methylphenoxy and an o-chlorophenoxy group.

Y represents a group capable of being released by a coupling reaction with an oxidation product of an aromatic primary amine developing agent. Such releasing group includes, for example, a halogen atom (e.g., chlorine, bromine), an arylthio group (e.g., 2-butoxy-5-t-octylphenylthio, 2-propoxy-5-t-hexylphenylthio, o-(tbutylcarbonamido)phenylthio), a nitrogen-containing heterocyclic group (e.g., imidazole, 4-chloroimidazole), or an aryloxy group (e.g., p-methylphenoxy, 2,4-dimethylphenoxy, 2,4-di-t-phenoxy). Halogen atoms and arylthio groups are especially preferred among them.

Za, Zb and Zc each represents a methine group, a substituted methine group, or a group of =N— or —NH—, and one of the Za—Zb bond and Zb—Zc bond is a double bond and the other is a single bond. Where the Za—Zb bond is a carbon-carbon double bond, it may be a part of an aromatic group. The compound of formula (III) may form a dimer or a higher polymer at the position of $R_1$ or X. Where Za, Zb or Zc is a substituted methine group, the compound of formula (III) may also form a dimer or a higher polymer at the position of the substituted methine moiety. Where Za, Zb or Zc represents a substituted methine group, the substituent for the group is preferably a substituted alkyl group, especially a branched substituted alkyl group (e.g., substituted i-propyl, substituted t-butyl).

As the yellow couplers for use in the present invention, there are mentioned non-diffusive acylacetamide couplers. Examples of these yellow couplers are described in U.S. Pat. Nos. 2.407,210, 2,875,057 and 3,265,506. In accordance with the present invention, 2-equivalent yellow couplers are preferably used. Specific examples of such couplers include the oxygen atom-releasing 2-equivalent yellow couplers described in U.S. Pat. Nos. 3,408,194, 3,447,928, 3,933,501 and 4,022,620, and the nitrogen atom-releasing 2-equivalent yellow couplers described in JP-B-58-10739 (the term "JP-B" as used herein means an "examined Japanese patent publication"), U.S. Pat. Nos. 4,401,752 and 4,326,024, *Research Disclosure*, Item No. 18053 (April, 1979), British Patent No. 1,425,020, West German Patent Laid-Open (OLS) Nos. 2,219,917, 2,261,361, 2,329,587 and 2,433,812. α-Pivaloylacetanilide couplers are preferred, because they form colored dyes with high fastness, especially high light-fastness. α-Benzoylacetanilide couplers are also preferred, because they form colored dyes with high color density. The effect of the present invention is more remarkable when α-pivaloylacetanilide couplers are employed.

2-Equivalent yellow couplers which are preferably employed in the present invention are those represented by the following formula (IV):

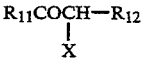

(IV)

where $R_{11}$ represents an alkyl group, a substituted alkyl group, an aryl group, or a substituted aryl group represents a cyano group or a substituted N-phenylcarbamoyl group; and X represents a group capable of being released by a coupling reaction with an oxidation product of an aromatic primary amine developing agent.

Regarding the couplers to be incorporated into the photographic materials of the present invention, the amount of the yellow coupler to be incorporated is defined above. The magenta coupler is incorporated in the silver halide emulsion layer in an amount of from 0.005 to 4 mols, preferably from 0.05 to 2 mols, per mol of silver halide. The same shall apply to the cyan coupler. The amount of each coupler coated on the support is preferably from $2\times10^{-5}$ mol/m$^2$ to $1\times10^{-2}$ mol/m$^2$, more preferably from $4\times10^{-5}$ mol/m$^2$ to $5\times10^{-3}$ mol/m$^2$.

Specific examples of couplers which are preferably employed in the present invention are mentioned below.
(M-1)
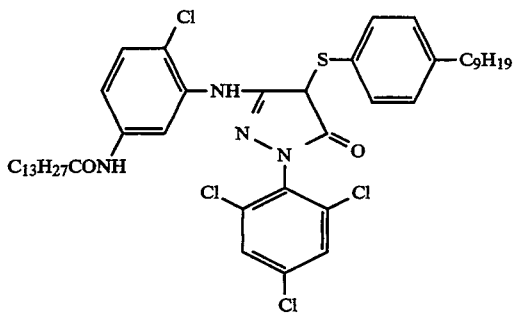
(M-2)
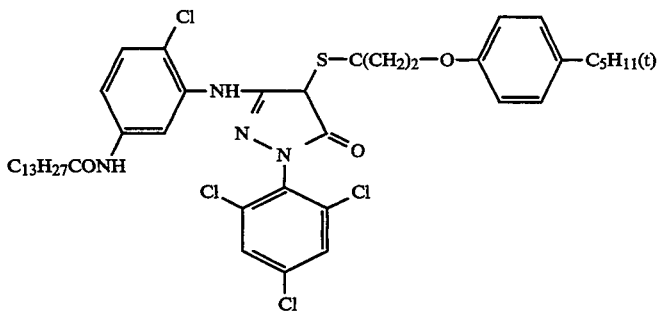
(M-3)
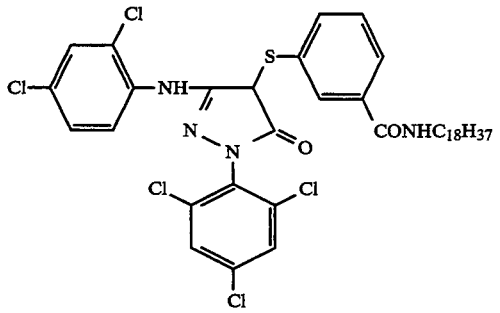
(M-4)
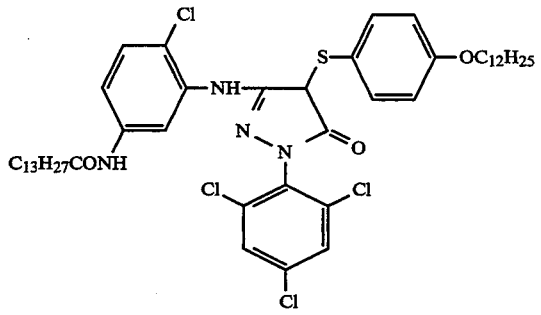
(M-5)
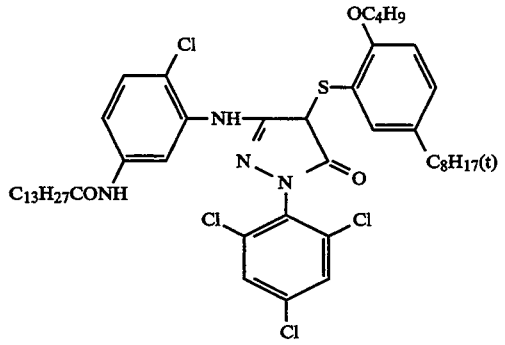

-continued
(M-6)
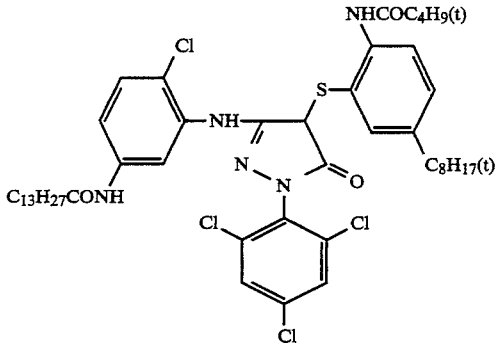
(M-7)
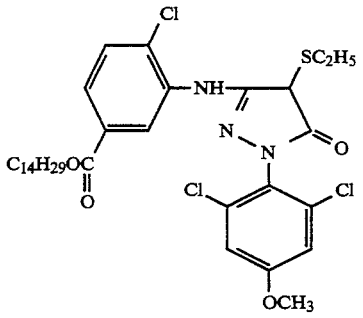
(M-8)
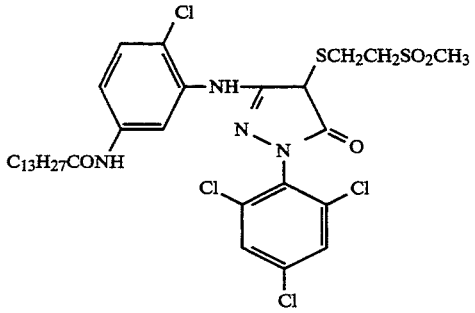
(M-9)
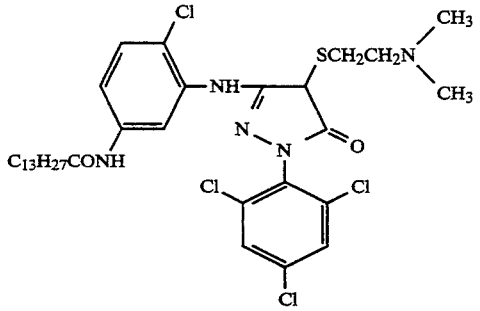
(M-10)
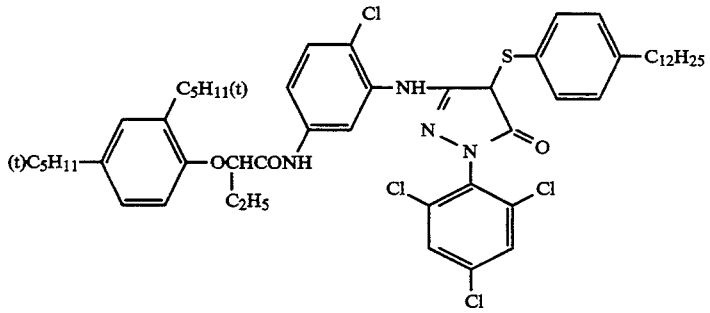

-continued
(M-11)
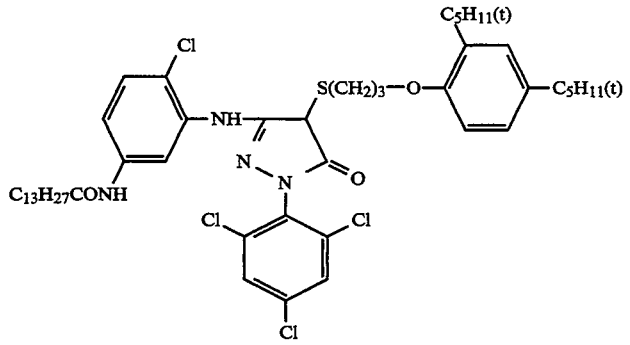
(M-12)
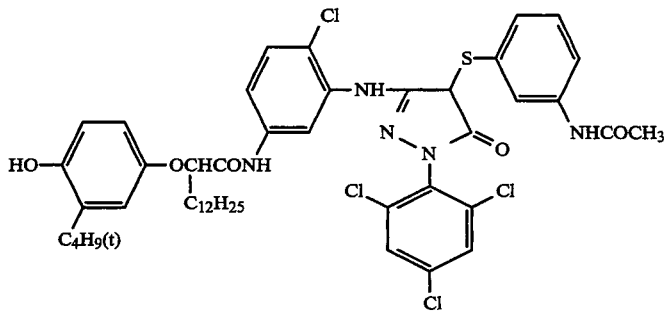
(M-13)
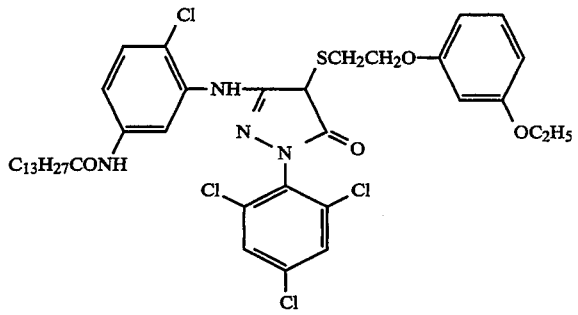
(M-14)
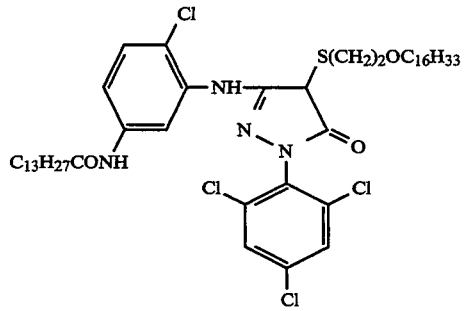
(M-15)
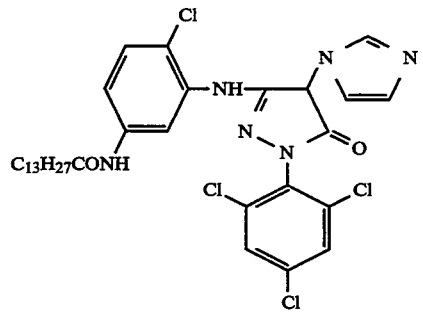

-continued
(M-16)
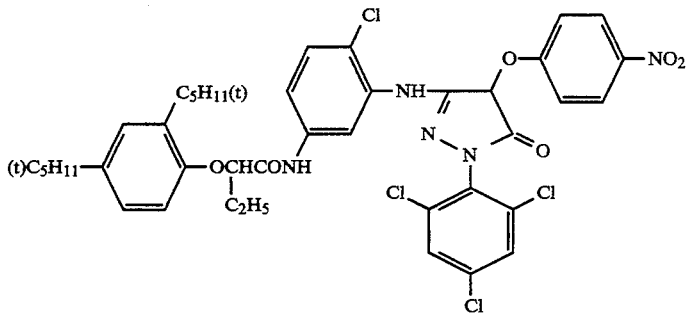
(M-17)
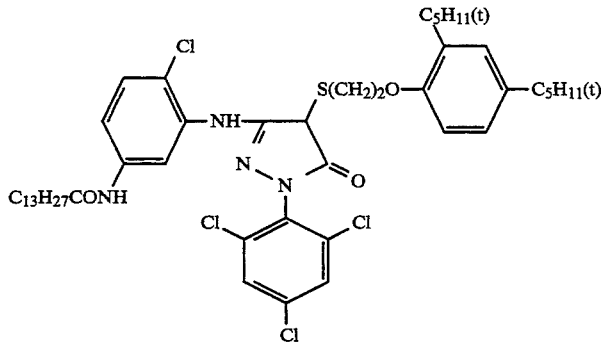
(M-18)
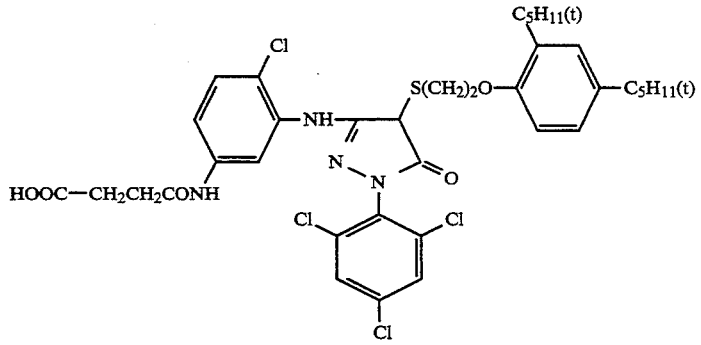
(M-19)
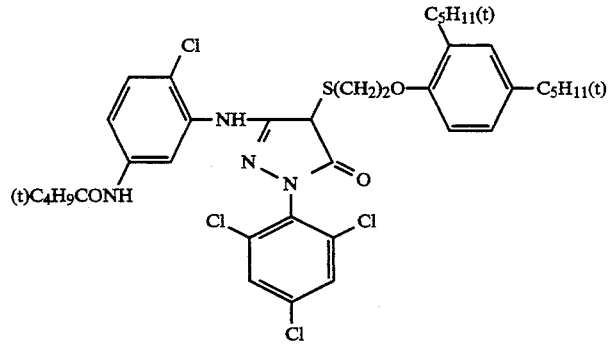
(M-20)
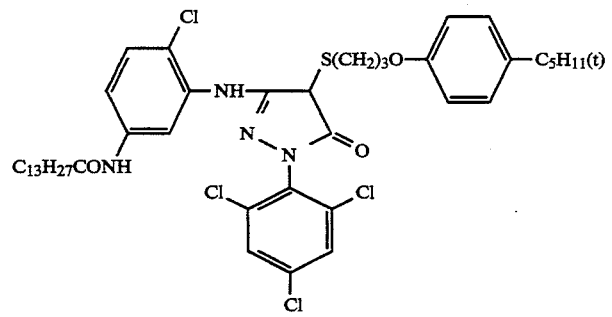

-continued
(M-21)
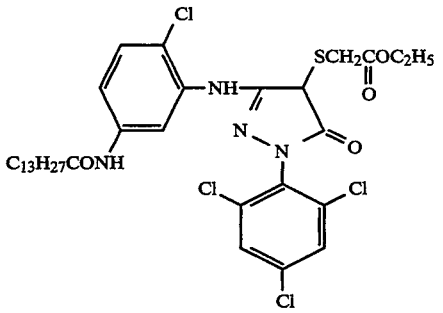
(M-22)
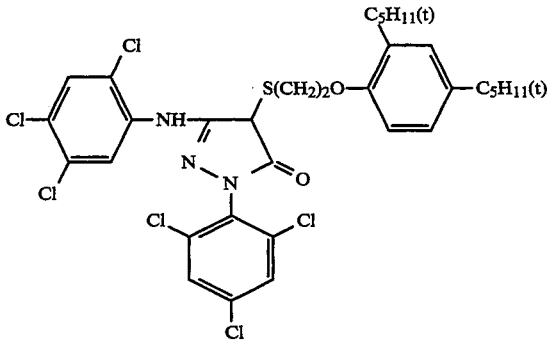
(M-23)
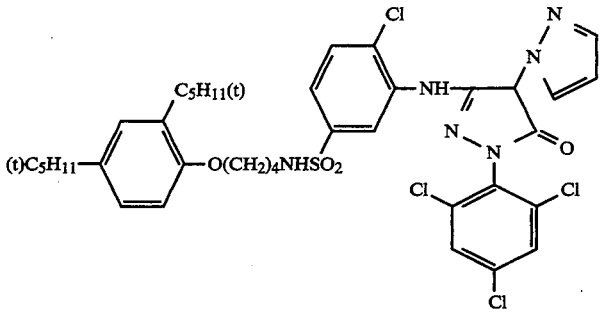
(M-24)
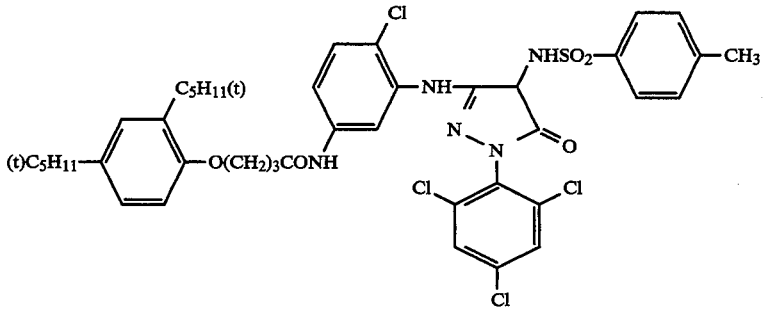
(M-25)
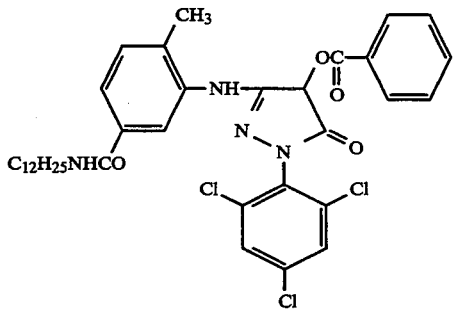

-continued
(M-26)
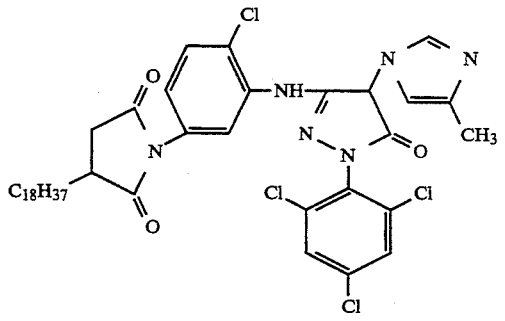
(M-27)
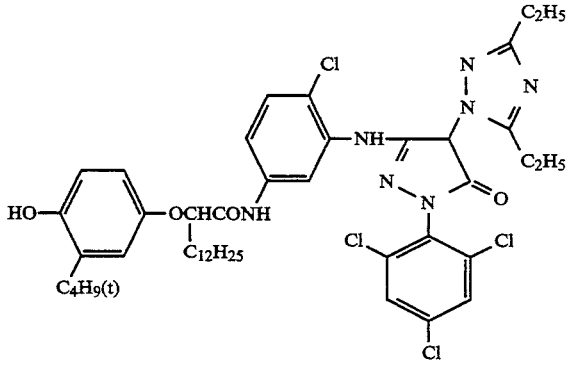
(M-28)
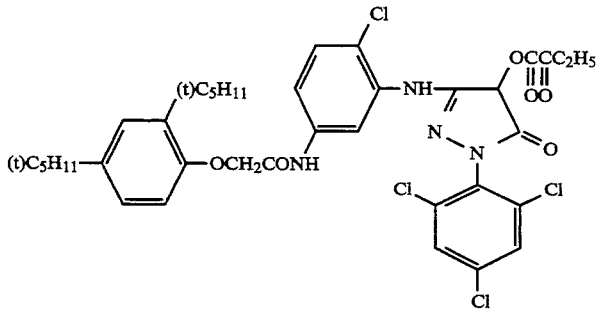
(M-29)
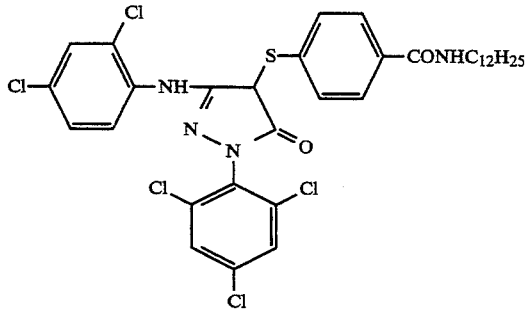
(M-30)
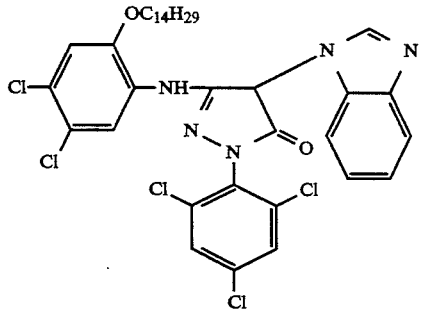

-continued
(M-31)
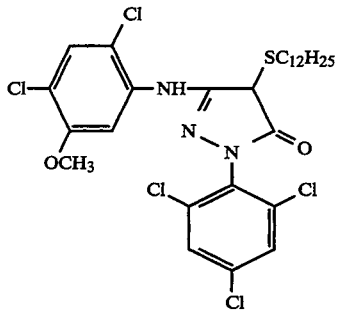
(M-32)
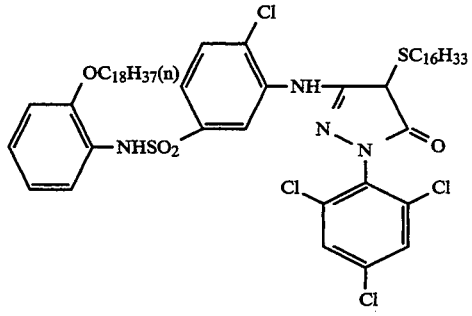
(M-33)
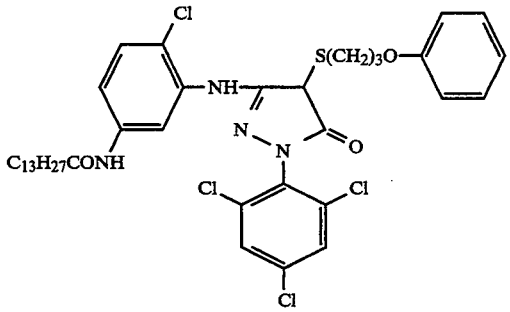
(M-34)
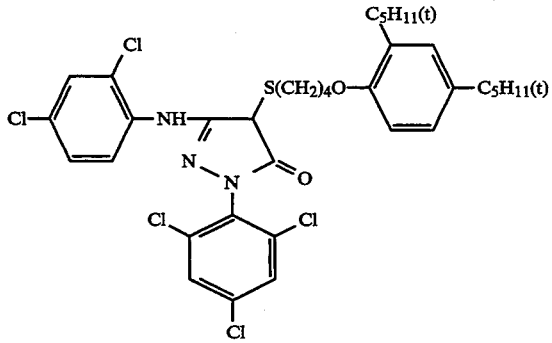
(M-35)
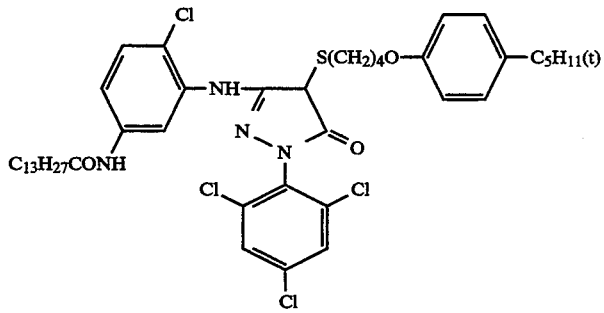

-continued
(M-36)
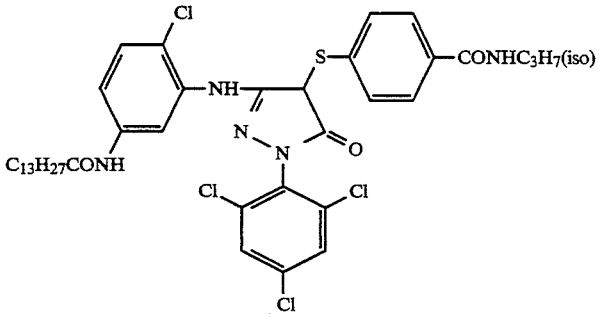
(M-37)
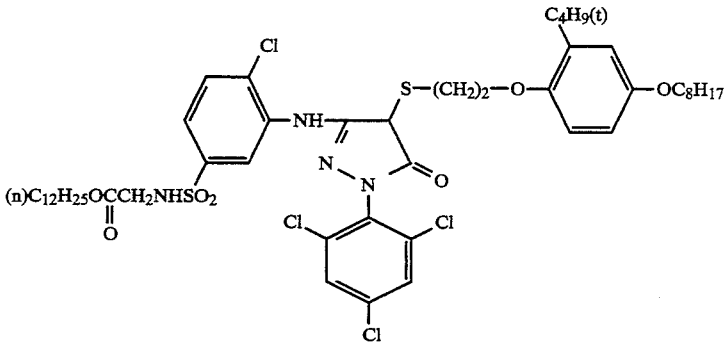
(M-38)
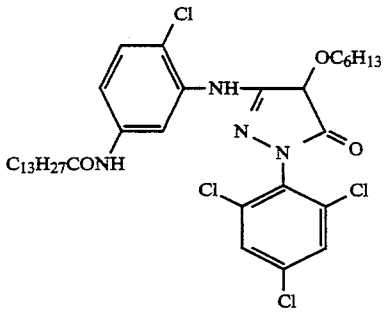
(M-39)
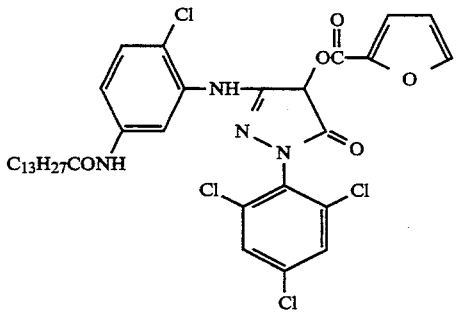
(M-40)
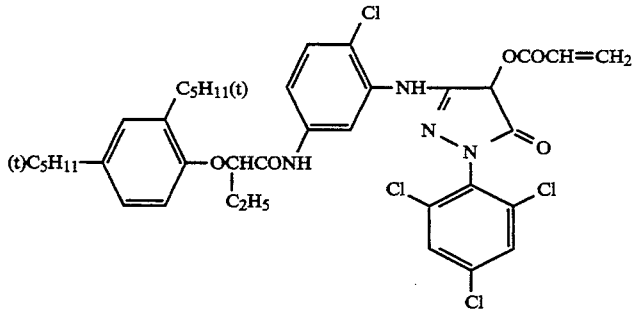

-continued
(M-41)
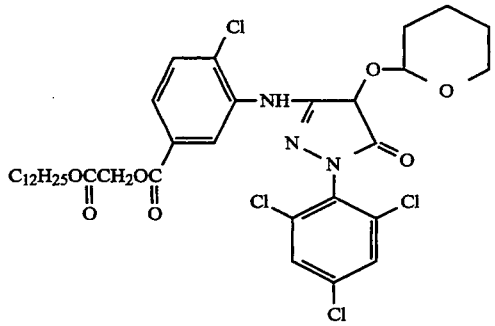
(M-42)
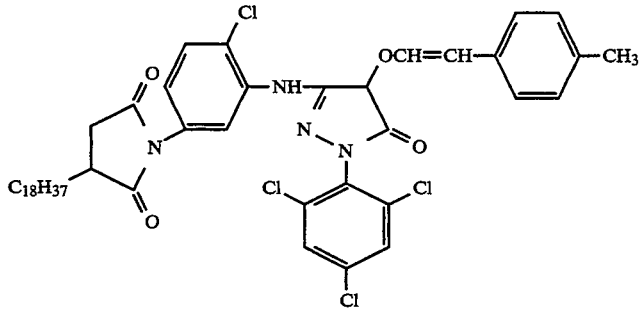
(M-43)
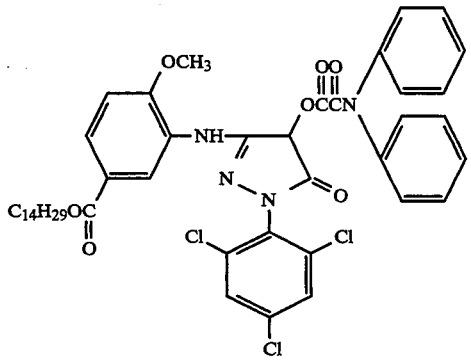
(M-44)
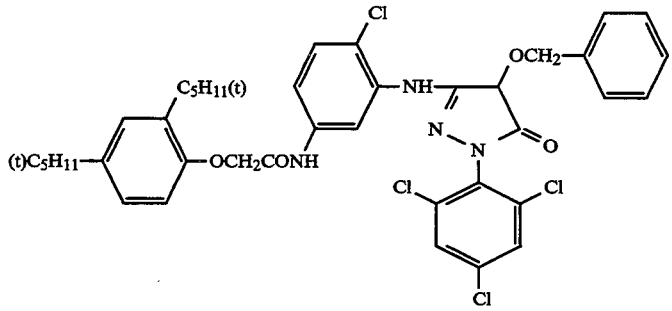
(M-45)
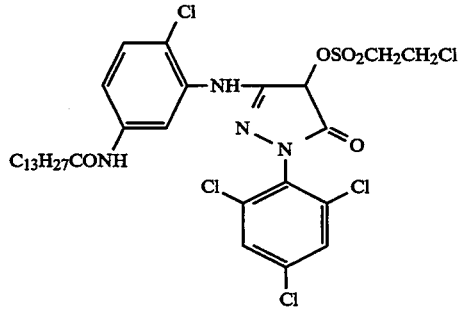

-continued
(M-46)
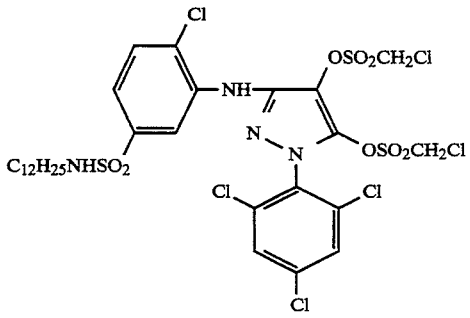
(M-47)
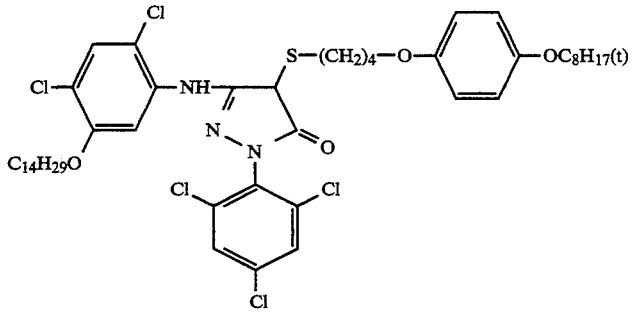
(M-48)
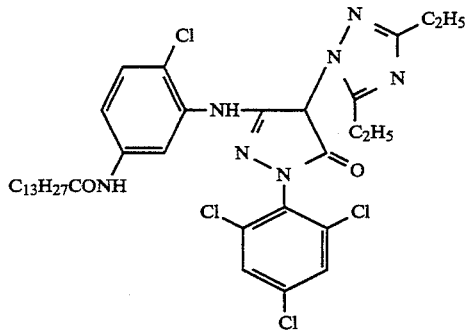
(M-49)
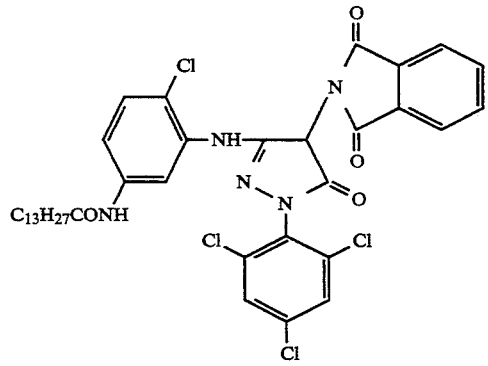
(M-50)
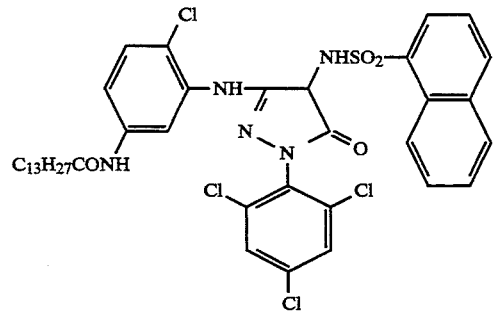

-continued
(M-51)
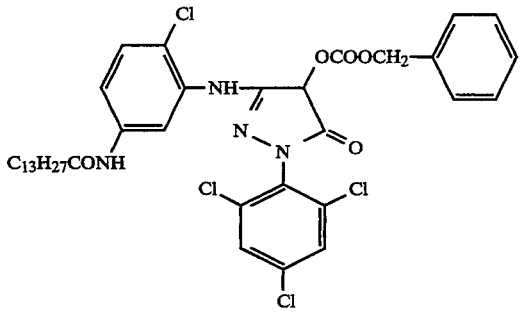
(M-52)
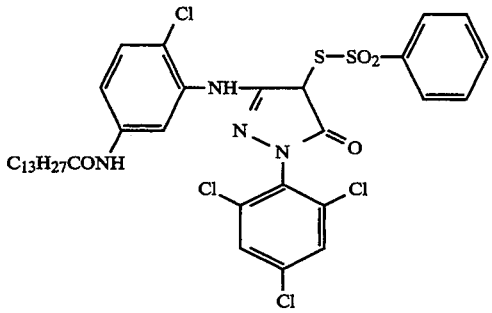
(M-53)
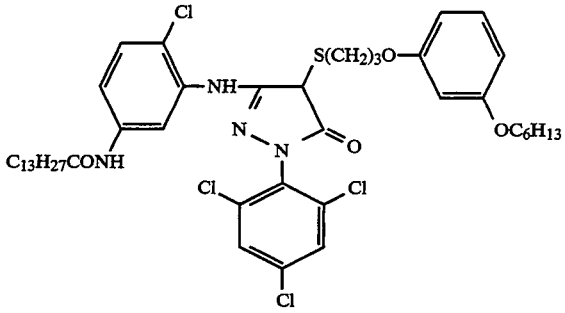
(M-54)
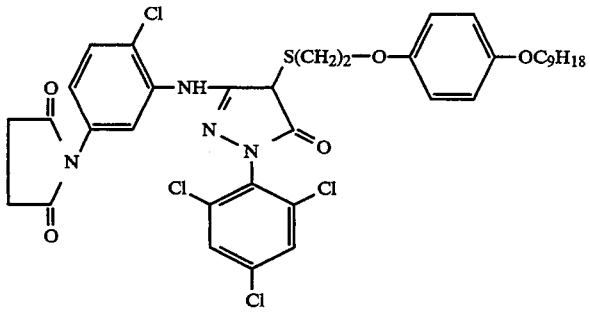
(M-55)
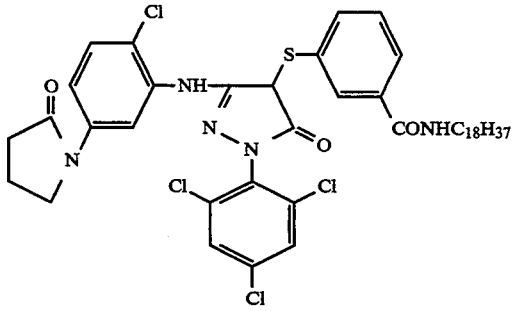

-continued
(M-56)
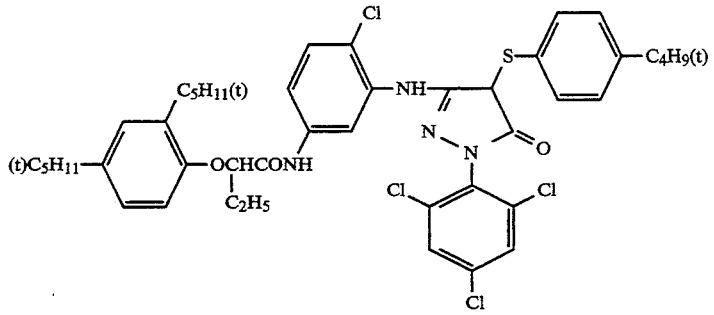
(M-57)
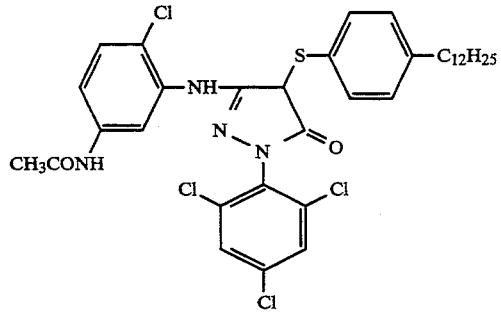
(M-58)
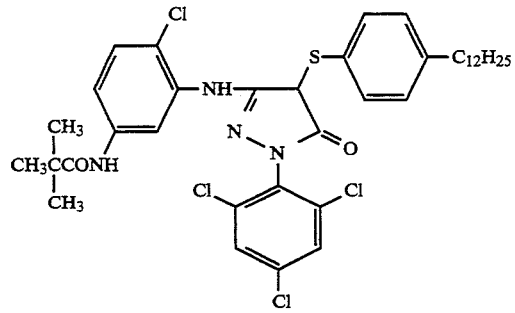
(M-59)
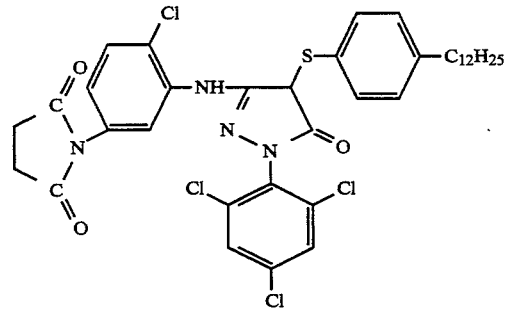
(M-60)
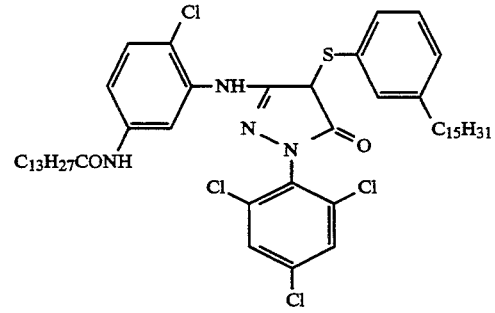

(M-61)
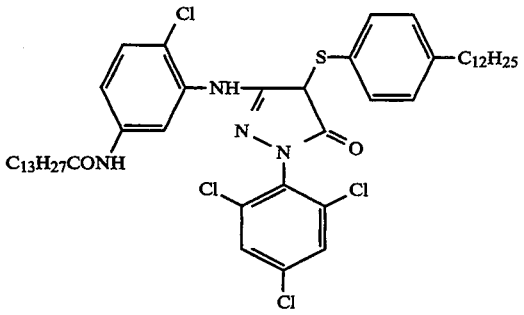
(M-62)
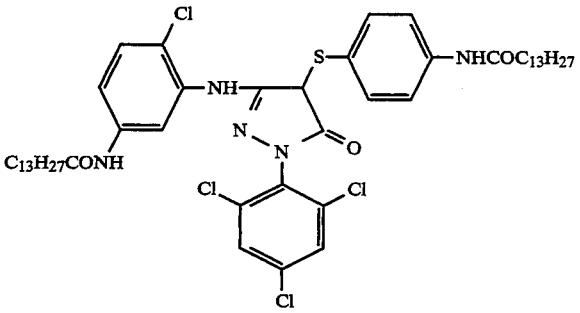
(M-63)
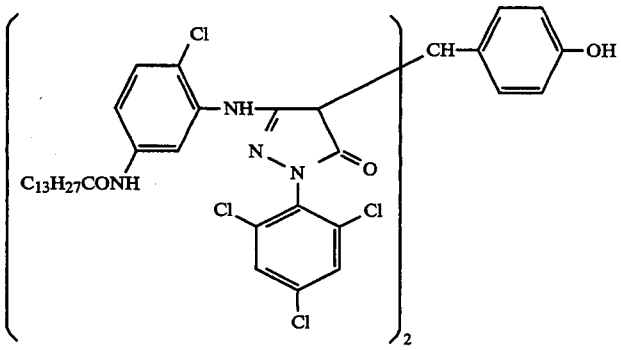
(M-64)
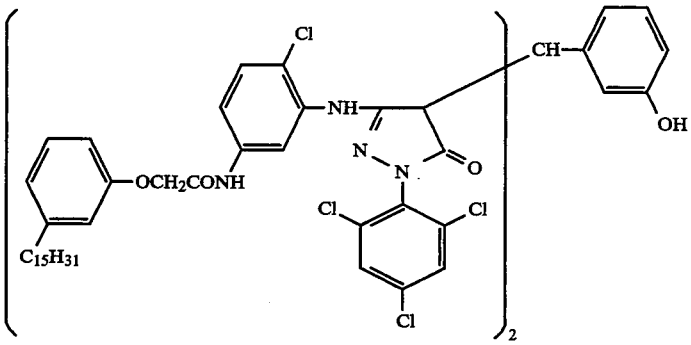
(M-65)
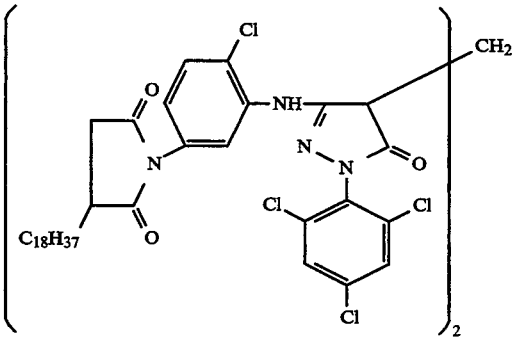

-continued
(M-66)
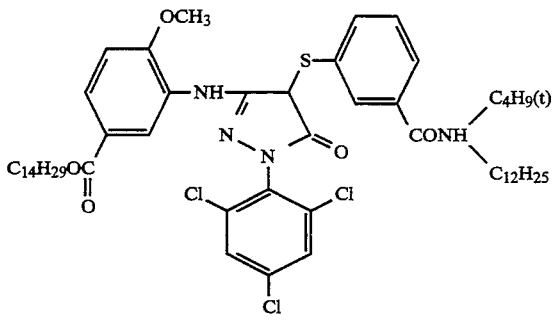
(M-67)
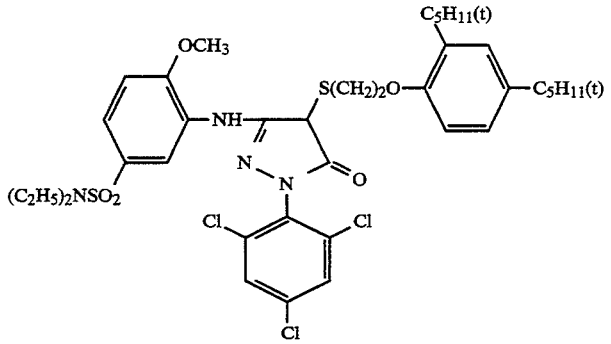
(M-68)
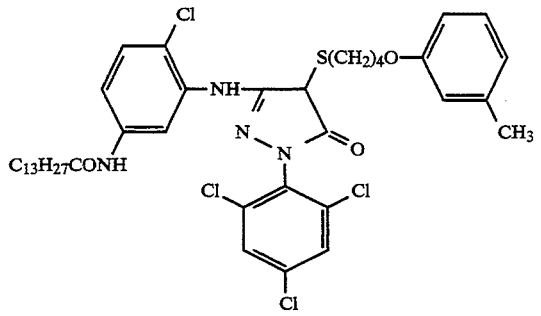
(M-69)
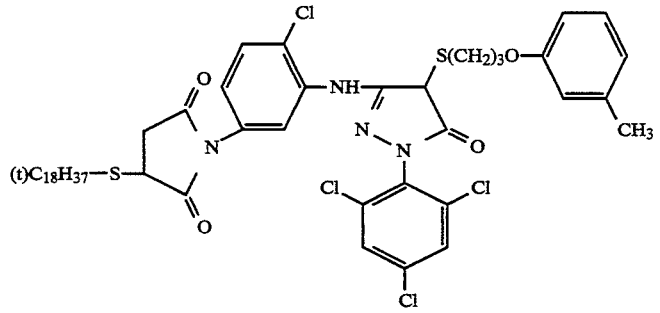
(M-70)
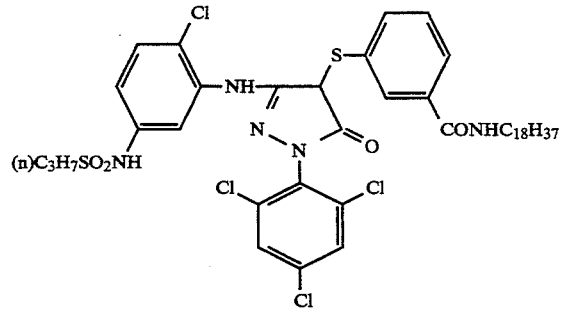

-continued
(M-71)
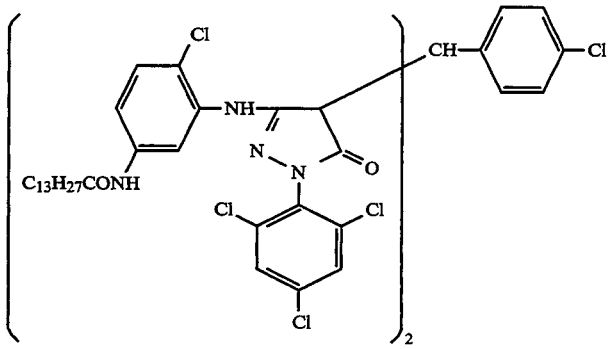
(M-72)
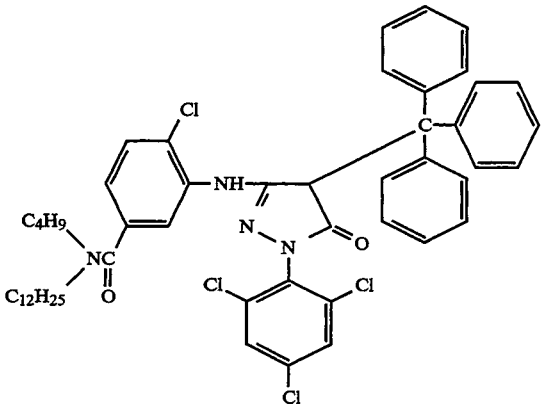
(M-73)
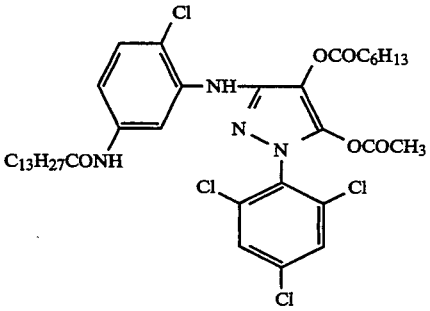
(M-74)
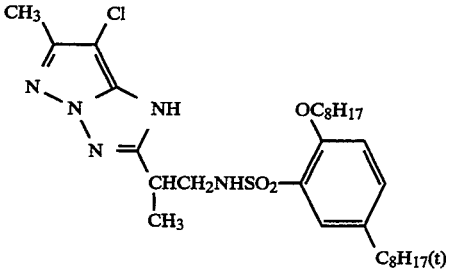
(M-75)
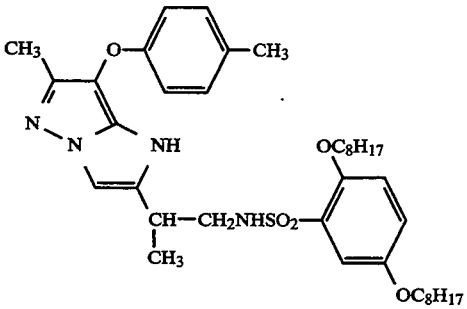

-continued
(M-76)
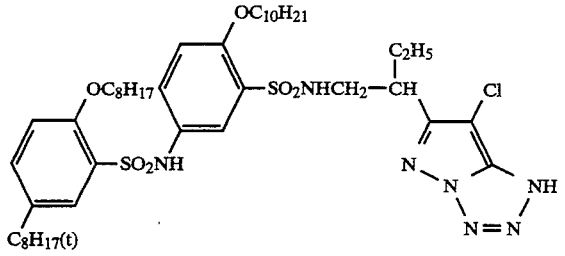
(M-77)
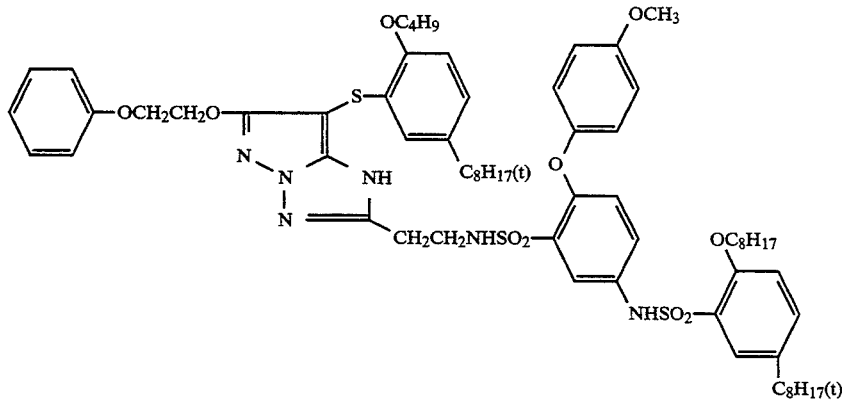
(M-78)
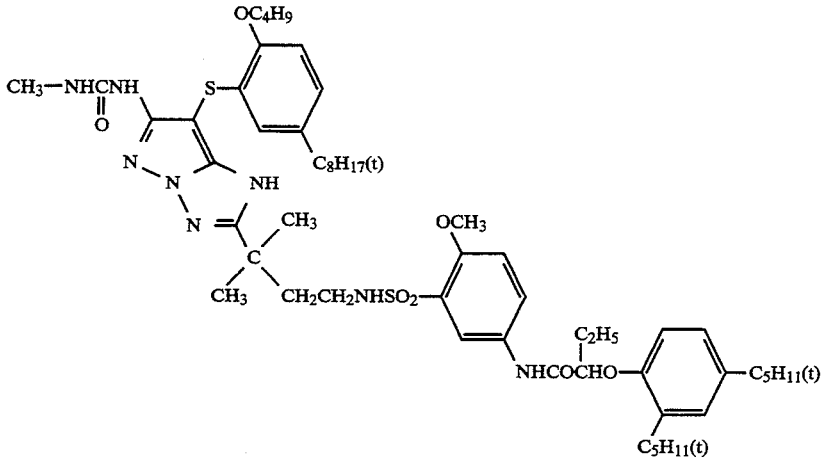
(M-79)
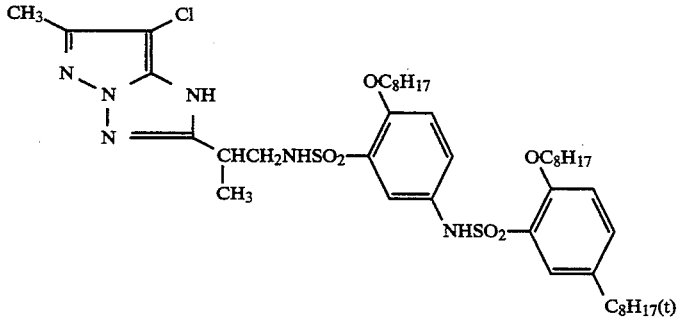
(M-80)
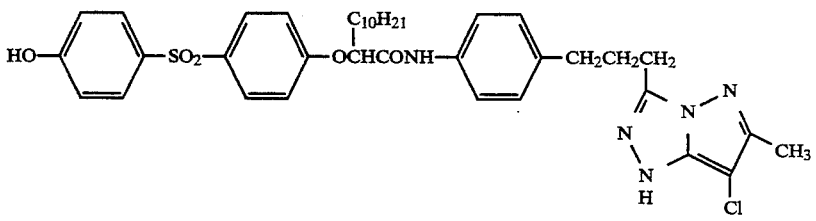

-continued
(M-81)
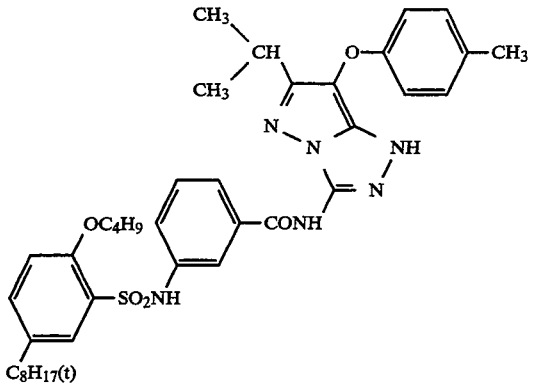
(M-82)
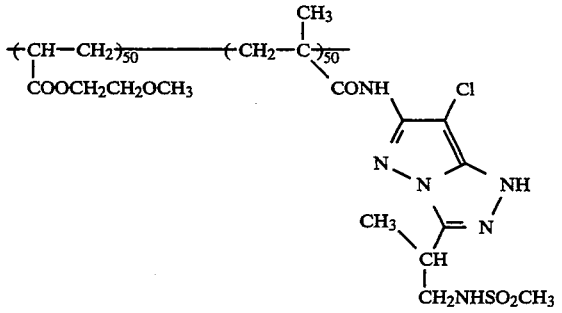
(M-83)
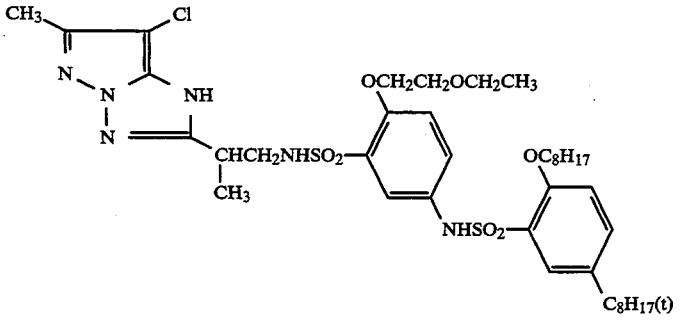
(M-84)
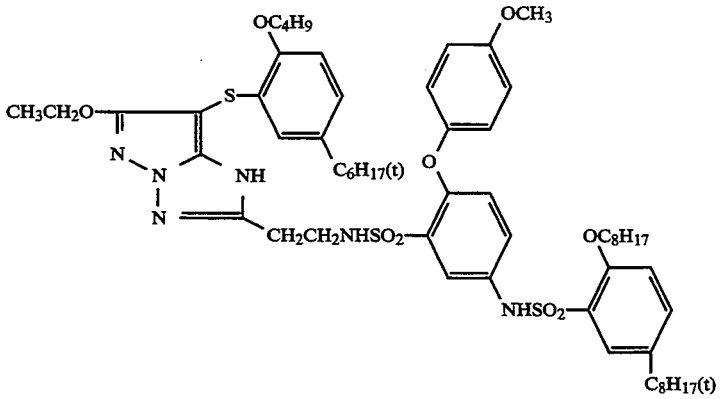

-continued
(M-85)
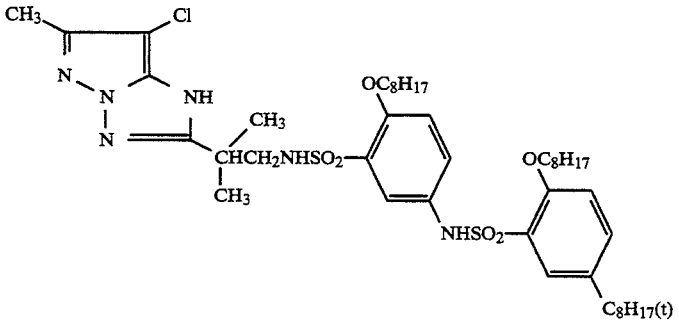
(M-86)
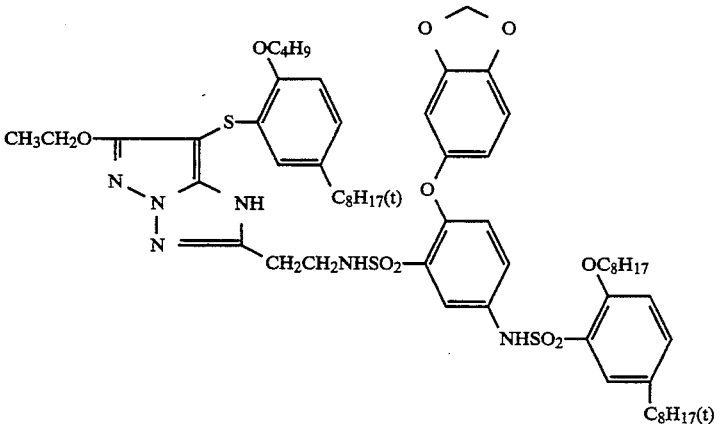
(M-87)
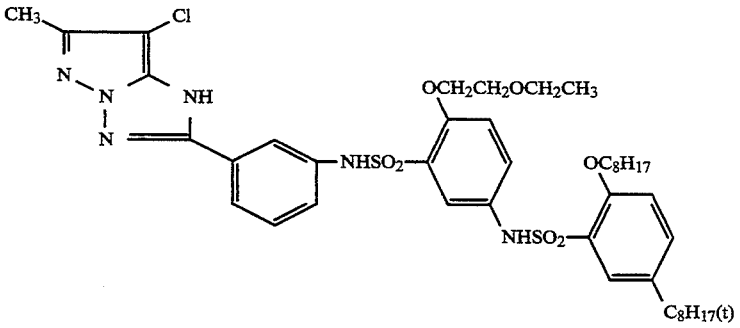
(M-88)
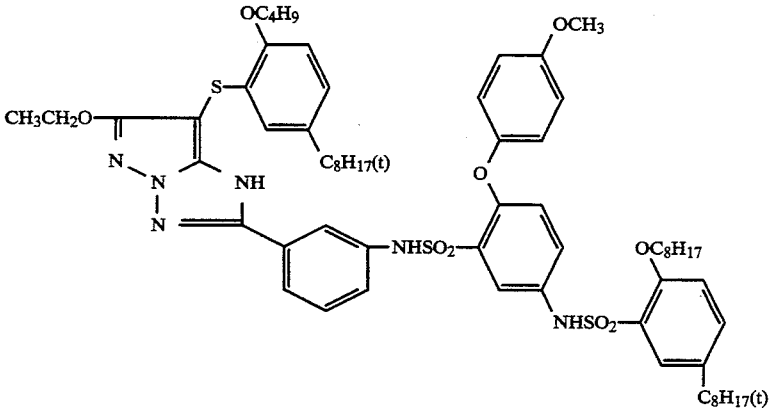

-continued
(M-89)
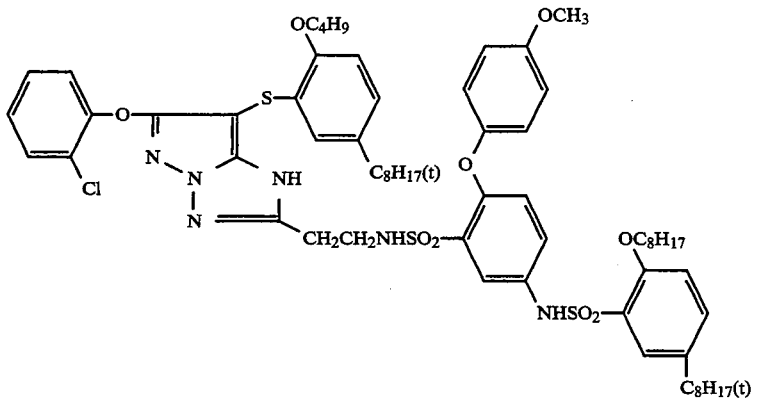
(M-90)
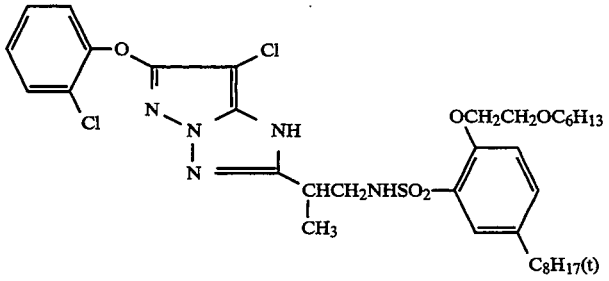
(M-91)
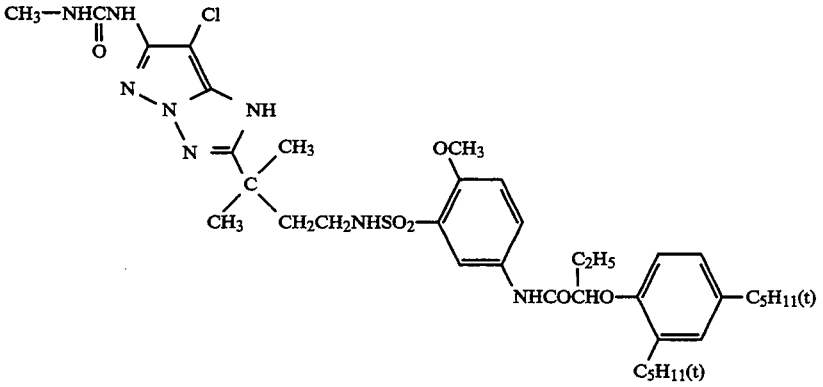
(M-92)
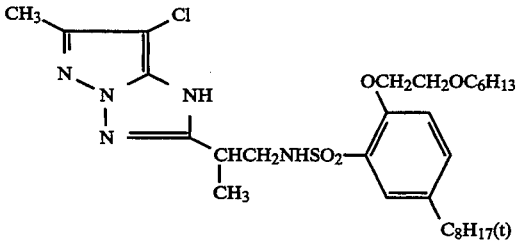
(Y-1)
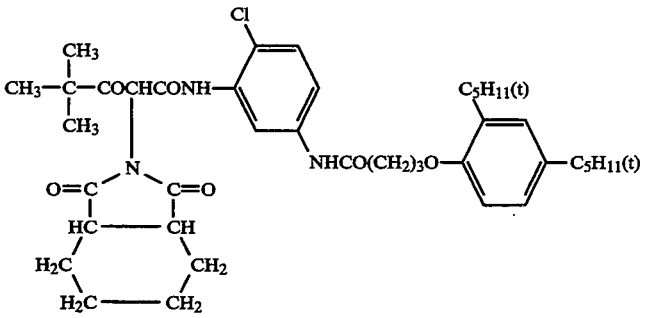

-continued
(Y-2)
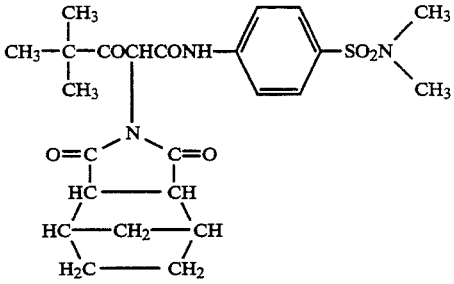
(Y-3)
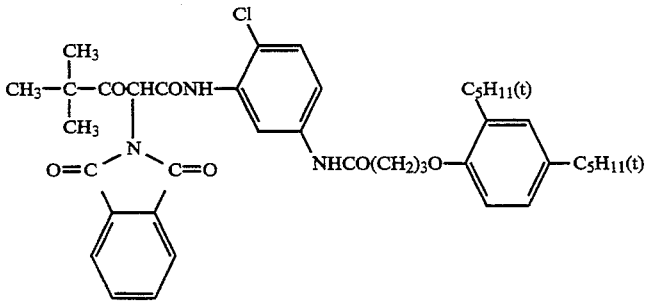
(Y-4)
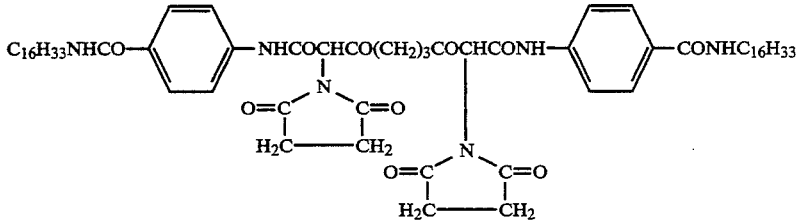
(Y-5)
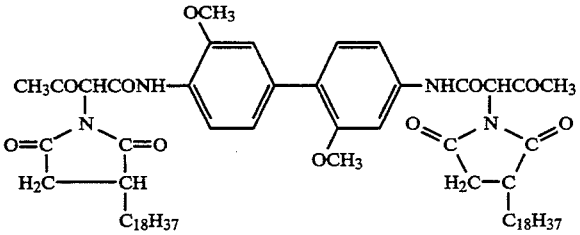
(Y-6)
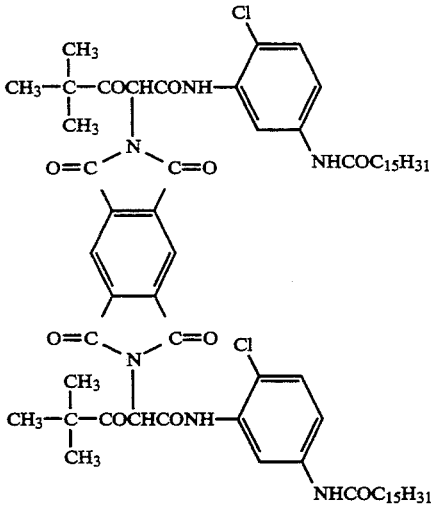

-continued
(Y-7)
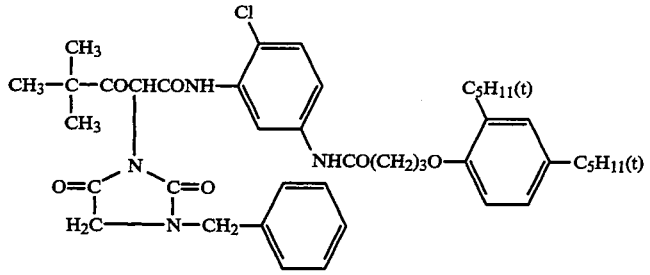
(Y-8)
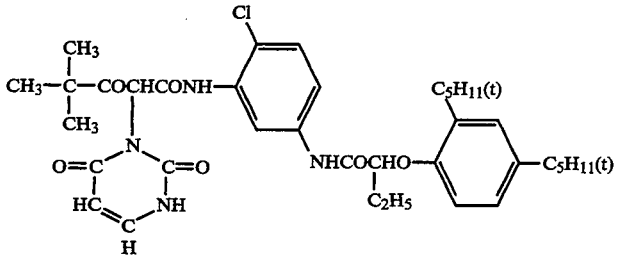
(Y-9)
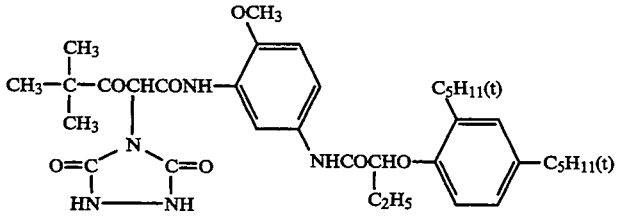
(Y-10)
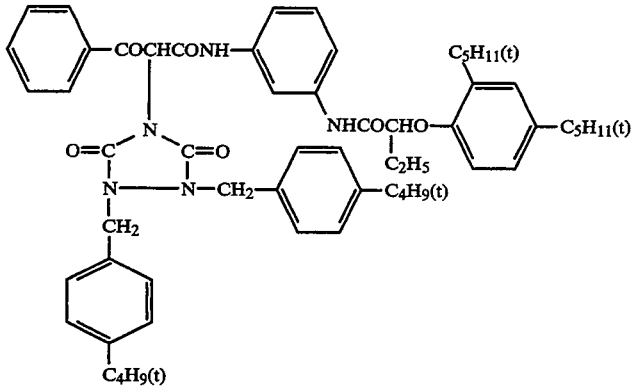
(Y-11)
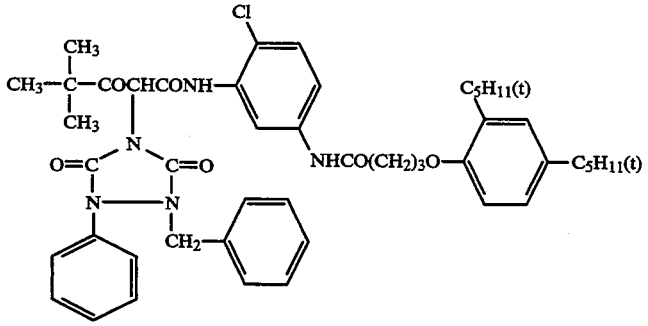

(Y-12)
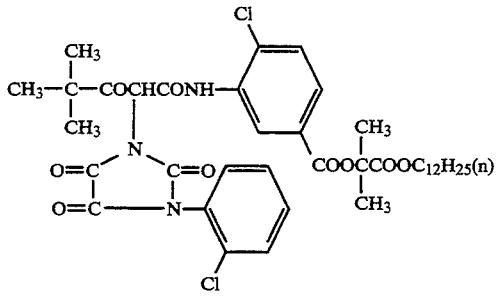
(Y-13)
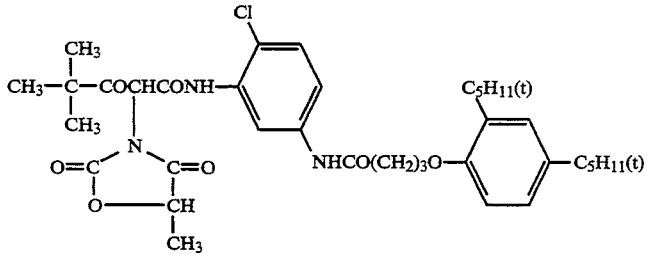
(Y-14)
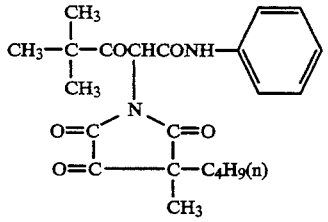
(Y-15)
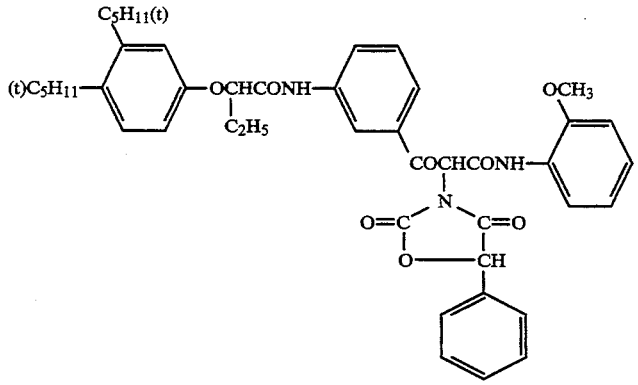
(Y-16)
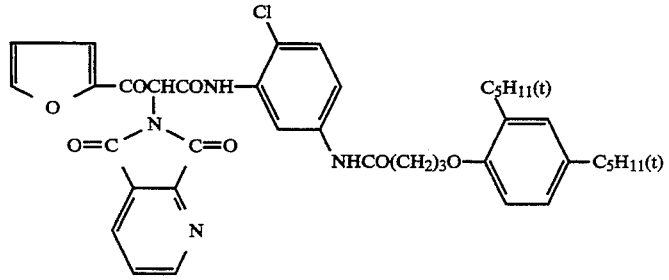

-continued
(Y-17)
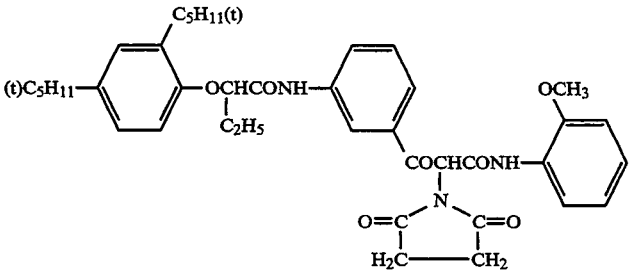
(Y-18)
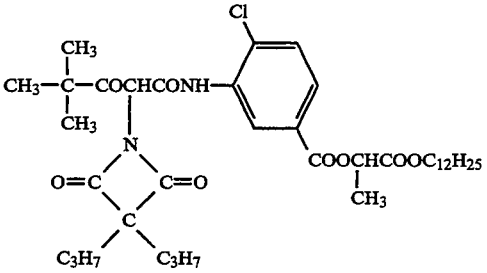
(Y-19)
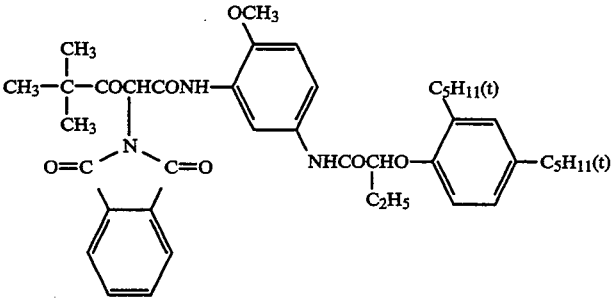
(Y-20)
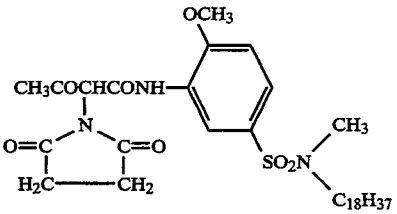
(Y-21)
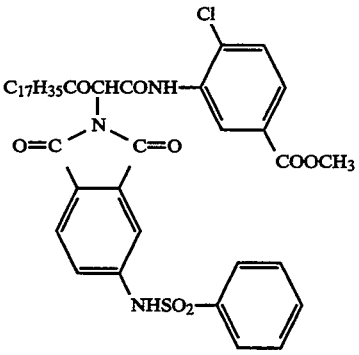

-continued
(Y-22)
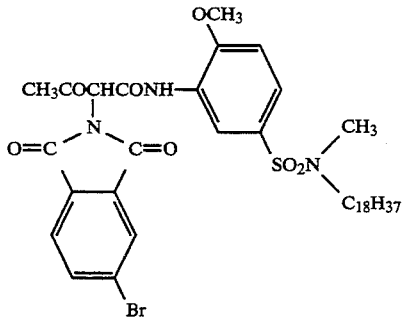
(Y-23)
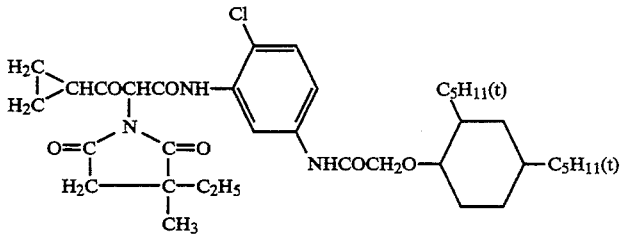
(Y-24)
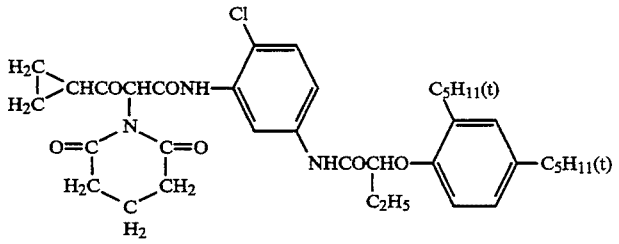
(Y-25)
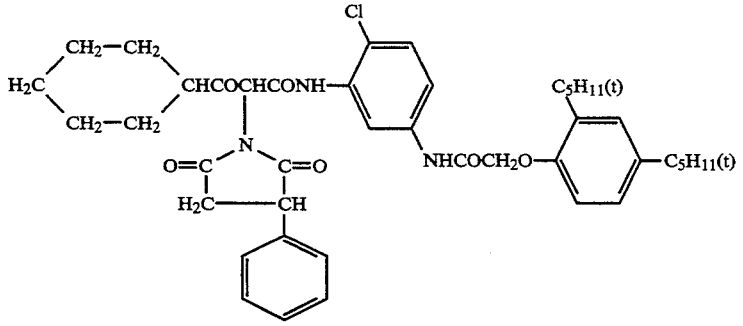
(Y-26)
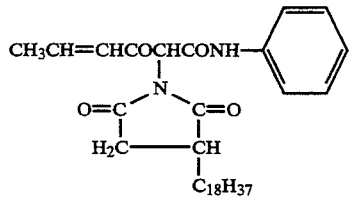
(Y-27)
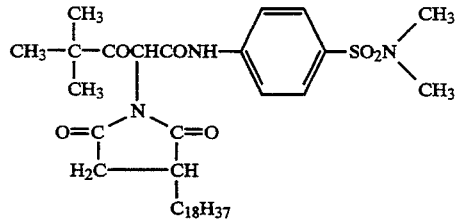

-continued
(Y-28)
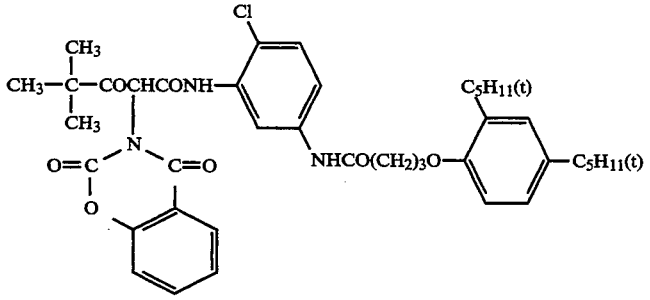
(Y-29)
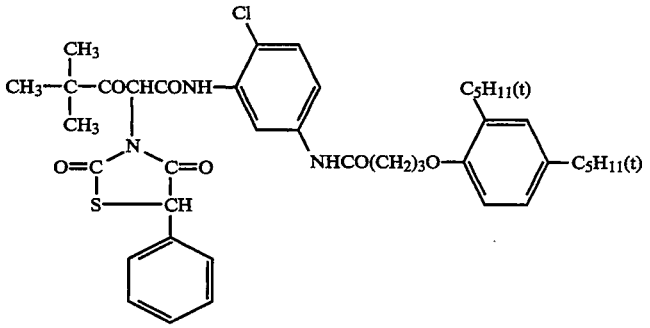
(Y-30)
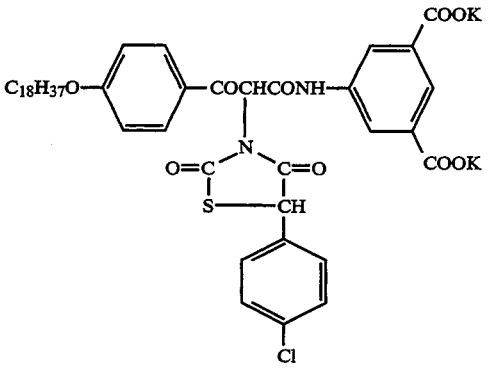
(Y-31)
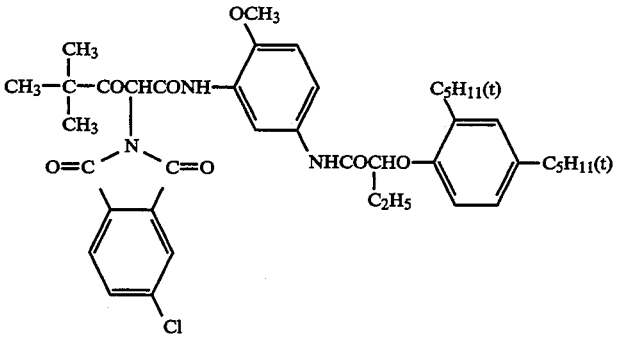
(Y-32)
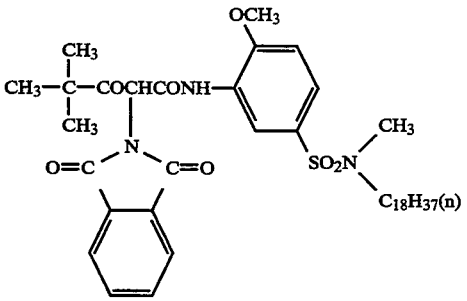

-continued
(Y-33)
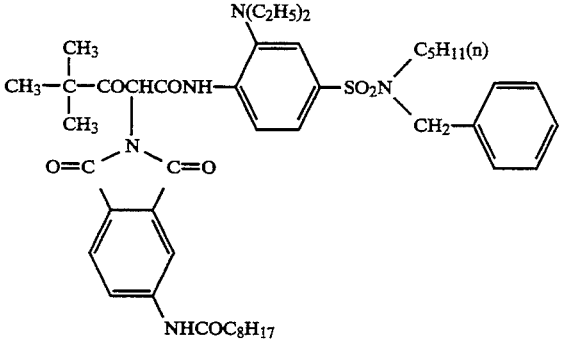
(Y-34)
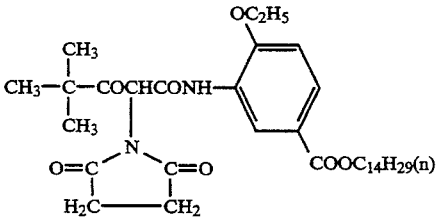
(Y-35)
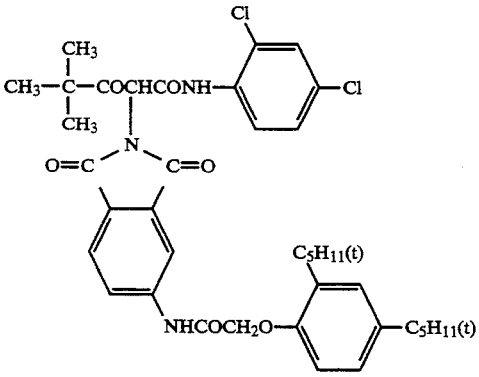
(Y-36)
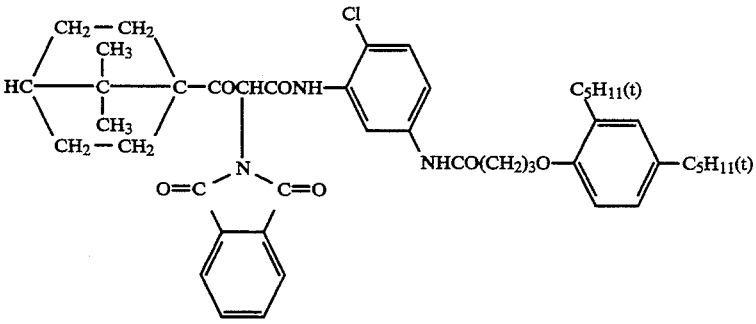
(Y-37)
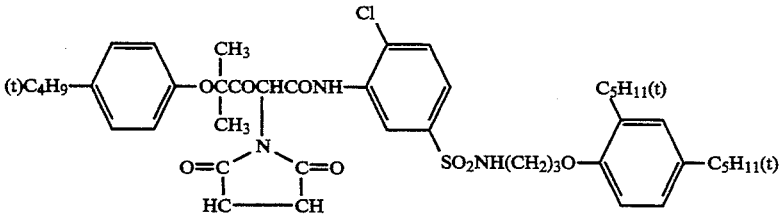

-continued
(Y-38)
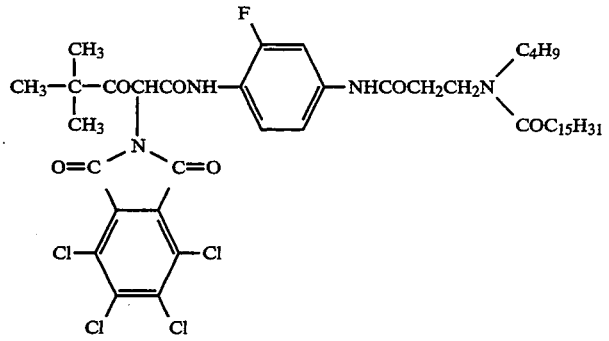
(Y-39)
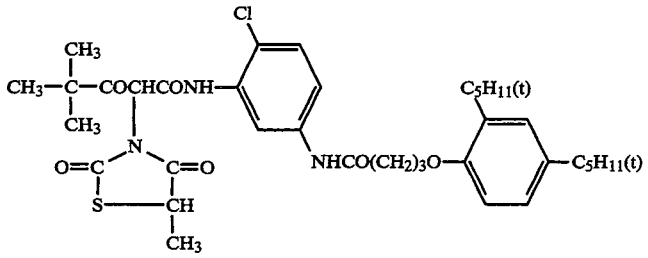
(Y-40)
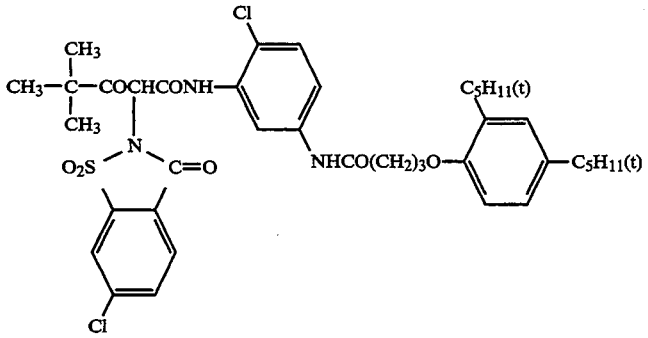
(Y-41)
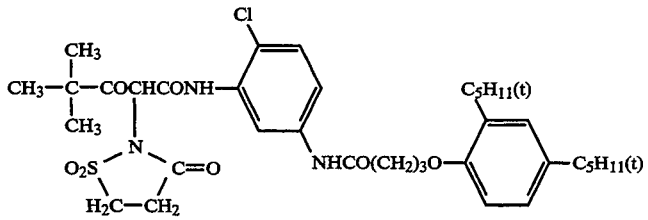
(Y-42)
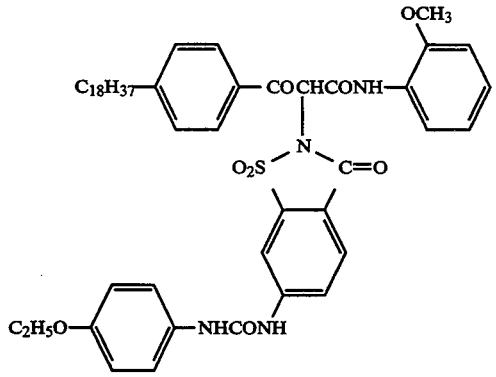

-continued
(Y-43)
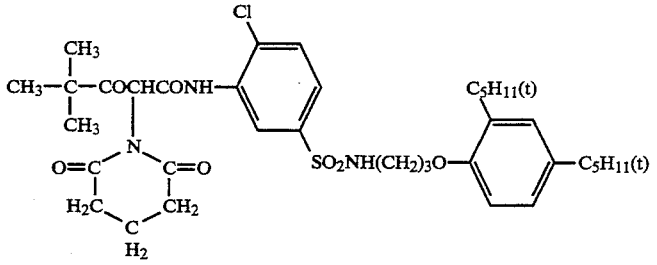
(Y-44)
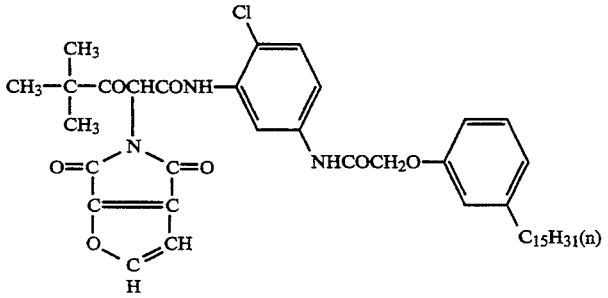
(Y-45)
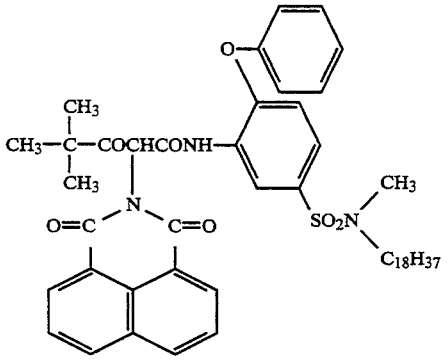
(Y-46)
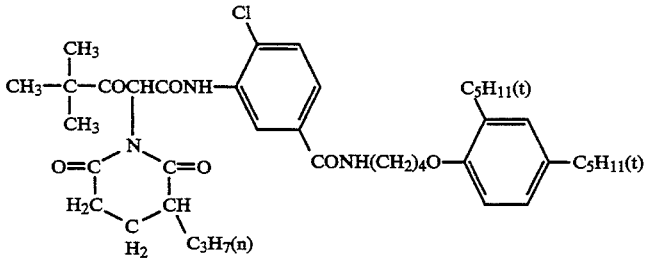
(Y-47)
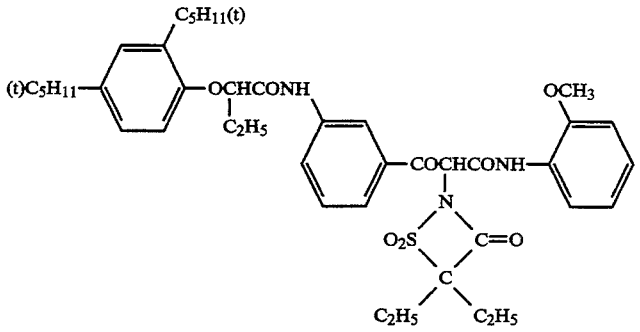

-continued
(Y-48)
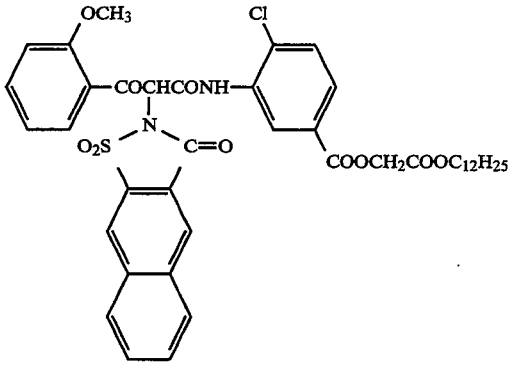
(Y-49)
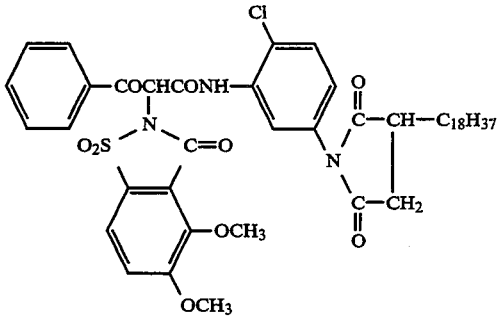
(Y-50)
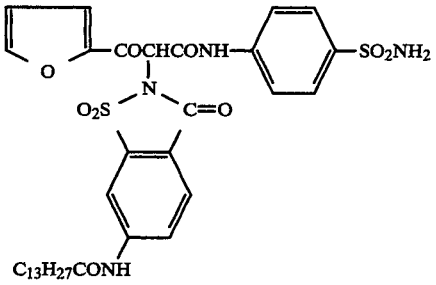
(Y-51)
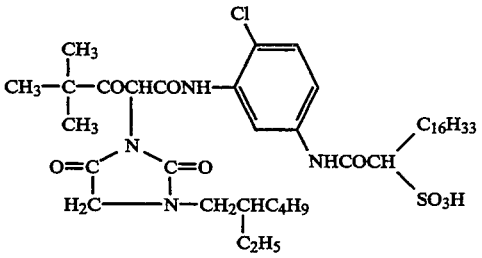
(Y-52)
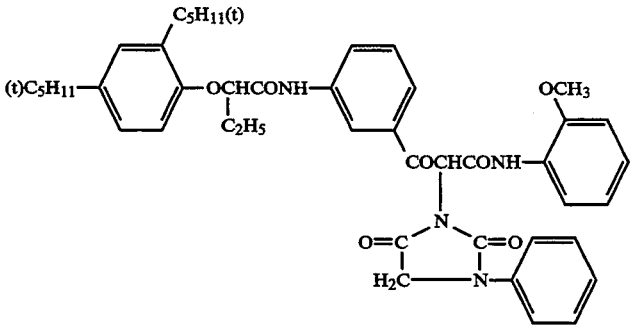

-continued
(Y-53)
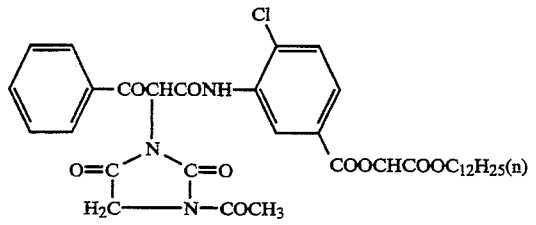
(Y-54)
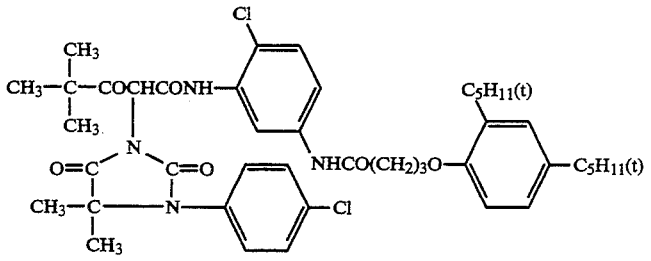
(Y-55)
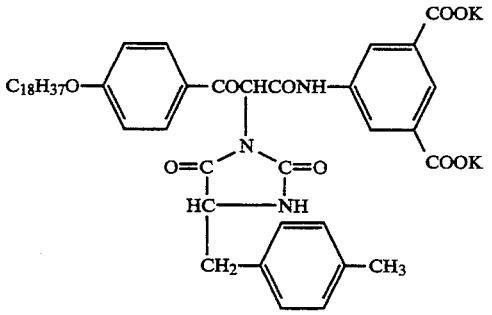
(Y-56)
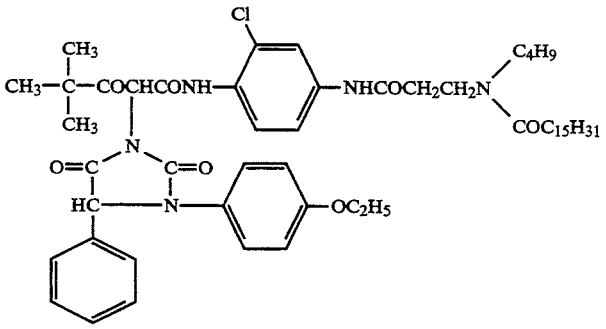
(Y-57)
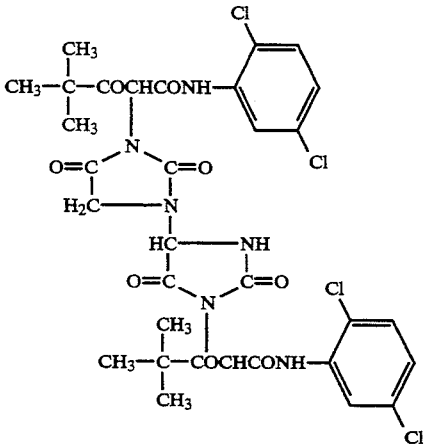

-continued
(Y-58)
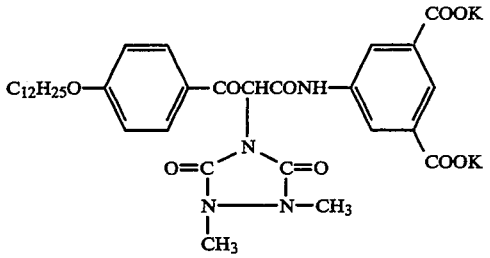
(Y-59)
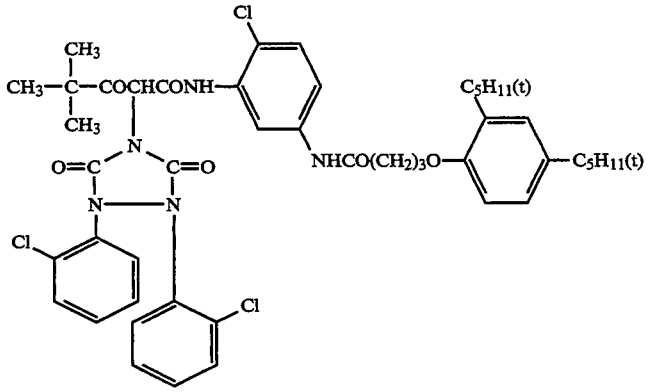
(Y-60)
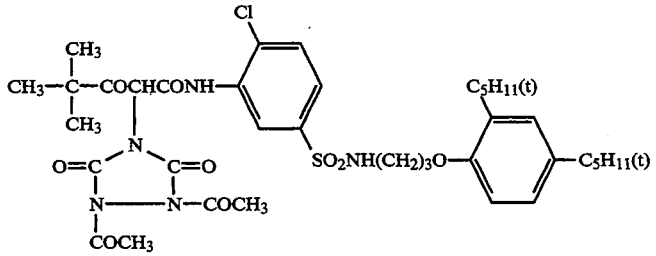
(Y-61)
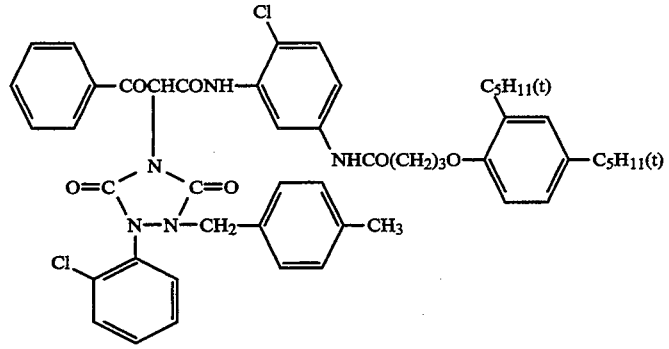
(Y-62)
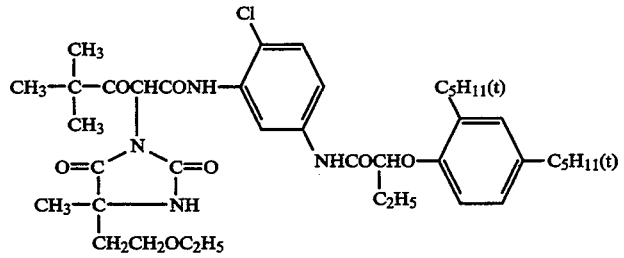

-continued
(Y-63)
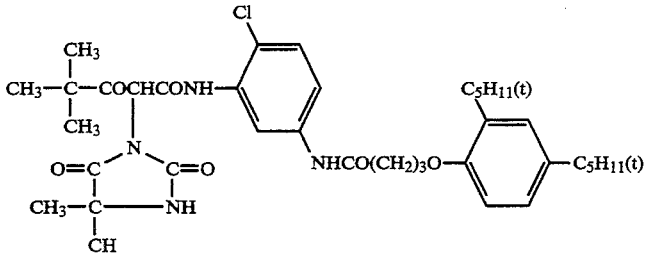
(Y-64)
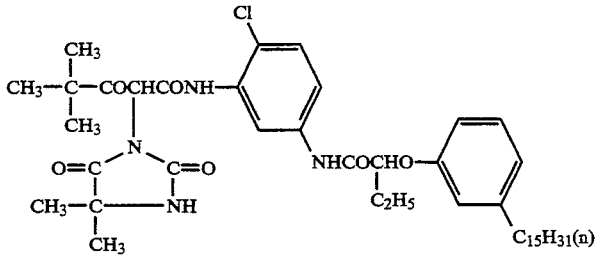
(Y-65)
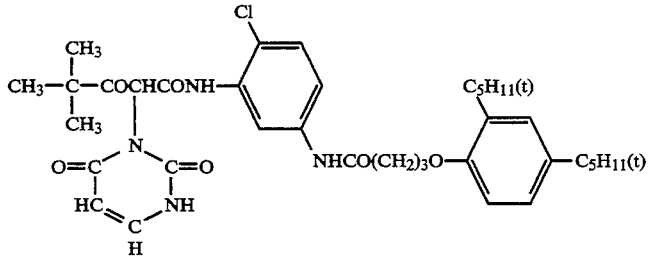
(Y-66)
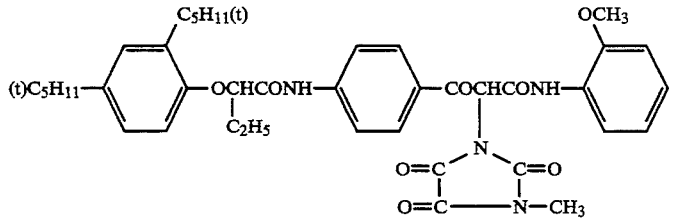
(Y-67)
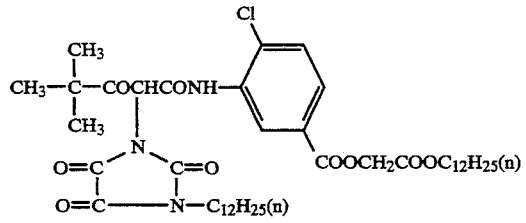
(Y-68)
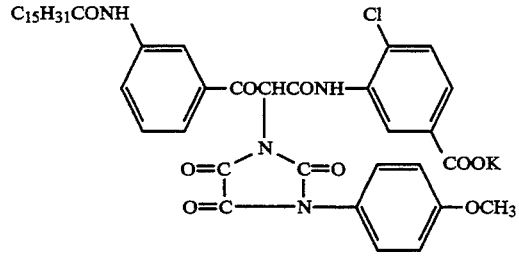

-continued
(Y-69)
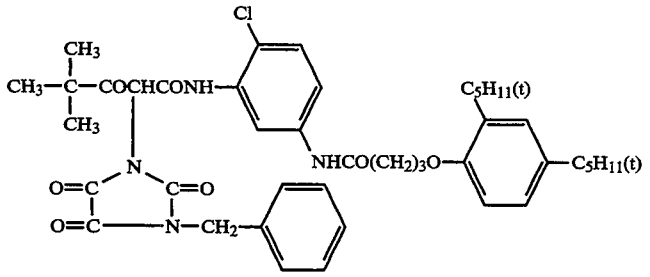
(Y-70)
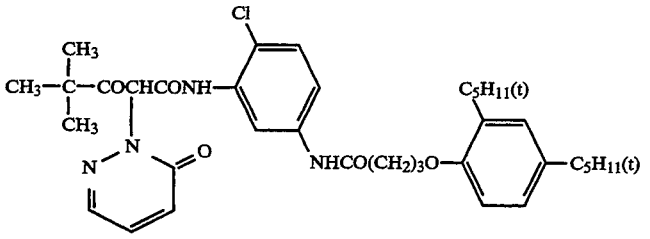
(Y-71)
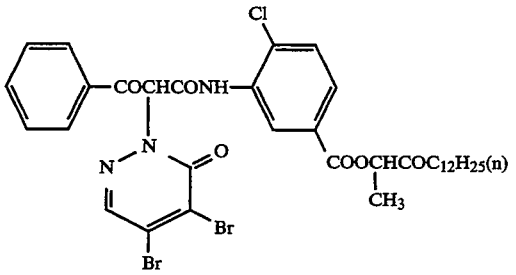
(Y-72)
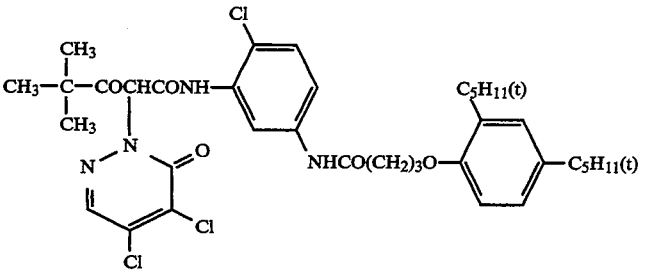
(Y-73)
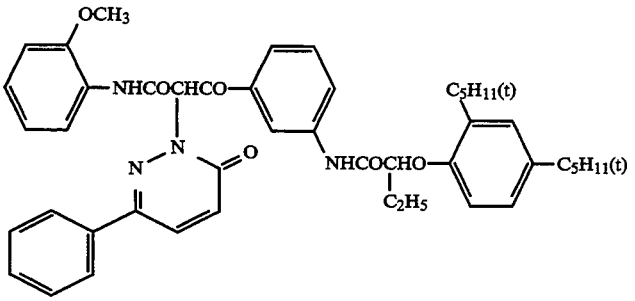
(Y-74)
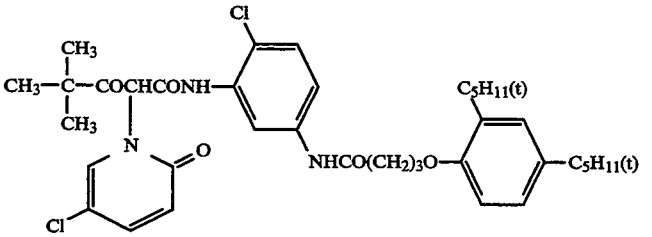

-continued
(Y-75)
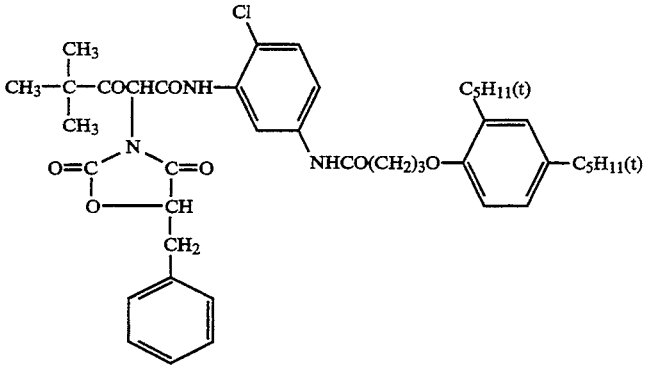
(Y-76)
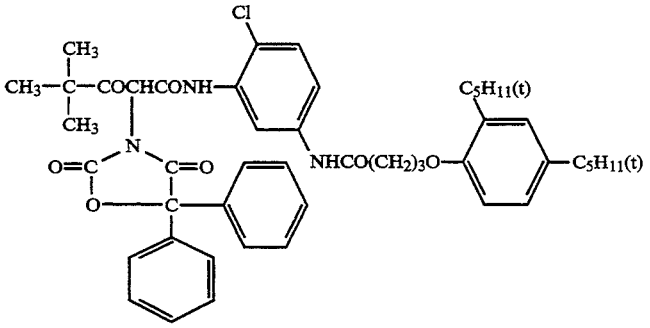
(Y-77)
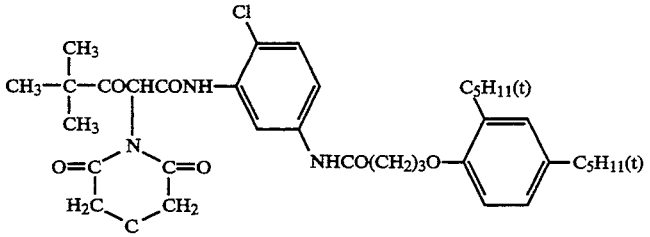
(Y-78)
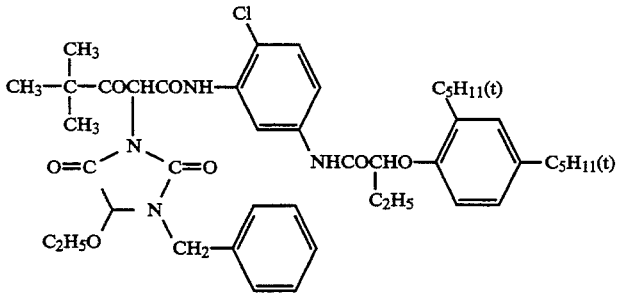
(Y-79)
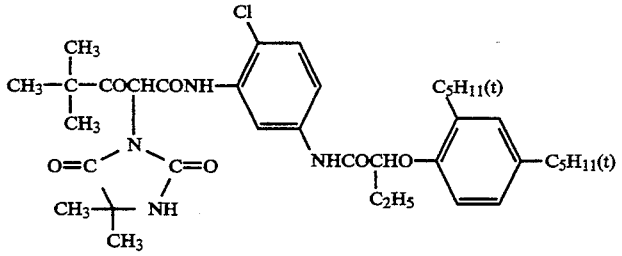

-continued
(Y-80)
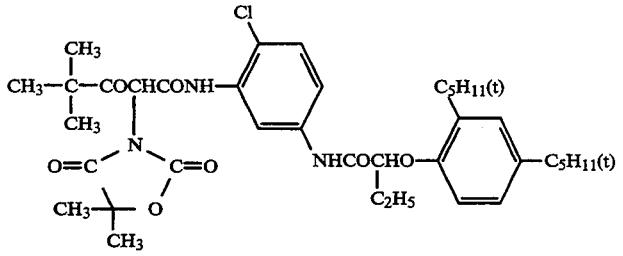
(Y-81)
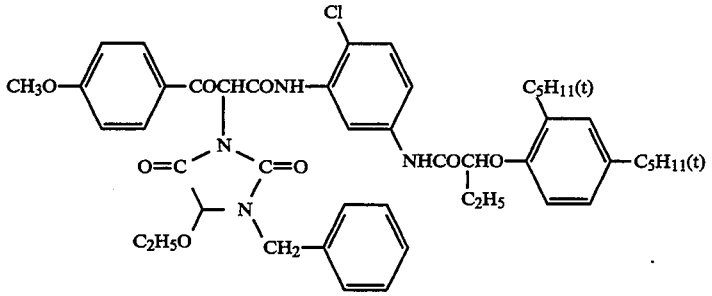
(Y-82)
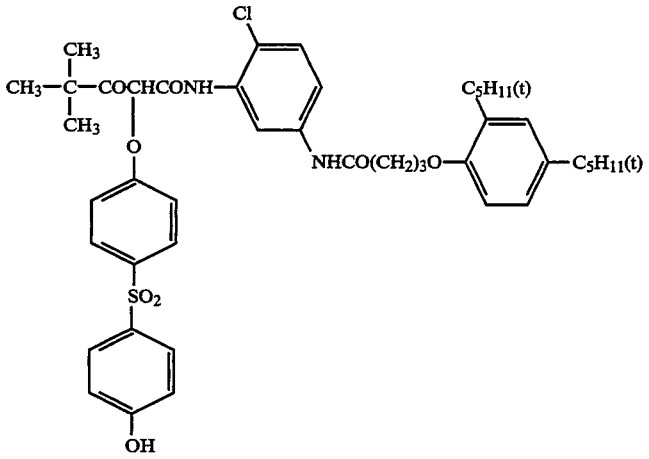
(Y-83)
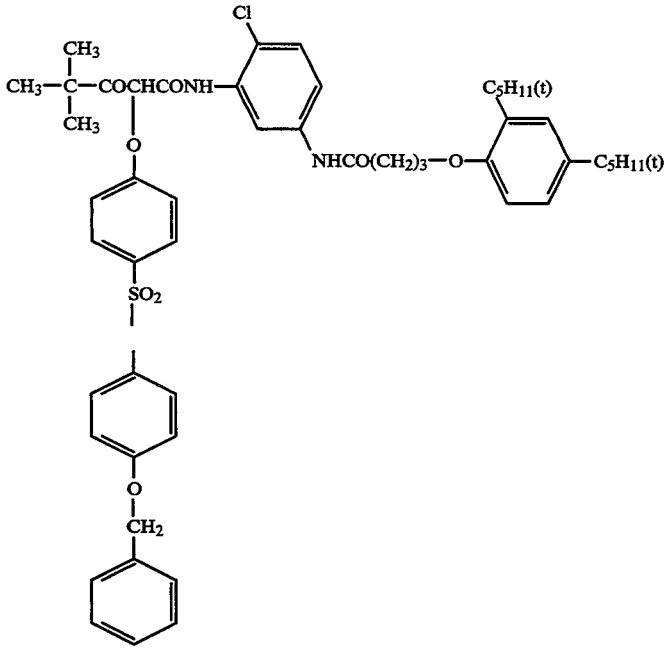

-continued (Y-84)

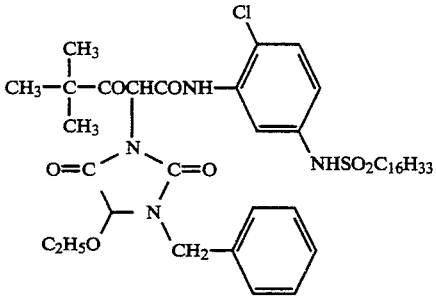

(Y-85)

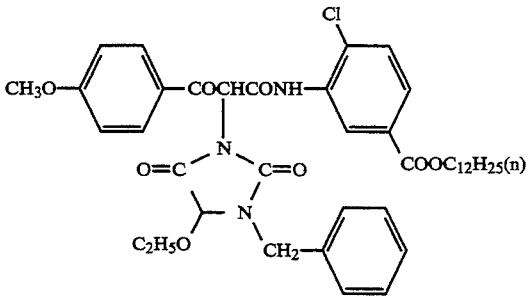

The cyan couplers for use in the present invention are not specifically limited, unlike the magenta couplers, but those represented by the following formulae (V) and (VI) are preferred.

(V)

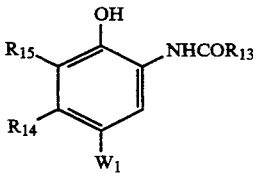

(VI)

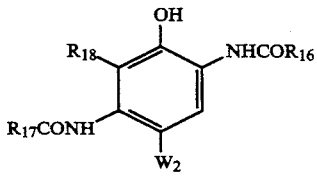

In the above formulae, $R_{13}$, $R_{16}$ and $R_{17}$ each represents an aliphatic group (the aliphatic group means a linear, branched or cyclic aliphatic hydrocarbon group which may be saturated or unsaturated, such as an alkyl group, an alkenyl group or an alkynyl group, and it has preferably from 1 to 36 carbon atoms, such as n-methyl, n-ethyl, n-butyl, n-pentyl, n-dodecyl, octadecyl, eicosenyl, i-propyl, t-butyl, t-octyl, t-dodecyl, cyclohexyl, cyclopentyl, allyl, vinyl, 2-hexadecenyl or propargyl group), an aromatic group (preferably having from 6 to 36 carbon atoms, such as a phenyl or naphthyl group), a heterocyclic group (e.g., 3-pyridyl or 2-furyl group), or an aromatic or heterocyclic amino group (e.g., anilino, naphthylamino, 2-benzothiazolylamino or 2-pyridylamino group). These groups may further be substituted by substituent(s) selected from an alkyl group, an aryl group, a heterocyclic group, an alkoxy group (e.g., methoxy, 2-methoxyethoxy), an aryloxy group (e.g., 2,4-di-t-amylphenoxy, 2-chlorophenoxy, 4-cyanophenoxy), an alkenyloxy group (e.g., 2-propenyloxy), an acyl group (e.g., acetyl, benzoyl), an ester group (e g., butoxycarbonyl, phenoxycarbonyl, acetoxy, benzoyloxy, butoxysulfonyl, toluenesulfonyloxy), an amido group (e.g., acetylamino), a carbamoyl group (e.g,, ethylcarbamoyl, dimethylcarbamoyl), a sulfonamido group (e.g., methanesulfonamido), a sulfamoyl group (e.g., butylsulfamoyl), a sulfamoyiamino group (e.g., dipropylsulfamoylamino), an imido group (e.g., succinimido, hydantoinyl), a ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxyl group, a cyano group, a carboxyl group, a nitro group, a sulfo group and a halogen atom.

$R_{14}$ represents an aliphatic group, preferably having from 1 to 20 carbon atoms, and the group may be substituted by the substituent(s) mentioned above for $R_{13}$.

$R_{15}$ and $R_{18}$ each represents a hydrogen atom a halogen atom (e.g., fluorine, chlorine, bromine), an aliphatic group (preferably having from 1 to 20 carbon atoms), an aliphatic oxy group (preferably having from 1 to 20 carbon atoms), or an acylamino group (preferably having from 1 to 20 carbon atoms, such as acetamido, benzamido, tetradecanamido). These groups may be substituted by the substituent(s) mentioned above for $R_{13}$.

$R_{14}$ and $R_{15}$ may be bonded to each other to form a 5-, 6- or 7-membered ring as a condensed ring such as a carbostyryl or oxyindole ring. $R_{17}$ and $R_{18}$ may also be bonded to each other to form a 5-, 6- or 7-membered ring as a condensed ring such as a carbostyryl or oxyindole ring.

The compounds of formulae (V) and (VI) may form dimer or higher polymer couplers at any position of $R_{13}$, $R_{14}$, $R_{15}$ or $W_1$ or at any position of $R_{16}$, $R_{17}$, $R_{18}$ or $W_2$, independently or in combination. For dimers, the linkage at he above position may be a chemical bond or may be a divalent linking group (such as alkylene group, arylene group, ether group, ester group or amido group). For oligomers or higher polymers, $R_{13}$, $R_{14}$, $R_{15}$ or $W_1$ and $R_{16}$, $R_{17}$, $R_{18}$ or $W_2$ each preferably constitute the main polymer chain or are bonded to the main polymer chain via the divalent group mentioned above for the dimers. The polymers may be either homopolymers of the coupler derivatives or copolymers containing one or more other non-coloring ethylenic comonomers (e.g., acrylic acid, methacrylic acid, methyl acrylate, n-butylacrylamide, β-hydroxymethacrylate, vinyl acetate, acrylonitrile, styrene, crotonic acid, maleic anhydride, N-vinylpyrrolidone).

$R_{13}$ and $R_{17}$ each represents a substituted or unsubstituted alkyl or aryl group. As the substituents for the alkyl group, a substituted or unsubstituted phenoxy group and a halogen atom are especially preferred. As the substituents for the phenoxy group, an alkyl group, an alkoxy group, a halogen atom, and a sulfonamido group are preferred. The aryl group is especially preferably a phenyl group substituted by at least one of halogen atom, alkyl group, sulfonamido group and acylamino group.

In formula (VI), $R_{16}$ is preferably a substituted alkyl group or a substituted or unsubstituted aryl group. As the substituent for the alkyl group, a halogen atom is especially preferred. The aryl group is especially preferably a phenyl group or a phenyl group substituted by at least one of halogen atom and sulfonamido group.

In formula (V), $R_{14}$ is preferably a substituted or unsubstituted alkyl group having from 1 to 20 carbon atoms. As the substituents for $R_{14}$, an alkyloxy group, an aryloxy group, an acylamino group, an alkylthio group, an arylthio group, an imido group, a ureido group, an alkylsulfonyl group and an arylsulfonyl group are preferred.

In formula (V), $R_{15}$ is preferably a hydrogen atom, a halogen atom (especially preferably, fluorine or bromine), or an acylamino group. Especially preferably, it is a halogen atom.

In formula (VI), $R_{18}$ is preferably a hydrogen atom, an alkyl or an alkenyl group having from 1 to 20 carbon atoms. Especially preferably, it is hydrogen atom.

In formula (VI), $R_{14}$ is more preferably an alkyl group having from 2 to 4 carbon atoms.

$W_1$ and $W_2$ each represents a hydrogen atom or a group capable of being released by coupling reaction with the oxidation product of a color developing agent. Such releasing group for $W_1$ and $W_2$ includes, for example, a halogen atom (e.g., fluorine, chlorine, bromine), a sulfo group, an alkoxy group, an aryloxy group, a heterocyclic oxy group, an alkylthio group, an arylthio group or a heterocyclic thio group.

Specific examples of cyan couplers which are preferably employed in the present invention are mentioned below.

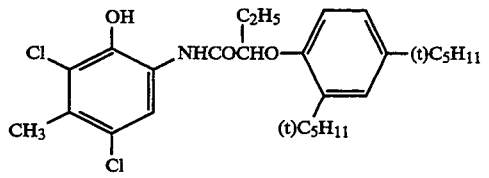

(C-1)

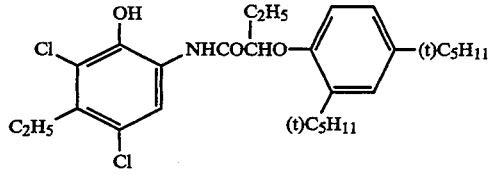

(C-2)

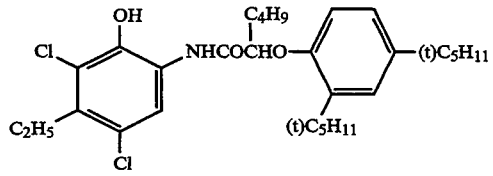

(C-3)

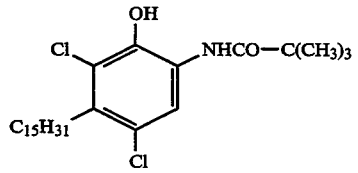

(C-4)

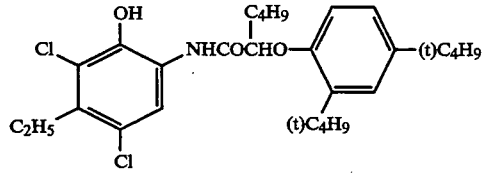

(C-5)

-continued
(C-6)
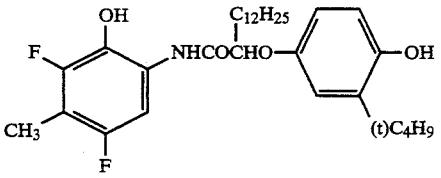
(C-7)
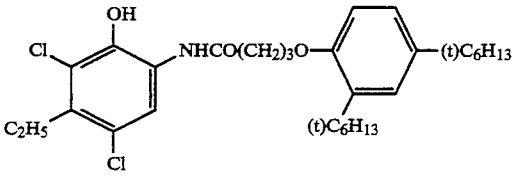
(C-8)
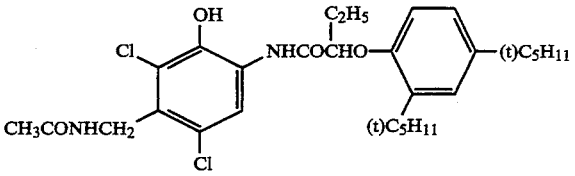
(C-9)
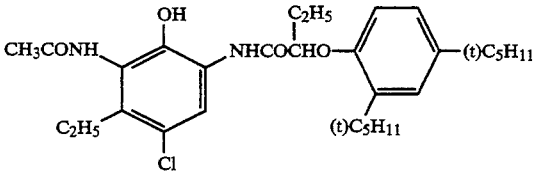
(C-10)
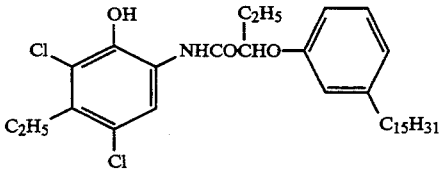
(C-11)
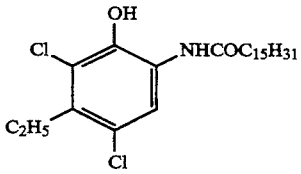
(C-12)
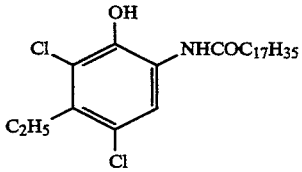
(C-13)
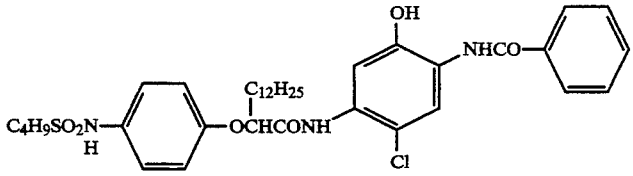

-continued
(C-14)
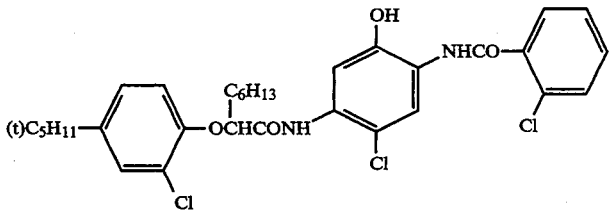
(C-15)
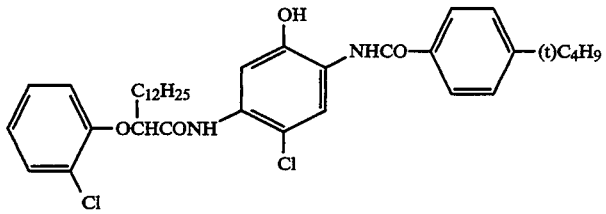
(C-16)
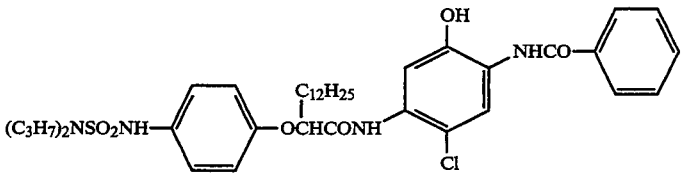
(C-17)
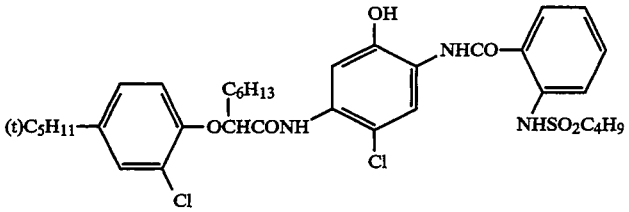
(C-18)
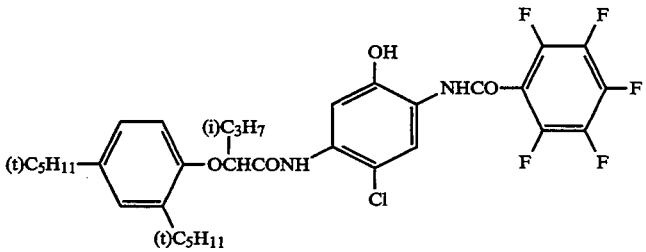
(C-19)
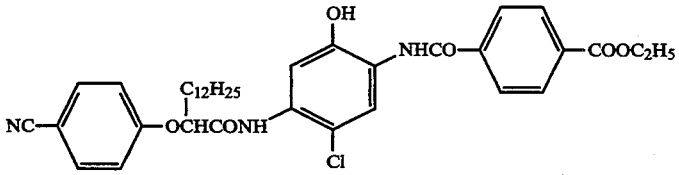
(C-20)
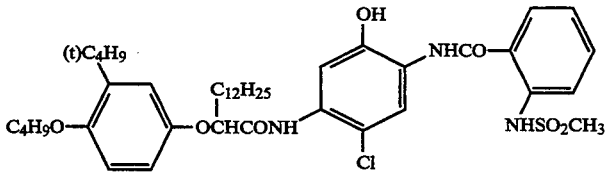

-continued
(C-21)
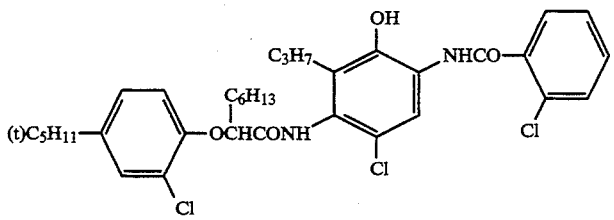
(C-22)
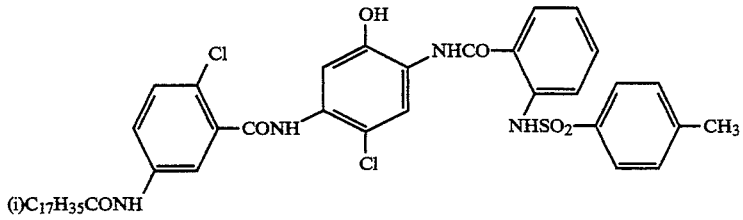
(C-23)
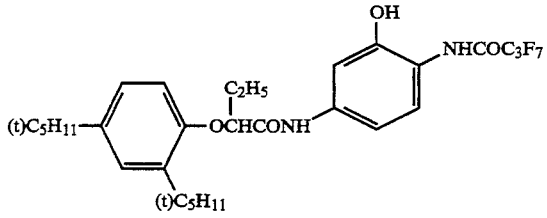
(C-24)
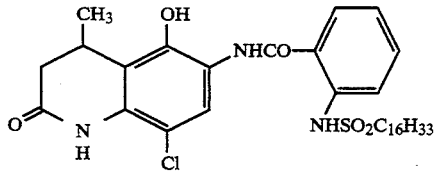
(C-25)
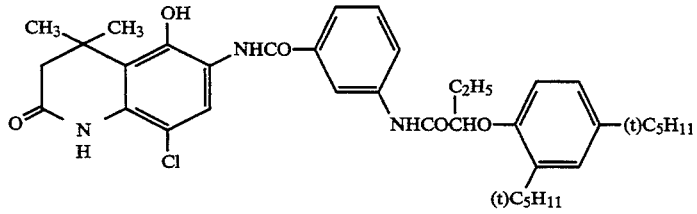
(C-26)
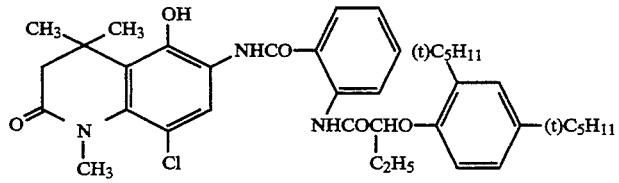
(C-27)
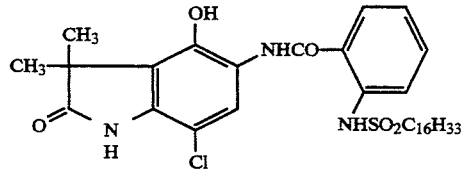

-continued
(C-28)
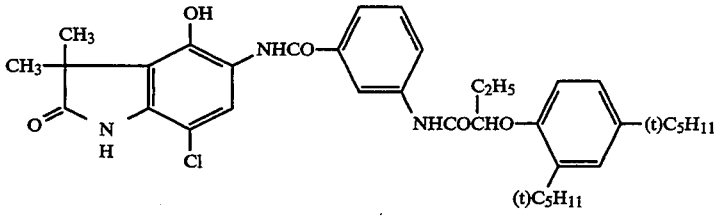
(C-29)
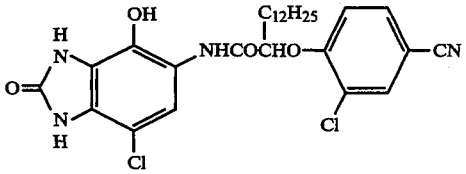
(C-30)
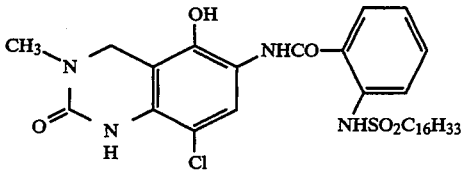
(C-31)
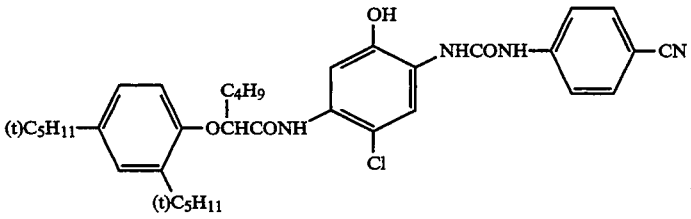
(C-32)
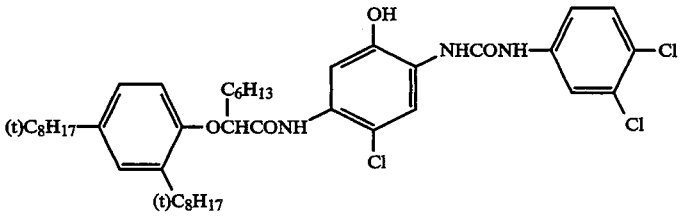
(C-33)
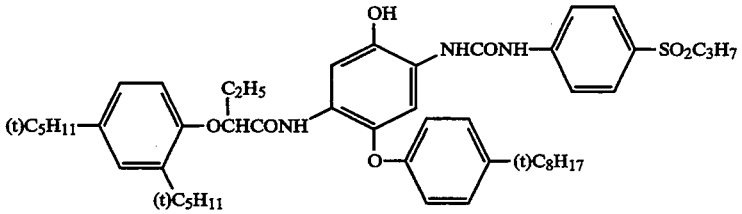
(C-34)
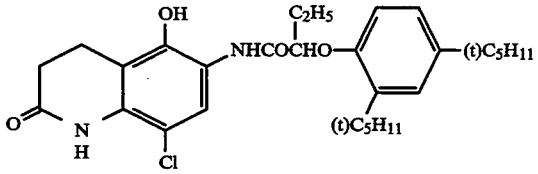

-continued
(C-35)
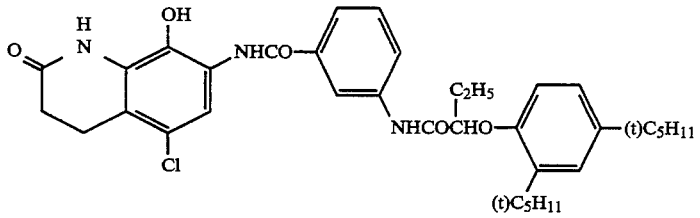
(C-36)
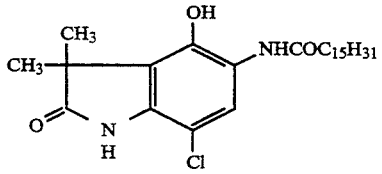
(C-37)
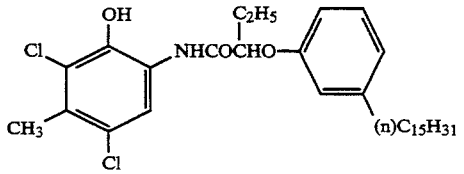
(C-38)
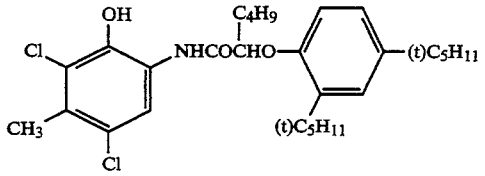
(C-39)
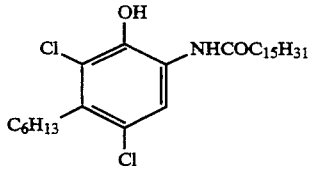
(C-40)
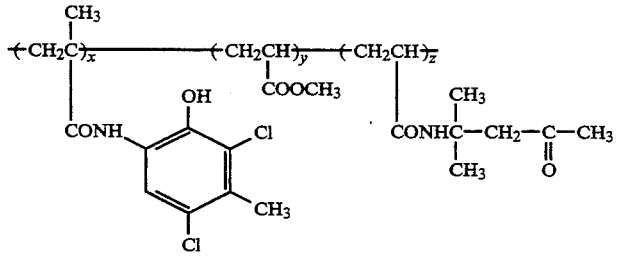
x/y/z = 50/20/30 (by weight)
(C-41)
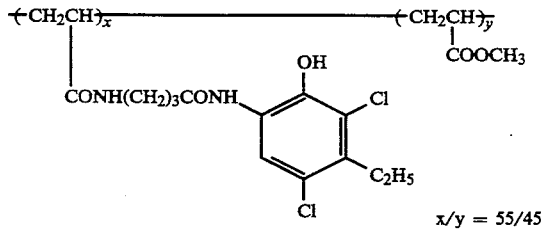
x/y = 55/45 (by weight)

-continued (C-42)

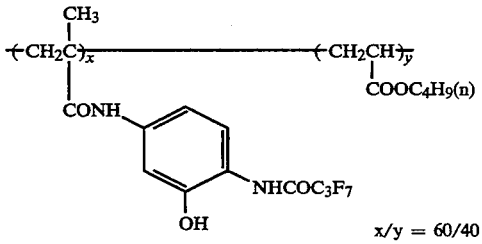

x/y = 60/40 (by weight)

(C-43)

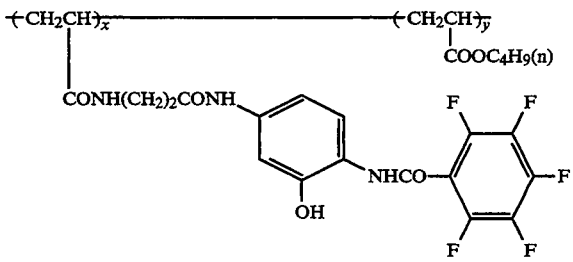

x/y = 50/50 (by weight)

(C-44)

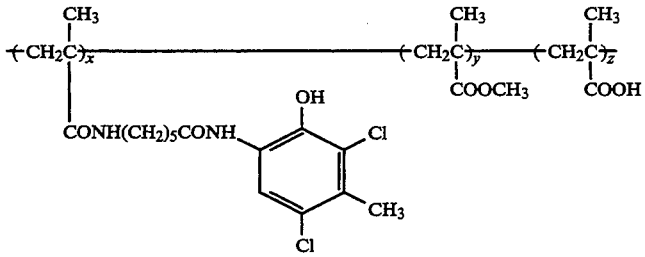

x/y/z = 55/40/5 (by weight)

The above-mentioned compounds or couplers of the formulae (I), (II), (III), (IV), (V) and (VI) are preferably dissolved in a high boiling point organic solvent together with other additives such as a color image stabilizer or a ultraviolet absorbent and are employed in the form of an emulsified dispersion. When these compounds or couplers are water-soluble or alkali-soluble, or when the compounds or couplers themselves or other photographic additives act also as solvents, the high boiling point organic solvent may not be used.

In accordance with the present invention, the preferred amount of the high boiling point organic solvent to be used for the purpose varies, depending upon the kind and amount of the compounds or couplers or other additives to be dissolved therein, and therefore could not be determined indiscriminately. However, the ratio of the high boiling point organic solvent to the coupler is preferably up to about 20, more preferably from about 0.01 to about 10, by weight.

The high boiling point organic solvent is required to be selected in consideration of extremely numerous conditions, for example, the solubility of coupler, the color-forming property, the hue of the colored dye, the color image fastness, the formability of leuco dye, the interaction with silver halide emulsion and sensitizing dye, the rinsability of various chemical agents to be used in processing, the film strength and the optical characteristics. It is necessary to select the most pertinent solvent in view of such conditions. As the case may be, a combination of plural high boiling point organic solvents can be employed.

In consideration of the various conditions, other properties of the high boiling point organic solvents, such as the dielectric constant and refractive index thereof, are also important.

The high boiling point organic solvents for use in the present invention are preferably those having a relatively high dielectric constant in view of the color forming property, and for example, those having a dielectric constant of 6.0 or more are generally preferred. However, the dielectric constant is not always critical from the viewpoint of light-fastness. On the contrary, high boiling point organic solvents having a dielectric constant of 6.0 or less are often preferred from the viewpoint of rapid processability.

Specific examples of high boiling point organic solvents which are preferably employed in the present invention are mentioned below.

$O{=}P{-}(OC_4H_{9}\text{-}n)_3$ (S-1)

$O{=}P{-}(OCH_2CH_2CH(CH_3)CH_3)_3$ (S-2)

$O{=}P{-}(OC_6H_{13}\text{-}n)_3$ (S-3)

(S-4)

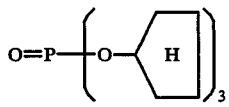

-continued
(S-5)
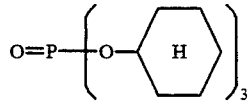
(S-6)
$O{=}P{-}(OC_8H_{17}\text{-}n)_3$
(S-7)
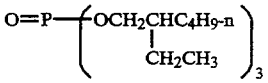
(S-8)
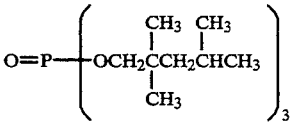
(S-9)
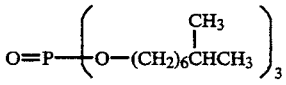
(S-10)
$O{=}P{-}(OC_9H_{19}\text{-}m)_3$
(S-11)
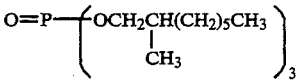
(S-12)
$O{=}P{-}(OC_{10}H_{21}\text{-}n)_3$
(S-13)
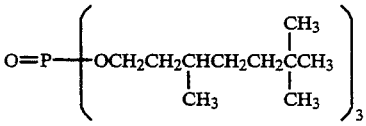
(S-14)
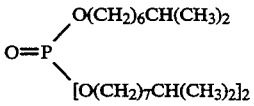
(S-15)
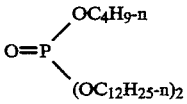
(S-16)
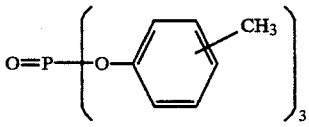
(S-17)
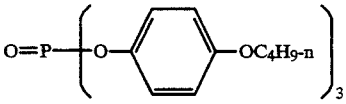
(S-18)
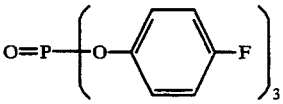
-continued
(S-19)
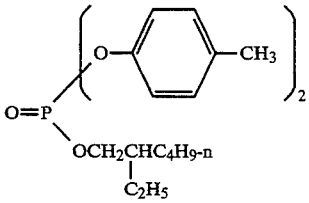
(S-20)
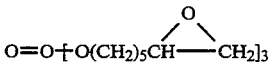
(S-21)
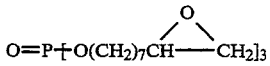
(S-22)
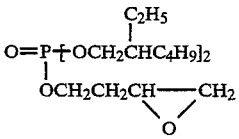
(S-23)
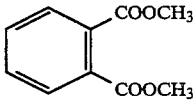
(S-24)
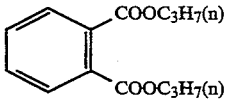
(S-25)
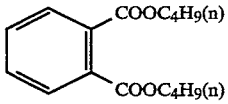
(S-26)
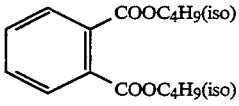
(S-27)
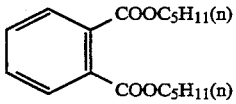
(S-28)
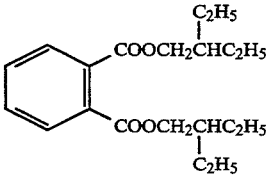
(S-29)
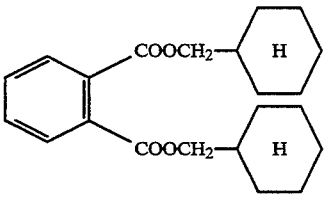

-continued
(S-30)
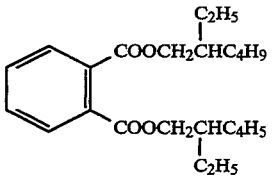
(S-31)
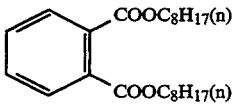
(S-32)
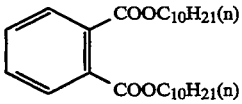
(S-33)
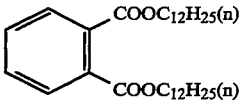
(S-34)
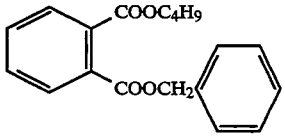
(S-35)
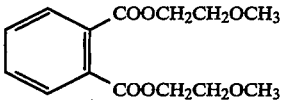
(S-36)
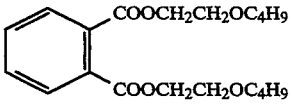
(S-37)
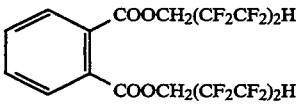
(S-38)
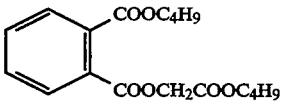
(S-39)
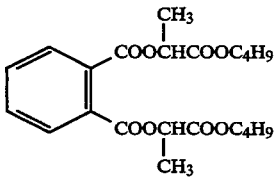
(S-40)
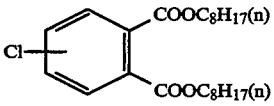
(A mixture of compounds having Cl-substituent at various positions on the benzene nucleus)
(S-41)
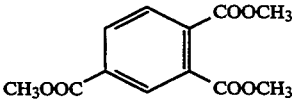
-continued
(S-42)
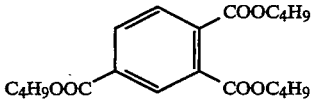
(S-43)
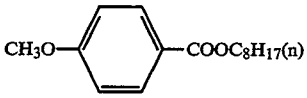
(S-44)
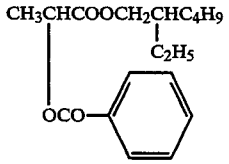
(S-45)
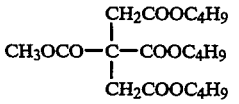
(S-46)
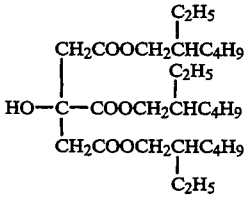
(S-47)
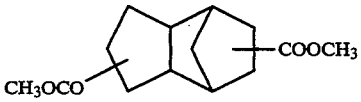
(S-48)
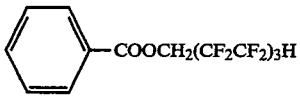
(S-49)
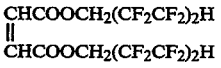
(S-50)
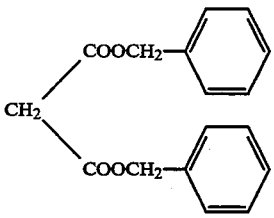
(S-51)
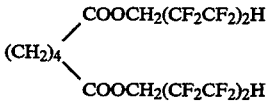
(S-52)
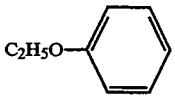
(S-53)
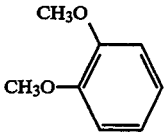

-continued

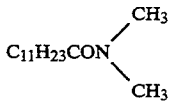

(S-54)

$C_{12}H_{25}OH$ (S-55)

$C_{16}H_{33}OH$ (S-56)

$C_{18}H_{37}OH$ (S-57)

$C_{10}H_{21}O(CH_2)_5O(CH_2)_2OH$ (S-58)

(S-59)

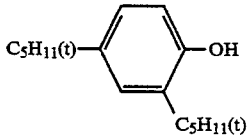

(S-60)

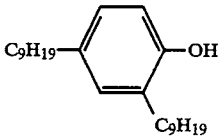

$CH_3(CH_2)_{17}Cl$ (S-61)

$CH_3(CH_2)_{15}Br$ (S-62)

(S-63)

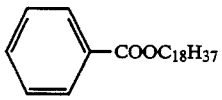

(S-64)

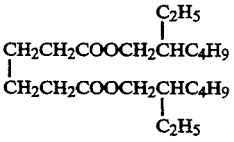

(S-65)

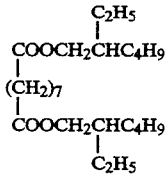

(S-66)

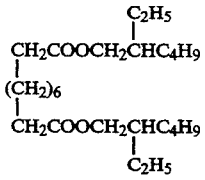

(S-67)

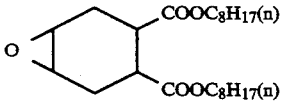

(S-68)

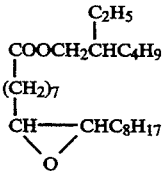

-continued (S-69)

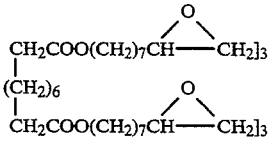

(S-70)

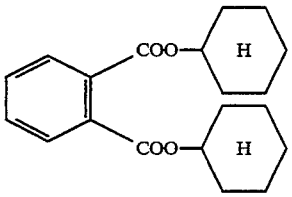

In accordance with the present invention, it is preferred to apply a technique of employing a compound which reacts with an aromatic amine developing agent which remains after color development by chemically bonding to form a chemically inactive and substantially colorless compound and/or a compound which reacts with the oxidation product of an aromatic amine developing agent which remains after color development by chemically bonding to form a chemically inactive and substantially colorless compound, singly or in combination, as described in European Patent Laid-Open Application No. 0,280,238, with the couplers or the high boiling point organic solvents. Especially, such is preferably applied to pyrazoloazole couplers.

It is also preferred to employ the water-soluble and organic solvent-soluble polymers described in European Patent Laid-Open Application No. 0,280,238. In particular, these are especially preferably empolyed together with cyan couplers or yellow couplers.

The silver halide emulsion to be contained in the light-sensitive layer of the silver halide color photographic material of the present invention is composed of silver chloride, silver bromide or silver chlorobromide which do not substantially contain silver iodide. The phrase". . . does not substantially contain silver iodide" as referred to herein means that the silver iodide content is 1 mol % or less, preferably the silver halide contains no silver iodide. A silver halide emulsion having a silver chloride content of 90 mol % or more as the halogen composition is preferably used in the present invention. In view of the stability of the photographic characteristic of the photographic material, the silver bromide content is preferably higher. On the other hand, where the silver bromide content is approximately 10 mol % or less, the bromide ion concentration to be equilibratedly accumulated in the developer as a result of running development of the photographic material having such low silver bromide content would be low so that the development speed would be accelerated. Accordingly, rapid processing could advantageously be effected.

In the latter case, the silver chloride content may be 90 mol % or more and is not limitative. Preferably, it is 95 mol % or more, more preferably 98 mol % or more, most preferably 99 mol % or more.

The high silver chloride content emulsion for use in the present invention preferably has a silver bromide-localized phase in which the silver bromide content is relatively high, in the silver halide grains. Such a silver bromide-localized phase may be in the inside of the silver halide grains or/and on the surface or the vicinity of the surface of the grains. The silver bromide-localized phase may form a shell structure form to wholly envelop the grain in the inside or on the surface of the grain in a so-called core/shell structure, or a part of the shell structure form may be broken. The localized phase may also be such that it is composed of plural discontinuous and mutually independent partial structures. One preferred embodiment of the localized structure is that the localized phase is on the surface or in the inside vicinity to the surface of the silver halide grains. Especially preferably, the localized phase is on the edges or corners of the crystal surface of the grain or in the crystal plane thereof. As the halogen composition, the silver bromide content in the localized phase may be from 10 mol % to 95 mol %, preferably from 15 mol % to 90 mol %, more preferably from 20 mol % to 60 mol %, most preferably from 30 mol % to 60 mol %.

The silver halide in the localized phase other than silver bromide is composed of silver chloride, but it may preferably contain a slight amount of silver iodide. However, the silver iodide must not be larger than 1 mol % of the total silver halide content, as mentioned above.

The amount of localized phase is preferably from 0.03 mol % to 30 mol % of the silver halide which constitutes the total silver halide grains in the emulsion, and more preferably it is from 0.1 mol % to 25 mol %.

The localized phase does not need to be composed of a single halogen composition, but it may be composed of two or more localized phases each having a different silver bromide content. In addition, it may have such a constitution that the interface between the localized phase and any other phase has a continuously varying halogen composition.

The above-mentioned silver bromide-localized phase may be formed by various methods. For instance, a water-soluble silver salt and a water-soluble bromide-containing water-soluble halide are added to an emulsion containing already formed silver chloride grains or high silver chloride content grains by a double jet method and these are reacted to thereby deposit the silver bromide-localized phase on the grains; or a part of the already formed silver chloride grains or high silver chloride content grains is converted into a silver bromide-rich phase by a so-called halogen conversion method; or fine silver bromide grains or high silver bromide content grains having a smaller grain size than the already formed silver chloride grains or high silver chloride content grains or other hardly-soluble silver salts are added to the silver chloride grains or high silver chloride content grains and are recrystallized on the surface of the silver chloride grains or high silver chloride content grains to form the silver bromide-localized phase on the grains.

These methods are described in, for example, European Patent Laid-Open Application No. 0,273,430A2.

The silver bromide content in the localized phase may be analyzed by an X-ray diffraction method (for example, described in *New Experimental Chemistry Lecture*-6, Structure Analysis (edited by Japan Chemical Society, published by Maruzen Publishing)) or by an XPS method (for example, described in *Surface Analysis*, Application of IMA and Auger Electron and Photoelectron Analysis (published by Kodansha Publishing)). In addition, the silver bromide-localized phase may be detected by observation with an electromicroscope or by the method described in the above-mentioned European Patent Laid-Open Application No. 0,273,430A2.

The silver halide grains for use in the present invention can contain metal ions other than silver ion (for example, metal ions of Group VIII of the Periodic Table, transition metal ions of Group II, lead ion of Group IV, gold ion or copper ion of Group I) or complex ions thereof, for the purpose of more efficiently displaying the rapid processability-improving effect under various conditions. Such metal ions or complex ions may be incorporated into the whole of the silver halide grains or into the above-mentioned silver bromide-localized phase of the grains or into any other phase of the grains.

Among the above-mentioned metal ions and complex ions, those selected from iridium ion, pallaium ion, rhodium ion, zinc ion, iron ion, platinum ion, gold ion and copper ion are especially useful. These metal ions and complex ions are preferred to be employed in combination rather than employed singly for the purpose of obtaining the desired photographic property. In particular, it is further preferred to vary the kind of the ions to be added and the amount thereof in the localized phase and in the other part of the grains. Especially, iridium ion or rhodium ion is preferred to be incorporated into the localized phase.

For the purpose of incorporating the metal ion or the complex ion into the localized phase of the silver halide grains and/or into the other part of the grains, the metal ion or the complex ion is directly added to the reactor before or during the formation of the silver halide grains or during physical ripening of the formed grains, or alternatively, it may previously be added to the water-soluble halide-containing solution or the water-soluble silver salt-containing solution. Where the localized phase is formed from fine silver bromide grains or fine high silver bromide content grains, the metal ion or complex ion may be incorporated into the fine silver bromide grains or fine high silver bromide grains by the same method as mentioned above and the resulting grains may be added to the silver chloride emulsion or high silver chloride content emulsion. Alternatively, a relatively hardely soluble bromide of the above-mentioned metal ion, except a silver salt, may be added as a solid or powder, whereupon the metal ion may be introduced during formation of the localized phase.

In the present invention, it is preferred that the yellow coupler-containing light-sensitive silver halide emulsion layer, the magenta coupler-containing light-sensitive silver halide emulsion layer and the cyan coupler-containing light-sensitive silver halide emulsion layer each contains a high silver chloride content emulsion in order that the photographic material may have a sufficient rapid processability.

The silver halide grains for use in the present invention may be so-called regular crystalline grains such as cubic, octahedral, tetradecahedral or rhombic dodecahedral grains, or irregular crystalline grains such as spherical or tabular grains. The grains may also be composite grains having complicated forms and composed of the planes of the above-mentioned various crystals, or may further be grains having crystal planes of higher order. The silver halide grains may be composed of a mixture of such silver halide grains. Preferably, the silver halide emulsion for use in the present invention is one containing regular crystalline silver halide grains in an amount of 50% or more, more preferably 70% or more, especially preferably 90% or more, by number or weight of the grains. In particular, an emulsion containing crystalline grains having a (100) crystal plane is especially preferred.

An emulsion containing tabular grains having a mean aspect ratio (ratio of the diameter obtained by considering the major plane of the grain as a circle to the thickness of the grain) of being 5 or more, especially preferably 8 or more, in a proportion of 50% or more of the total projected area of the grains is especially preferred for the photographic material of the present invention, since a material having such an emulsion advantageously has an excellent rapid processability.

The grain size of the silver halide grains for use in the present invention is not specifically limited, provided that the grains do not interfere with the rapid processability of the photographic material, but the grain size is preferably such that the average of the diameter obtained by considering the projected area of the grain as a circle is from 0.1 to 1.7 μm. The grain size distribution of the silver halide grains may be either broad or narrow, but a so-called mono-dispersed emulsion is preferred view of the photographic characteristics such as latent image stability and pressure-resistance as well as the processing stability, such as the developer pH-dependent property. Especially preferably, the value obtained by dividing the standard deviation (S) of the distribution of the diameter obtained by considering the projected area of the silver halide grains as a circle by the mean diameter of the grains (S/d) is 20% or less, particularly 15% or less.

The silver chloride, silver bromide or silver chlorobromide emulsion for use in the present invention can be prepared in accordance with the methods described in P. Glafkides, *Chimie et Physique Photographique* (published by Paul Montel, 1967), G. F. Duffin, *Photographic Emulsion Chemistry* (published by Focal Press, 1966), and V. L. Zelikman et al, *Making and Coating Photographic Emulsion* (published by Focal Press, 1964). For example, the silver halide emulsion may be prepared by anyone of an acid method, a neutralization method and an ammonia method. In particular, the acid method and neutralization method are preferred as being effective for reducing fog in the photographic material. As a method of reacting a soluble silver salt and soluble halide(s) to form a silver halide emulsion, a so-called single jet method or double jet method or a combination of the two may be employed. A so-called reverse mixing method wherein silver halide grains are formed in the presence of excessive silver ions can also be employed. The double jet method is preferred for the purpose of preparing a monodispersed grains-containing emulsion suitable for the present invention. As one system of the double jet method, a so-called controlled double jet method of keeping a constant silver ion concentration in the liquid phase in which the silver halide is formed is more preferred for this present invention. According to the method, a silver halide emulsion containing silver halide grains having a regular crystal form and having narrow grain size distribution, which is preferred for the present invention, can be obtained.

In the step of forming the silver halide grains or the step of physically ripening the grains, a cadmium salt, a zinc salt, a lead salt, a thallium salt, or the above-mentioned iridium salt or a complex salt thereof, a rhodium salt or a complex salt thereof, or an iron salt or a complex salt thereof can be added to the reaction system.

During or after formation of the grains, a silver halide solvent may be employed. As the solvent, ammonia, thiocyanates as well as the thioethers and thione compounds described in U.S. Pat. No. 3,271,157 and JP-A-51-12360, JP-A-53-82408, JP-A-53-144319, JP-A-54-100717 or JP-A-54-155828 are known. Where the solvent is employed in combination with the above-mentioned method, a silver halide emulsion containing regular crystalline silver halide grains and having a narrow grain size distribution, which is preferred for use in the present invention, can be obtained.

For removing the soluble salts from the emulsion physically ripened, various means, such as the noodle washing method, the flocculation precipitation method or the ultrafiltration method can be utilized.

The emulsion for use in the present invention can be chemically sensitized by sulfur sensitization, selenium sensitization, reduction sensitization or noble metal sensitization, or a combination thereof. For example, the emulsion may be sensitized by a sulfur sensitization method which uses a sulfur compound capable of reacting with an active gelatin or silver ion (e.g., thiosulfates, thiourea compounds, mercapto compounds, rhodanine compounds), or a reduction sensitization method which uses a reducing compound (e.g., stannous salts, amines, hydrazine derivatives, formamidinesulfinic acids, silane compounds), or a noble metal sensitization method which uses a noble metal compound (e.g., the above-mentioned gold complexes, or salts or complexes or metals of Group VIII of the Periodic Table such as platinum, iridium, palladium, rhodium or iron), or by a combination of the above methods. For the emulsions for use in the present invention, sulfur sensitization or selenium sensitization is preferred, which is more preferably combined with gold sensitization. Such chemical sensitization is preferably effected in the presence of a hydroxyazaindene compound or nucleic acid, for the purpose of effectively controlling sensitivity and gradation.

Various additives including the above-mentioned compounds can be added to the silver halide emulsion and the photographic material of the present invention, during the step of preparing or producing them. For instance, the substances described in *Research Disclosure*, Vol. 176, Item No. 17643 (December, 1978) and ibid., Vol. 187, Item No. 18716 (November, 1979) are mentioned. In particular, the following additives can be used in the present invention.

| Kinds of Additives | RD 17643 | Rd 18716 |
|---|---|---|
| Chemical Sensitizer | p. 23 | p. 648, right column |
| Sensitivity-enhancer | | " |
| Spectral Sensitizer and Super Color Sensitizer | pp. 23 to 24 | from p. 648, right column to p. 649, right column |
| Brightening Agent | p. 24 | |
| Anti-foggant and Stabilizer | pp. 24 to 25 | p. 649, right column |
| Light Absorbentm Filter Dye and UV Absorbent | pp. 25 to 26 | from p. 649, right column to p. 650, left column |
| Stain Inhibitor | p. 25, right column | p. 650, from left to right column |

-continued

| Kinds of Additives | RD 17643 | Rd 18716 |
|---|---|---|
| Color Image Stabilizer | p. 25 | |
| Hardening Agent | p. 26 | p. 651, left column |
| Binder | p. 26 | " |
| Plasticizer and Lubricant | p. 27 | p. 650, right column |
| Coating Aid and Surfactant | pp. 26 to 27 | " |
| Antistatic Agent | p. 27 | " |

For photographically processing the photographic materials of the present invention, any known method and any known processing solution, for example, such as described in *Research Disclosure*, Item No. 17643, pages 28 to 30 (RD-17643), can be employed. The photographic processing may be any processing having the step of forming a silver image during the procedure or of directly forming the intended color image, provided that the process may give the intended color image finally. The processing temperature is preferably from 18° C. to 50° C., but a lower temperature than 18° C. or a higher temperature than 50° C. may also be employed.

The color photographic processing method to be applied to the photographic material of the present invention is not specifically limited. For instance, as some typical methods, there are mentioned a system where the photographic material is exposed and then color-developed and bleach-fixed and thereafter optionally rinsed with water or stabilized, a system where the photographic material is exposed and then color-developed, bleached and fixed separately and thereafter optionally rinsed with water and stabilized, a system where the photographic material is exposed, developed with a developer containing a black-and-white developing agent, again uniformly exposed, color-developed and bleach-fixed in order and thereafter optionally rinsed with water or stabilized, and a system where the photographic material is exposed, developed with a developer containing a black-and-white developer, again developed with a color developer containing a fogging agent (such as sodium borohydride) and then bleach-fixed in order and thereafter optionally rinsed with water or stabilized.

As the aromatic primary amine color-developing agent used in the color developer in the present invention, any of the known compound which are widely used in various color photographic processes can be utilized as the agent. Such a developing agent typically includes an aminophenol compound and a p-phenylenediamine compound. Preferred are p-phenylenediamine compounds among them, and specific examples of such compounds are mentioned below, which, however, are not limitative.

Z-1: N,N-diethyl-p-phenylenediamine
Z-2: 2-Amino-5-diethylaminotoluene
Z-3: 2-Amino-5-(N-ethyl-N-laurylamino)toluene
Z-4: 4-[N-ethyl-N-(β-hydroxyethylamino]aniline
Z-5: 2-Methyl-4-[N-ethyl-N-(β-hydroxyethyl-)amino]aniline
Z-6: N-ethyl-N-(β-methanesulfonamidoethyl)-3-methyl-4-aminoaniline
Z-7: N-(2-amino-5-diethylaminophenylethyl)methanesulfonamide
Z-8: N,N-dimethyl-p-phenylenediamine
Z-9: 4-Amino-3-methyl-N-ethyl-N-methoxyethylaniline
Z-10: 4-Amino-3-methyl-N-ethyl-N-β-ethoxyethylaniline
Z-11: 4-Amino-3-methyl-N-ethyl-N-β-butoxyethylaniline The p-phenylenediamine compounds may be in the form of salts such as sulfates, hydrochlorides, sulfites or p-toluenesulfonates. The above-mentioned compounds are described in U.S. Pat. Nos. 2,193,015, 2,552,241, 2,566,271, 2,592,364, 3,656,950 and 3,698,525. The amount of the aromatic primary amine color-developing agent to be used is approximately from 0.1 g to 20 g, more preferably approximately from 0.5 g to 10 g, per liter of the developer.

The color developer for use in the present invention can contain hydroxylamines.

Hydroxylamines can be used in the form of a free amine in the color developer, but they may also be used in the form of a water-soluble acid salt. Examples of such salts include sulfates, oxalates, chlorides, phosphate, carbonates, acetates, etc. Hydroxylamines to be used for the purpose may be either substituted compounds or unsubstituted substances. However, hydroxylamine compounds where the nitrogen atom is substituted by alkyl group(s) (for example, N,N-diehtylhydroxylamine) are especially preferably used for processing the photographic materials of the present invention which preferably contain silver halide emulsions having a high silver chloride content.

The amount of the hydroxylamine to be added to the color developer is preferably 10 g or less, more preferably 5 g or less, per liter of the color developer. The amount of the hydroxylamine to be added to the color developer is preferably smaller, provided that the stability of the developer may be maintained.

In order to improve the preservability of the processing solution, a preservative, for example, a sulfite, such as, sodium sulfite, potassium sulfite, sodium bisulfite, potassium bisulfite, sodium metasulfite or potassium metasulfite, or a carbonylsulfite adduct, can be incorporated into the solution. However, where the photographic materials of the present invention preferably contain high silver chloride content emulsions, the amount of the preservative to be incorporated into the processing solution is preferably smaller. The effect of the present invention is especially remarkable when the materials are processed with such solution where the content of the preservative is minimized. Anyway, the amount of the preservative in the processing solution is preferably 20 g or less, more preferably 5 g or less, per liter of the color developer.

As other preservatives which can be employed in the present invention, there are mentioned the aromatic polyhydroxy compounds described in JP-A-52-49828, JP-A-56-47038, JP-A-56-32140 and JP-A-59-160142 and U.S. Pat. No. 3,746,544; the hydroxyacetones described in U.S. Pat. No. 3,615,503 and British Patent 1,306,176;

the α-aminocarbonyl compounds described in JP-A-52-143020 and JP-A-53-89425; various metal compounds described in JP-A-57-44148 and JP-A-57-53749; various saccharides described in JP-A-52-102727; the hydroxamic acids described in JP-A-52-27638; the α,α'-dicarbonyl compounds described in JP-A-59-160141; the salicylic acids described in JP-A-59-180588; the alkanolamines described in JP-A-54-3532; the poly(alkyleneimines) described in JP-A-56-94349; the gluconic acid derivatives described in JP-A-56-75647; and the triethylenediamine derivatives described in JP-A-63-239447. These preservatives may be used in combination of two or more of them. In particular, addition of 4,5-dihydroxy-m-benzenedisulfonic acid, poly(ethyleneimine), 1,4-diazabicyclo[2,2,2]octane and triethanolamine is preferred.

The color developer for use in the present invention preferably has a pH value of from 9 to 12, more preferably from 9 to 11. The color developer can contain various developer components of known compounds, in addition to the above-mentioned components.

in order to maintain the above-mentioned pH value range, various buffers are preferably added to the developer. As buffers usable for the purpose, there are mentioned, for example, carbonates, phosphates, borates, tetraborates, hydroxybenzoates, glycine salts, N,N-dimethylglycine salts, leucine salts, norleucine salts, guanidine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. In particular, carbonates, phosphates, tetraborates and hydroxybenzoates are preferred, as having a high solubility and an excellent buffering capacity in the pH range of 9.0 or higher. In addition, these buffers have further advantages that they have no bad influences on the photographic processing capacity (fogging) of the developer when they are added to the developer and they are low-priced. Accordingly, these buffers are preferably employed.

As specific examples of these buffers, there are mentioned sodium carbonate, potassium carbonate, sodium bicarbonate, potassium bicarbonate, trisodium phosphate, tripotasaium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, these compounds are not limitative.

The amount of the buffer to be added to the color developer is preferably 0.1 mol/liter or more, especially preferably from 0.1 mol/liter to 0.4 mol/liter.

In addition, the color developer may further contain various chelating agents as an agent for preventing precipitation of calcium or magnesium or for the purpose of improving the stability of the color developer.

As such chelating agents, organic acid compounds are preferred. Examples include aminopolycarboxylic acids described in JP-B-48-030496 and JP-B-44-30232; organic phosphonic acids described in JP-A-56-97347, JP-B-56-39359 and West German Patent 2,227,639; phosphonocarboxylic acids described in JP-A-52-102726, JP-A-53-42730, JP-A-54-121127, JP-A-55-126241 and JP-A-55-65956; and compounds described in JP-A-58-195845, JP-A-58-203440 and JP-B-53-40900. Specific examples of chelating agents which are employable in the present invention are mentioned below, which, however, are not imitative.

Nitrilotriacetic Acid
Diethyleneamine-pentaacetic Acid
Ethyelendiamine-tetraacetic Acid
Triethylenetetramine-hexaacetic acid
N,N,N-trimethylenephosphonic Acid
Ethylenediamine-N,N,N',N'-tetramethylenephosphonic Acid
1,3-Diamino-2-propanol-tetraacetic Acid
Transcyclohexanediamine-tetraacetic Acid
Nitrilotripropionic Acid
1,2-Diaminopropane-tetraacetic Acid
Hydroxyethyliminodiacetic Acid
Glycoletherdiamine-tetraacetic Acid
Hydroxyethylenediamine-triacetic Acid
Ethylenediamine-orthohydroxyphenylacetic Acid
2-Phosphonobutane-1,2,4-tricarboxylic Acid
1-Hydroxyethane-1,1-diphosphonic Acid
N,N'-bis(2-hydroxybenzyl)ethylenediamine-N,N'-diacetic Acid These chelating agents can be used in combination of two or more of them, if desired. The amount of the chelating agent to be added to the color developer may be such that it is sufficient for sequestering the metal ions in the color developer. For instance, the amount can be approximately from 0.1 g/liter to 10 g/liter.

In addition to the above-mentioned compounds, the hydrazine compounds described in JP-A-63-146041, JP-A-63-146042, JP-A-63-146043, JP-A-63-170642 (for example, N,N-di(carboxymethyl)hydrazine) are especially preferably incorporated into the color developer. Such compounds are effective for improving the preservability of the color developer to be used for processing the silver halide color photographic materials of the present invention. Additionally, they are also effective for elevating the color forming ability and for improving the stability of the photographic characteristics against variation of various conditions of the processing solutions used. The effect of the present invention is especially noticeable when the photographic materials are processed with a color developer containing a compound of the hydrazine type as the main preservative.

The color developer may optionally contain a development accelerator, if desired.

Benzyl alcohol is known as one typical color development-accelerator, and it can be incorporated into the processing solution for the photographic materials of the present invention. However, it is preferred that the processing solution for the photographic materials of the present invention does not substantially contain benzyl alcohol. Specifically, the content of benzyl alcohol in the color developer for use in the present invention is 2 ml/liter or less, preferably 0.5 ml/liter or less, and especially preferably, the color developer does not contain the same. Where the color developer not containing benzyl alcohol is used for processing the photographic materials of the present invention, the effect of the present invention is advantageously remarkable.

As other development accelerators usable in the present invention, there are mentioned thioether compounds described in JP-B-37-16088, JP-B-37-5987, JP-B-38-7826, JP-B-44-12380, JP-A-45-9019 and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; p-aminophenol compounds described in U.S. Pat. Nos. 2,610,122 and 4,119,462; amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346; polyalkyleneoxides described in JP-B-37-16088 and JP-B-42-25201, U.S. Pat. No. 3,128,183, JP-B-41-11431 and JP-B-42-23883 and U.S. Pat. No. 3,532,501; and other 1-phenyl-3-pyrazolidones, hydrazines, mesoionic compounds, thione compounds and imidazole compounds. These development accelerators can be added to the color developer, if desired. In particular, thioether compounds and 1-phenyl-3-pyrazolidones are preferred.

The color developer for use in the present invention can an contain antifoggant, if desired. For instance, alkali metal halides such as potassium bromide, sodium bromide or potassium iodide as well as organic antifoggants can be used. Where the photographic materials of the present invention contain high silver chloride content emulsions, it is preferred that the content of such bromide ion in the processing solution is minimized in order that rapid processing of the materials is facilitated.

As organic antifoggants usable in the present invention, there are mentioned, for example, nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethylbenzimidazole and hydroxyazaindolidine; mercapto-substituted heterocyclic compounds such as 1-phenyl-5-mercaptoterazole, 2-mercaptobenzimidazole and 2-mercaptobenzothiazole; adenine; and mercapto-substituted aromatic compounds such as thiosalicylic acid. The antifoggant may be incorporated into the silver halide color photographic materials of the present invention and dissolved out therefrom and accumulate in the color developer during processing the materials. However, the amount of the antifoggant to be accumulated is preferably as small as possible, for the purpose of reducing the amount of the waste drainage.

The color developer for use in the present invention preferably contains a brightening agent. For instance, 4,4'-diamino-2,2'-disulfostilbene compounds are preferred as the brightening agent. The amount of the brightening agent to be added to the developer is up to 5 g/liter, preferably from 0.1 to 2 g/liter.

If desired, the developer may also contain various surfactants such as alkylphosphonic acids, arylphosphonic acids, aliphatic carboxylic acids and aromatic carboxylic acids.

The processing temperature with the color developer is preferably from 30° to 50° C., more preferably from 33° to 42° C. The amount of the replenisher during processing is from 30 to 1500 cc/m$^2$, preferably from 30 to 600 cc/m$^2$, more preferably from 30 to 300 cc/m$^2$. For the purpose of reducing the amount of the waste drainage from the process, the amount of the replenisher is preferably small.

The bleaching solution or bleach-fixing solution which is used for processing the photographic materials of the present invention contains a bleaching agent, which is generally a ferric complex. As the ferric complex, a complex composed of a ferric ion and a chelating agent such as aminopolycarboxylic acids, aminopolyphosphonic acids or salts thereof is preferred. As salts of aminopolycarboxylic acids or salts of aminopolyphosphonic acids, salts of aminopolycarboxylic acids or aminopolyphosphonic acids and alkali metal salts, ammonium or water-soluble amines are preferred. The alkali metals include sodium, potassium and lithium; and the water-soluble amines include alkylamines such as methylamine, diethylamine, triethylamine and butylamine, alicyclic amines such as cyclohexylamine, arylamines such as aniline and m-toluidine, and heterocyclic amines such as pyridine, morpholine and piperidine.

Specific examples of the chelating agents of aminopolycarboxylic acids and aminopolyphosphonic acids and salts thereof are mentioned below, which, however, are not limitative.

Ethylenediamine-tetraacetic Acid
Disodium Ethylenediaminetetraacetate
Diammonium Ethylenediaminetetraacetate
Tetra(trimethylammonium) Ethylenediaminetetraacetate
Tetrapotassium Ethylenediaminetetraacetate
Tetrasodium Ethylenediaminetetraacetate
Trisodium Ethylenediaminetetraacetate
Diethylenetriamine-pentaacetic Acid
Pentasodium Diethylenetriamine-pentaacetate
Ethylenediamine-N- (β-hydroxyethyl) -N,N',N'-triacetic Acid
Trisodium Ethylenediamine-N-(β-hydroxyethyl)-N,N',N'-triacetate
Triammonium Ethylenediamine-N-(β-hydroxyethyl)-N,N',N'-triacetate
Propylenediaminetetraacetic Acid
Disodium Propylenediamine-tetraacetate
Nitrilotriacetic Acid
Trisodium Nitrilotriacetate
Cyclohexanediamine-tetraacetic Acid
Disodium Cyclohexanediaminetetraacetate
Iminodiacetic Acid
Dihydroxyethylglycine
Ethylether-diaminetetraacetic Acid
Glycolether-diaminetetraacetic Acid
Ethylenediamine-tetrapropionic Acid
Phenylenediaminetetraacetic Acid
1,3-Diaminopropanol]-N,N,N',N'-tetramethylenephosphonic Acid
Ethylenediamine-N,N,N',N'-tetramethylenephosphonic Acid
1,3-Propylenediamine-N,N,N',N'-tetramethylenephosphonic Acid The ferric complex may be directly added to the solution as the complex; or alternatively, using a ferric salt such as ferric sulfate, ferric chloride, ferric nitrate, ammonium ferric sulfate or ferric phosphate and a chelating agent such as an aminopolycarboxylic acid, aminopolyphosphonic acid or phosphonocarboxylic acid, the ferric complex may be formed in a solution. In the former case of using the ferric complex, one complex only or two or more complexes in combination may be used. On the other hand, in the latter case where the complex is formed from a ferric salt and a chelating agent in a solution, one or more ferric salts may be employed. Also one or more chelating agents may be employed. Anyway, the amount of the chelating agent may be over the necessary amount for forming the intended ferric complex. Among ferric complexes, aminopolycarboxylic acid/ferric complexes are preferred, and the amount thereof to be added to the solution is form 0.01 to 1.0 mol/liter, more preferably from 0.05 to 0.50 mol/liter.

The bleaching solution or bleach-fixing solution may contain a bleaching accelerator, if desired. As specific examples of bleaching accelerators usable, there are mentioned mercapto group- or disulfido group-containing compounds described in U.S. Pat. No. 3,893,858, West German Patents 1,290,812 and 2,059,988, JP-A-53-32736, JP-A-53-57831, JP-A-53-37418, JP-A-53-65732, JP-A-53-72623, JP-A-53-95630, JP-A-53-95631, JP-A-53-104232, JP-A-53-124424, JP-A-53-141623 and JP-A-53-28426 and *Research Disclosure*, Item No. 17129 (July, 1978); thiazolidine derivatives described in JP-A-50-140129; thiourea derivatives described in JP-B-45-8506, JP-A-52-20832 and JP-A-53-32735, and U.S. Pat. No. 3,706,561; iodides described in West German Patent 1,127,715 and JP-A-58-16235; polyethylene oxides described in West German Patents 966,410 and 2,748,430; polyamines described in JP-B-45-8836; compounds described in JP-A-49-42434, JP-A-49-59644, JP-A-53-94927, JP-A-54-35727, JP-A-55-26506 and JP-A-58-163940; and iodide and bromide ions. Among them, mercapto group- or disulfido group-containing compounds are preferred, as having a large accelerating effect. In particular, the compounds described in U.S. Pat. No. 3,893,858, West German Patent 1,290812 and JP-A-53-95630 are preferred.

In addition, the bleaching solution or bleach-fixing solution for use in the present invention preferably contains a re-halogenating agent such as iodides (e.g., potassium bromide, sodium bromide, ammonium bromide), chlorides (e.g., potassium chloride, sodium chloride, ammonium chloride) or iodides (e.g., ammonium iodide). If desired, the solution may further contain one or more inorganic acids or organic acids or alkali metal or ammonium salts thereof which have a pH-buffering capacity, such as boric acid, borax, sodium metaborate, acetic acid, sodium acetate, sodium carbonate, potassium carbonate, phosphorous acid, phosphoric acid, sodium phosphate, citric acid, sodium citrate or tartaric acid, as well as an anticorrosive such as ammonium nitrate or guanidine.

A known fixing agent can be employed in the bleach-fixing solution or fixing solution for use in the present invention. As the fixing agent, one or more water soluble silver halide solublizers can be used, which include, for example, thiosulfates such as sodium thiosulfate or ammonium thiosulfate, thiocyanates such as sodium thiocyanate or ammonium thiocyanate, ethylenebisthioglycolic acid or thioether compounds such as 3,6-dithia-1,8-octanediol, and thioureas. A particular bleach-fixing solution containing the fixing agent described in JP-A-55-155354 together with a large amount of a halide such as potassium iodide can also be used. In the present invention, thiosulfates, especially ammonium thiosulfate, are preferably used.

The amount of the bleaching agent in the solution is preferably from 0.3 to 2 mol/liter, more preferably from 0.5 to 1.0 mol/liter.

The pH range of the bleach-fixing solution or fixing solution for use in the present invention is preferably from 3 to 10, more preferably from 4 to 9. If the pH value of the solution is lower than the above range, the preservability of the solution is deteriorated and leucoation of the cyan dye during processing is accelerated, although the desilvering capacity is improved. On the other hand, if the pH value is higher than the above range, the desilvering would be retarded and would cause an increase of stains in the processed materials.

In order to adjust the pH value of the bleach-fixing solution or fixing solution, hydrochloric acid, sulfuric acid, nitric acid, acetic acid (glacial acetic acid), bicarbonates, ammonia, potassium hydroxide, sodium hydroxide, sodium carbonate or potassium carbonate can be added to the respective solution, if desired.

The bleach-fixing solution may further contain other various brightening agents, defoaming agents or surfactants as well as organic solvents such as polyvinyl pyrrolidone or methanol.

The bleach-fixing solution or fixing solution for use in the present invention contains, as a preservative, a sulfite ion-releasing compound such as sulfites (e.g., sodium sulfite, potassium sulfite, ammonium sulfite), bisulfites (e.g., ammonium bisulfite, sodium bisulfite, potassium bisulfite), and metabisulfites (e.g., potassium metabisulfite, sodium metabisulfite, ammonium metabisulfite). The presevative compound is preferably incorporated into the solution in an amount of approximately from 0.02 to 0.50 mol/liter, more preferably approximately from 0.04 to 0.40 mol/liter, as the sulfite ion.

As the preservative, addition of the sulfites is generally employed, but other compounds such as ascorbic acid, carbonyl-sulfite adducts or carbonyl compounds may also be added to the solution.

In addition, the bleach-fixing solution or fixing solution may further contain a buffer, a brightening agent, a chelating agent and a fungicide, if desired.

Next, the rinsing step to be effected for processing the photographic materials of the present invention will be mentioned hereunder. In the present invention, a simplified processing method where only a so-called "stabilization" with no substantial rinsing-in-water step may be employed in place of the ordinary "rinsing-in-water" processing method. Accordingly, the "rinsing step" as referred to herein indicates the broad meaning as mentioned above.

The amount of the water to be used in the rinsing step in the present invention varies, depending upon the number of the baths employed in a multi-stage countercurrent rinsing procedure and the amount of the carryover of the processing solution from the previous bath together with the material being processed, and is therefore difficult to be specifically defined. However, in the process of the present invention, the concentration of the components of the previous bath having a bleach-fixing capacity in the final rinsing bath is preferably $5\times10^{-2}$ mol/l or less, more preferably $2\times10^{-2}$ mol/l or less. For instance, in the case of a three-tank countercurrent rinsing, the amount of water to be used is preferably approximately 1000 ml or more per $m^2$ of the photographic material being processed. In the case of an economized process, the amount of water may be preferably 1000 ml or less per $m^2$ of the material.

The temperature of the rinsing water is preferably from 15° C. to 45° C., more preferably from 20° C. to 40° C.

In the rinsing step, various known compounds may be used for the purpose of prevention off precipitation or of stabilization of the rinsing water. For instance, chelating agents such as inorganic phosphoric acids, aminopolycarboxylic acids or organic phosphonic acids; bactericides or fungicides for preventing propagation of various bacteria, algae and mold, such as compounds described in *Journal of Antibacterial and Antifungal Agents*, Vol. 11, No. 5, pages 207 to 223 (1983)

and compounds described in H. Horiguchi, *Antibacterial and Antifungal Chemistry*; metal salts such as magnesium salts or aluminum salts; alkali metal and ammonium salts; and surfactants for preventing drying load or unevenness may be added to the rinsing solution, if desired. In addition, the compounds described in West, *Photographic Science and Engineering*, Vol. 6, pages 344 to 359 (1965) may also be added.

The method illustrated in JP-A-62-288838 where a rinsing water containing reduced amounts of calcium and magnesium is used is especially preferably employed in the present invention.

Addition of a chelating agent, a bactericide and/or a fungicide to the rinsing water in the multi-stage countercurrent rinsing step having two or more rinsing tanks for the purpose of noticeably reducing the amount of the rinsing water to be used in the step is especially effective in performing the present invention. In addition, the multi-stage countercurrent stabilization step (so-called stabilization step) described in JP-A-57-8543 is also especially effective for the present invention, in place of the ordinary rinsing step. In this case, the bleach-fixing component in the final bath may be $5\times10^{-2}$ mol/l or less, preferably $1\times10^{-2}$ mol/l or less.

Various compounds can be added to the stabilization bath for the purpose of stabilizing the image formed in the photographic material processed. For instance, various buffers for the purpose of adjusting the film pH (for example, within the pH range of from 3 to 8) may be employed as a combination of two or more of borates, metaborates, borax, phosphate, carbonates, potassium hydroxide, sodium hydroxide, aqueous ammonia, monocarboxylic acids, dicarboxylic acids and polycarboxylic acids. In addition, aldehydes such as formalin may also be used for the purpose. Further, other various additives, such as chelating agents (e.g., inorganic phosphoric acids, aminopolycarboxylic acids, organic phosphonic acids, aminopolyphosphonic acids, phosphonocarboxylic acids ), bactericides (e.g., thiazoles, isothiazoles, halogenated phenols, sulfanylamides, benzotriazoles), surfactants, brightening agents and hardening agents may also be added. Two or more compounds having the same or different purposes may be employed in combination.

As the film pH-adjusting agent for the photographic materials processed, various ammonium salts such as ammonium chloride, ammonium nitrate, ammonium sulfate, ammonium phosphate, ammonium sulfite or ammonium thiosulfate are preferably added, for the purpose of improving image storability.

Where the amount of the rinsing solution is noticeably reduced as mentioned above, it is preferred that a part or all of the over-flow solution from the rinsing tank is recirculated back to the previous bleach-fixing bath or fixing bath for the purpose of reducing the amount of the waste drainage.

In the continuous processing procedure to be applied to the photographic materials of the present invention, replenishers for the processing solutions are preferably added to the respective steps for the purpose of inhibiting fluctuation of the composition of the processing solution and of thereby obtaining consistently finished products. The amount of the replenisher is preferably as small as possible for the purpose of reducing the processing cost, provided that the finished product may have a favorable photographic property by properly controlling the processing conditions such as the composition of the processing solution, the temperature thereof, the processing time and the stirring means.

The processing baths may optionally and preferably have a heater, a temperature sensor, a liquid level sensor, a circulating pump, a filter, various floating lids, various squeegees, a nitrogen stirrer and an air stirrer, if desired.

The silver halide photographic materials of the present invention preferably have auxiliary layers such as a protective layer, interlayer, anti-halation layer, filter layer and backing layer, if desired, in addition to the silver halide emulsion layers.

As a layer constitution for ordinary color photographic materials, it is preferred that a protective layer constitution is superposed over the outermost emulsion layer and the protective layer constitution is composed of an upper protective layer containing a matting agent having an appropriate grain size, a slide agent and a dispersion of a polyvinyl alcohol polymer or copolymer or a high boiling point organic solvent for the purpose of adjusting the physical and mechanical characteristics of the coated film and a lower protective layer containing an ultraviolet absorbent (especially, 2-(2'-hydroxyphenyl)benzotriazoles), a mordant agent and the same polymer or high boiling point organic solvent as in the upper protective layer.

An interlayer may be provided between a silver halide emulsion layer containing cyan coupler and that containing magenta coupler, and a color mixing preventing agent is preferably added to the interlayer. As the color mixing preventing agent to be employed for the purpose, there are various reducing agents such as hydroquinones. Alkylhydroquinones are most typical, which are described in U.S. Pat. Nos. 2,360,290, 2,419,613, 2,728,659, 2,732,300, 3,960,570 and 3,700,453.

As a support on which the above-mentioned emulsion layers and auxiliary layers are coated for preparing the photographic materials of the present invention, there are mentioned, for example, baryta paper, resin-coated paper, triacetate film, polyethylene terephthalate film, vinyl chloride film and other plastic films, as well as synthetic papers made of the above-described polymers or a polypropylene, and a glass sheet, a metal plate and a metal laminate base.

The following examples are intended to illustrate the present invention in more detail but not to restrict it in any way.

EXAMPLE 1

A silver halide color photographic material having the constitution mentioned below was prepared. This is called Sample No. 1.

Silver halide emulsions for the respective layers were prepared as mentioned below.

Emulsion for Red-sensitive Layer 30 g of lime-processed gelatin was added to 1000 ml of distilled water and dissovled at 40° C. Next, the resulting solution was adjusted to have a pH of 3.8 by addition of sulfuric acid, and 5.5 g of sodium chloride and 0.02 g of N,N'-dimethylimidazolidine-2-thione were added thereto and the temperature was raised to 52.5° C. A solution of 62.5 g of silver nitrate dissolved in 750 ml of distilled water and a solution of 21.5 g of sodium chloride dissolved in 500 ml of distilled water were added to the above-mentioned solution over a period of 40 minutes at 52.5° C. and blended. Further, a solution of 62.5 g of silver nitrate dissolved in 500 ml of distilled water and a solution of 21.5 g of sodium chloride dissolved in 300 ml of distilled water were added thereto over a period of 20 minutes under the condition of 52.5° C. and blended.

The resulting emulsion was observed with an electronic microscope, which proved that the emulsion was composed of cubic grains having a mean side length of about 0.46 μm and a fluctuation coefficient of the grain size distribution of 0.09.

The emulsion was desalted and washed with water, and 0.2 g of nucleic acid, $1\times10^{-4}$ mol/mol.Ag of Compound (V-1) and a monodispersed silver bromide emulsion having a mean grain size of 0.05 μm (containing $2\times10^{-5}$ mol/mol.Ag of dipotassium iridium hexachloride) in an amount of 0.6 mol % as silver halide were added thereto. Next, the resulting emulsion was chemically sensitized with approximately $2\times10^{-6}$ mol/mol.Ag of triethylthiourea, and further $7\times10^{-4}$ mol/mol.Ag of Compound (I-1) and $5\times10^{-3}$ mol/mol.Ag of Compound (F-1) were added to the emulsion.

Emulsion for Green-sensitive Layer 30 g lime-processed gelatin was added to 1000 ml of distilled water and dissolved at 40° C., and 5.5 g of sodium chloride and 0.02 g of N,N'-dimethylimidazolidine-2-thione were added thereto and the temperature was raised to 50° C. A solution of 62.5 g of silver nitrate dissolved in 750 ml of distilled water and a solution of 21.5 g of sodium chloride dissolved in 500 ml of distilled water were added to the above mentioned solution over a period of 40 minutes at 50° C. and blended. Further, a solution of 62.5 g of silver nitrate dissolved in 500 ml of distilled water and a solution of 21.5 g of sodium chloride dissolved in 300 ml of distilled water were added thereto over a period of 20 minutes under the condition of 50° C. and blended.

The resulting emulsion was observed with an electronic microscope, which proved that the emulsion was composed of cubic grains having a mean side length of about 0.44 μm and a fluctuation coefficient of the grain size distribution of 0.08.

The emulsion was desalted and washed with water, and 0.2 g of nucleic acid, $5\times10^{-4}$ mol/mol.Ag of Compound (V-2) $7\times10^{-4}$ mol/mol.Ag of Compound (V-3) and a monodispersed silver bromide emulsion (containing $2.5\times10^{-5}$ mol/mol.Ag of dipotassium iridium hexachloride) having a mean grain size of 0.05 μm in an amount of 0.4 mol % as silver halide were added thereto. Next, the resulting emulsion was chemically sensitized with $2.5\times10^{-6}$ mol/mol.Ag of triethylthiourea, and further $1.1\times10^{-3}$ mol/mol.Ag of Compound (I-1) was added to the emulsion.

Emulsion for Blue-sensitive Layer 30 g lime-processed gelatin was added to 1000 ml of distilled water and dissolved at 40° C., and the pH value was adjusted to 3.8 with sulfuric acid. 5.5 g of sodium chloride and 0.03 g of N,N'-dimethylimidazolidine-2-thione were added to the resulting solution and the temperature was raised to 75° C. A solution of 12.5 g of silver nitrate dissolved in 150 ml of distilled water and a solution of 4.3 g of sodium chloride dissolved in 100 ml of distilled water were added thereto over a period of 30 minutes at 75° C. and blended. Further, a solution of 112.5 g of silver nitrate dissolved in 1100 ml of distilled water and a solution of 38.7 g of sodium chloride dissolved in 650 ml of distilled water were added thereto over a period of 40 minutes under the condition of 75° C. and blended.

The resulting emulsion was observed with an electronic microscope, which proved that the emulsion was composed of cubic grains having a mean side length of about 0.82 μm and a fluctuation coefficient of the grain size distribution of 0.11.

The emulsion was desalted and rinsed with water, and 0.2 g of nucleic acid, $2\times10^{-3}$ mol/mol.Ag of Compound (V-4) $2\times10^{-3}$ mol/mol.Ag of Compound (V-5) and a monodispersed silver bromide emulsion having a mean grain size of 0.05 μm (containing $1\times10^{-5}$ mol/mol.Ag of dipotassium iridium hexachloride) in an amount of 0.3 mol % as silver halide was added thereto. Next, the resulting emulsion was chemically sensitized with $1.2\times10^{-6}$ mol/mol.Ag of triethylthiourea, and then $9\times10^{-4}$ mol/mol.Ag of Compound (I-1) was added to the emulsion.

The sample was further coated with Compounds (D-1), (D-2), (D-3) and (D-4) in amounts of 0.006 g/m², 0.007 g/m², 0.003 g/m² and 0.012 g/m², respectively, for the purpose of anti-irradiation and improvement of the image-sharpness.

As a gelatin-hardening agent, a mixture of the following compounds (3/2/1, by mol) was used.

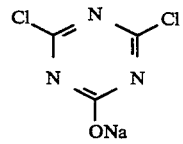

$CH_2NHCOCH_2SO_2CH{=}CH_2$
|
$CH_2NHCOCH_2SO_2CH{=}CH_2$ $OCH_2SO_2CH{=}CH_2$
|
$CH_2SO_2CH{=}CH_2$

The layer constitution of the photographic material sample was as follows:

Support $TiO_2$ (3 g/m²)-containing Polyethylene Laminate Paper

| | Coated Amount |
|---|---|
| First Layer: Blue-sensitive Layer | |
| Above-mentioned Blue-sensitive Layer | 0.27 g/m² |
| Emulsion | as Ag |
| Gelatin | 1.66 g/m² |
| Polymer (P-1) | 0.16 g/m² |
| Yellow Coupler (Y-79) | 0.14 g/m² |
| Yellow Coupler (Y-82) | 0.18 g/m² |
| Yellow Coupler (Y-78) | 0.35 g/m² |
| Color Image Stabilizer (H-11) | 0.01 g/m² |
| Solvent (S-13) | 0.15 g/m² |
| Solvent (S-68) | 0.14 g/m² |
| Second Layer: Color Mixing Preventing Layer | |
| Gelatin | 1.30 g/m² |
| Color Mixing Preventing Agent (H-1) | 0.06 g/m² |
| Solvent (S-16) | 0.12 g/m² |
| Solvent (S-25) | 0.12 g/m² |
| Third Layer: Green-sensitive Layer | |
| Above-mentioned Green-sensitive Layer | 0.15 g/m² |
| Emulsion | as Ag |
| Gelatin | 1.60 g/m² |
| Magenta Coupler (M-83) | 0.22 g/m² |
| Magenta Coupler (M-92) | 0.09 g/m² |
| Color Image Stabilizer (E-1) | 0.10 g/m² |
| Color Image Stabilizer (A-1) | 0.08 g/m² |
| Color Image Stabilizer (B-1) | 0.03 g/m² |
| Color Image Stabilizer (H-5) | 0.01 g/m² |
| Solvent (S-7) | 0.44 g/m² |
| Solvent (S-16) | 0.22 g/m² |
| Fourth Layer: Ultraviolet Absorbing Layer | |

-continued

| | Coated Amount |
|---|---|
| Gelatin | 1.60 g/m$^2$ |
| Ultraviolet Absorbent (X-1) | 0.06 g/m$^2$ |
| Ultraviolet Absorbent (X-2) | 0.27 g/m$^2$ |
| Ultraviolet Absorbent (X-3) | 0.29 g/m$^2$ |
| Color Mixing Preventing Agent (H-1) | 0.06 g/m$^2$ |
| Solvent (S-66) | 0.26 g/m$^2$ |
| Fifth Layer: Red-sensitive Layer | |
| Above-mentioned Red-sensitive Layer | 0.24 g/m$^2$ |
| Emulsion | as Ag |
| Gelatin | 1.76 g/m$^2$ |
| Polymer (P-1) | 0.53 g/m$^2$ |
| Cyan Coupler (C-1) | 0.07 g/m$^2$ |
| Cyan Coupler (C-5) | 0.12 g/m$^2$ |
| Cyan Coupler (C-11) | 0.09 g/m$^2$ |
| Cyan Coupler (C-38) | 0.07 g/m$^2$ |
| Color Image Stabilizer (X-1) | 0.04 g/m$^2$ |
| Color Image Stabilizer (X-2) | 0.05 g/m$^2$ |
| Color Image Stabilizer (X-4) | 0.05 g/m$^2$ |
| Color Image Stabilizer (A-1) | 0.01 g/m$^2$ |

-continued

| | Coated Amount |
|---|---|
| Color Image Stabilizer (B-1) | 0.01 g/m$^2$ |
| Color Image Stabilizer (H-11) | 0.01 g/m$^2$ |
| Color Image Stabilizer (H-2) | 0.04 g/m$^2$ |
| Solvent (S-68) | 0.11 g/m$^2$ |
| Solvent (S-70) | 0.11 g/m$^2$ |
| Sixth Layer: Ultraviolet Absorbing Layer | |
| Gelatin | 0.65 g/m$^2$ |
| Ultraviolet Absorbent (X-1) | 0.2 g/m$^2$ |
| Ultraviolet Absorbent (X-2) | 0.09 g/m$^2$ |
| Ultraviolet Absorbent (X-3) | 0.10 g/m$^2$ |
| Color Mixing Preventing Agent (H-1) | 0.02 g/m$^2$ |
| Solvent (S-66) | 0.11 g/m$^2$ |
| Seventh Layer: Protective Layer | |
| Gelatin | 1.30 g/m$^2$ |
| Acryl-modified Polyvinyl Aclohol Polymer (modification degree: 17%) | 0.15 g/m$^2$ |
| Liquid Paraffin | 0.05 g/m$^2$ |

The compounds used above were as follows:

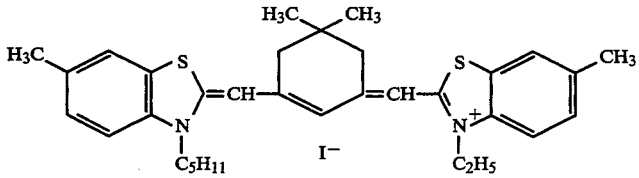

(V-1)

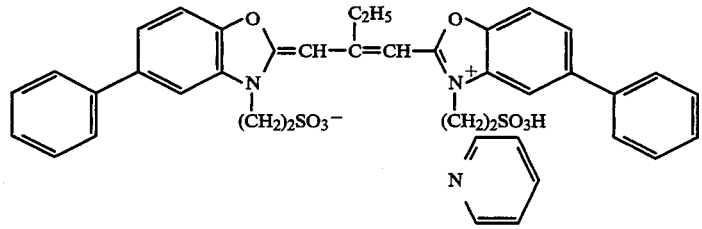

(V-2)

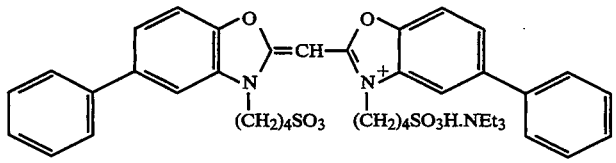

(V-3)

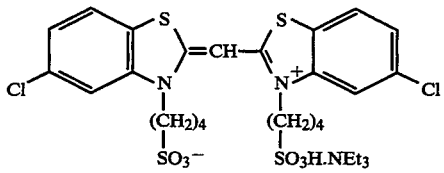

(V-4)

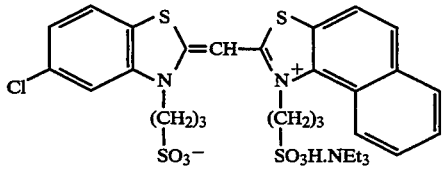

(V-5)

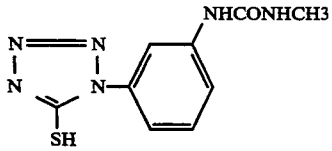

(I-1)

-continued
(F-1)
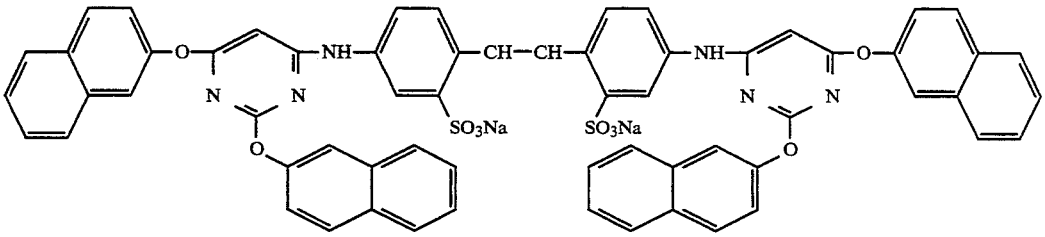
(D-1)
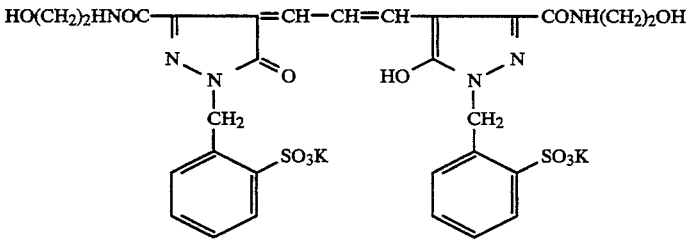
(D-2)
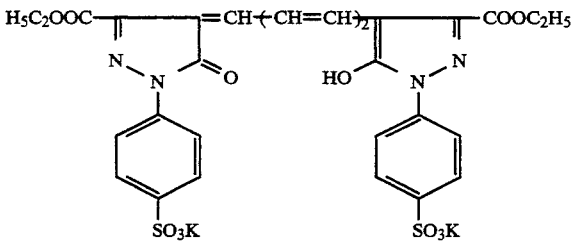
(D-3)
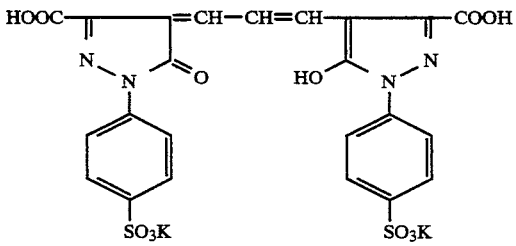
(D-4)
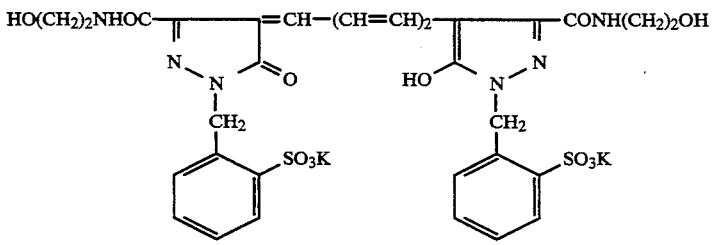
(X-1)
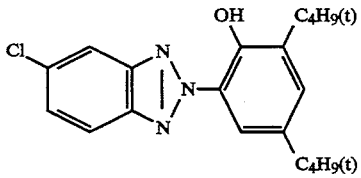
(X-2)
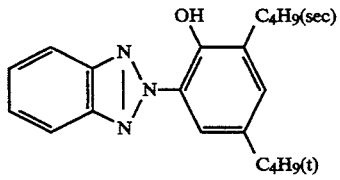

-continued

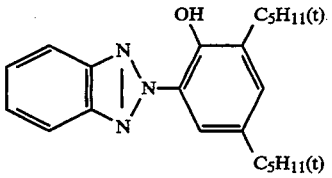

(X-3)

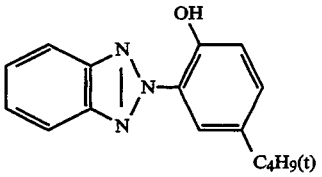

(X-4)

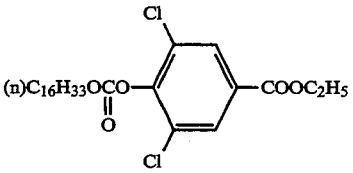

(A-1)

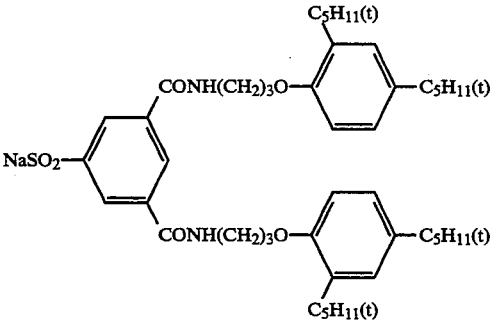

(B-1)

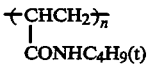

(molecular weight: about 60,000)

(P-1)

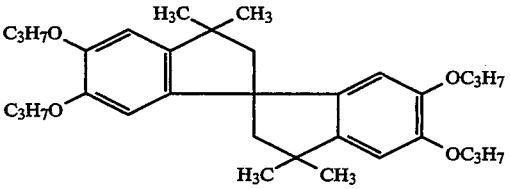

(E-1)

Samples Nos. 2 to 6 were prepared in the same manner, except that the molar ratio of silver halide/coupler in the first layer and the amount of the color mixing preventing agent in the second layer were varied as indicated in Table 1 below, whereupon the coating amount of the blue-sensitive emulsion was properly varied so that the gradation of the blue-sensitive layer could be almost the same in every sample.

TABLE 1

| Sample No. | Ratio of Silver/Coupler in 1st Layer (mol/mol) | Amount of H-1 in 2nd Layer ($mol/m^2$) | Remarks |
|---|---|---|---|
| 1 | 2.93 | $1.80 \times 10^{-4}$ | Comparison |
| 2 | 2.93 | $3.00 \times 10^{-4}$ | The Invention |
| 3 | 1.46 | $1.80 \times 10^{-4}$ | Comparison |
| 4 | 1.46 | $3.00 \times 10^{-4}$ | Comparison |
| 5 | 4.39 | $1.80 \times 10^{-4}$ | Comparison |
| 6 | 1.39 | $3.00 \times 10^{-4}$ | Comparison |

Each of the samples was subjected to exposure to white light for 0.1 second through a blue filter and an optical wedge and then subjected to color development processings in accordance with the following procedure.

| Processing Step | Temperature | Time |
|---|---|---|
| Color Development | 38° C. | 45 sec |
| Bleach-fixation | 30 to 36° C. | 45 sec |
| Rinsing (1) | 30 to 37° C. | 30 sec |
| Rinsing (2) | 30 to 37° C. | 30 sec |
| Rinsing (3) | 30 to 37° C. | 30 sec |
| Drying | 70 to 80° C. | 60 sec |

Processing solutions used in the above steps were as follows:

| Color Developer: | |
|---|---|
| Ethylenediamine-N,N,N',N'-tetramethylene-phosphonic Acid | 3.0 g |

-continued

| | |
|---|---|
| N,N-di(carboxymethyl)hydrazine | 4.5 g |
| N,N-diethylhydroxylamine Oxalate | 2.0 g |
| Triethanolamine | 8.5 g |
| Sodium Sulfite | 0.14 g |
| Potassium Chloride | 1.6 g |
| Potassium Bromide | 0.01 g |
| Potassium Carbonate | 25.0 g |
| N-ethyl-N-(β-methanesulfonamidoethyl)-3-methyl-4-aminoaniline Sulfate | 5.0 g |
| WHITEX-4 (product by Sumitomo Chemical) | 1.4 g |
| Water to make | 1000 ml |
| pH | Adjusted to 10.05 |
| Bleach-fixing Solution: | |
| Ammonium Thiosulfate (55 wt % aqueous solution) | 100 ml |
| Sodium Sulfite | 17.0 g |
| Ammonium Ethylenediaminetetraacetato/Iron (III) | 55.0 g |
| Disodium Ethylenediaminetetraacetate | 5.0 g |
| Ammonium Bromide | 40.0 g |
| Glacial Acetic Acid | 9.0 g |
| Water to make | 1000 ml |
| pH | Adjusted to 5.80 |
| Rinsing Solution: | |
| Ion-exchanged Water | (calcium ion content: 3 ppm or less, magnesium ion content: 2 ppm or less) |

The magenta color density of each of the thus processed samples was measured with a X-RITE 310 Reflection Densitometer at a yellow density of (Dy) 1.0 or 1.75, and the values obtained are shown in Table 2 below.

TABLE 2

| Sample No. | Magenta Density (Dy = 1.0) | Magenta Density (Dy = 1.75) | Remarks |
|---|---|---|---|
| 1 | 0.28 | 0.43 | Comparison |
| 2 | 0.27 | 0.40 | The Invention |
| 3 | 0.27 | 0.42 | Comparison |
| 4 | 0.27 | 0.40 | Comparison |
| 5 | 0.32 | 0.57 | Comparison |
| 6 | 0.29 | 0.48 | Comparison |

In Table 2, the magenta density derived from the yellow dye itself at the position of a yellow density of 1.0 or 1.75 is 0.27 or 0.40, respectively. Accordingly, the samples having the values 0.27 and 0.40 are interpreted that they are free from color-mixing.

Next, the same samples were exposed and processed in the same manner as above, except that the time for color development was shortened to 30 seconds. The yellow density of the thus processed samples were then measured at the point where the exposure was the same as that where the previous samples (color developed for 45 seconds) provided an yellow density of 1.5. The results are shown in Table 3 below.

TABLE 3

| Sample No. | Yellow Density (45 second-color development) | Yellow Density (30 second-color development) | Remarks |
|---|---|---|---|
| 1 | 1.50 | 1.35 | Comparison |
| 2 | 1.50 | 1.33 | The Invention |
| 3 | 1.50 | 1.25 | Comparison |
| 4 | 1.50 | 1.18 | Comparison |
| 5 | 1.50 | 1.37 | Comparison |
| 6 | 1.50 | 1.35 | Comparison |

In the previous Table 2, not only Sample No. 2 of the present invention, but also the comparative Sample No. 4 was almost free from color-mixing and showed a good yellow hue. However, in Table 3, the comparative Sample No. 4 indicates retardation of development and is obviously inferior to Sample No. 2 of the present invention. In Table 3, the Sample No. 2 of the invention was noted to have a slightly lower developing speed than the Sample Nos. 1, 5 and 6, which, however, is practically out of problem. The magenta color density in the yellow color portion is visually sensitively differentiated even with a difference of 0.02. On these grounds, Sample No. 2 of the present invention is concluded to be the best overall.

EXAMPLE 2

Samples 7 to 12 were prepared in the same manner as that for preparation of Samples 1 to 6 in Example 1, respectively, except that the magenta coupler in the third layer was replaced by the following 4-equivalent magenta coupler and the amount of the coupler in the layer was varied to 1.5 molar times and the amount of the silver in the third layer was varied to 2.2 times.

4-Equivalent Magenta Coupler:

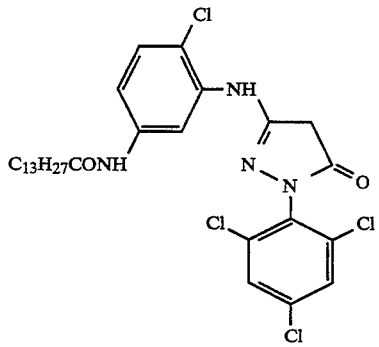

These samples were exposed, processed and checked in the same manner as in Example 1. The results are shown in Table 4 below.

TABLE 4

| Sample No. | Magenta Density (Dy = 1.0) | Magenta Density (Dy = 1.75) | Yellow Density (45 second-color development) | Yellow Density (30 second-color development) | Remarks |
|---|---|---|---|---|---|
| 7 | 0.27 | 0.40 | 1.50 | 1.24 | (Comparison) |
| 8 | 0.27 | 0.40 | 1.50 | 1.24 | (Comparison) |
| 9 | 0.27 | 0.40 | 1.50 | 1.16 | (Comparison) |
| 10 | 0.27 | 0.40 | 1.50 | 1.19 | (Comparison) |
| 11 | 0.27 | 0.44 | 1.50 | 1.29 | (Comparison) |
| 12 | 0.27 | 0.42 | 1.50 | 1.26 | (Comparison) |

Some of these Samples Nos. 7 to 12 may be comparable to Sample No. 2 of the present invention in Example 1 in the point of the retarded color-mixing. However, it is noted that the developing speed of these comparative samples was somewhat low. Anyway, as so mentioned hereinabove, the samples containing the 4-equivalent magenta coupler could not have the excellent color-reproducibility of forming the magenta dye and the excellent color-fastness of the dye formed, unlike the Sample No. 2 of the present invention of Example 1.

EXAMPLE 3

Samples were prepared in the same manner as that for preparation of Samples Nos. 1 to 6 in Example 1, except that the magenta coupler in the third layer was replaced by Compound (M-5) and the amount of the compound was varied to 1.2 molar times and the silver in the third layer was varied to 1.3 times.

These samples were tested in the same manner as in Example 1, and almost the same results were obtained.

EXAMPLE 4

Samples 13 to 18 were prepared in the same manner as that for preparation of Samples Nos. 1 to 6 in Example 1, respectively, except that the following red-sensitive emulsion, green-sensitive emulsion and blue-sensitive emulsion were used.

Red-sensitive Layer Emulsion

A mixed emulsion (3/7, as silver) composed of an emulsion of cubic silver chlorobromide grains having a mean grain size of 0.51 μm, a grain size distribution fluctuation coefficient of 0.09 and a silver chloride content of 30 mol % and an emulsion of cubic silver chlorobromide grains having a mean grain size of 0.42 μm, a grain size distribution fluctuation coefficient of 0.10 and a silver chloride content of 30 mol %.

This emulsion contained Compound (V-1), Compound (F-1) and Compound (I-1).

Green-sensitive Layer Emulsion

A mixed emulsion (5/5, as silver) composed of an emulsion of cubic silver chlorobromide grains having a mean grain size of 0.45 μm, a grain size distribution fluctuation coefficient of 0.08, and a silver chloride content of 20 mol % and an emulsion of cubic silver chlorobromide grains having a mean grain size of 0.34 μm, a grain size distribution fluctuation coefficient of 0.11 and a silver chloride content of 20 mol %.

This emulsion contained Compound (V-2), Compound (V-3) and Compound (I-1).

Blue-sensitive Layer Emulsion

A mixed emulsion (2/8, as silver) composed of an emulsion of cubic silver chlorobromide grains having a mean grain size of 0.86 μm, a grain size distribution fluctuation coefficient of 0.08 and a silver chloride content of 10 mol % and an emulsion of cubic silver chlorobromide grains having a mean grain size of 0.62 μm, a grain size distribution fluctuation coefficient of 0.09 and a silver chloride content of 10 mol %.

This emulsion contained Compound (V-4) and Compound (V-5).

These Samples Nos. 13 to 18 were exposed, processed and tested in the same manner as in Example 1, except that the development was effected in accordance with the procedure mentioned below.

Sample No. 14 of the present invention and Comparative Sample No. 16 were excellent in that they were free from the color-mixing. However, Comparative Sample No. 16 was inferior to Sample No. 14 of the present invention with respect to development speed. In addition, it is further noted that Comparative Sample No. 16 is more disadvantageous than Sample No. 14 of the present invention with respect to manufacturing cost.

| Processing Step | Temperature | Time |
|---|---|---|
| Color Development | 27° C. | 7 min 30 sec |
| Bleach-fixation | 33° C. | 1 min 30 sec |
| Rinsing with Water | 24 to 34° C. | 3 min |
| Drying | 70 to 80° C. | 1 min |
| Color Developer: | | |
| Water | | 800 cc |
| Diethylenetriamine-pentaacetic Acid | | 1.0 g |
| Nitrilotriacetic Acid | | 1.5 g |
| Benzyl Alcohol | | 15.0 ml |
| Diethylene Glycol | | 10.0 ml |
| Sodium Sulfite | | 2.0 g |
| Potassium Bromide | | 0.5 g |
| Potassium Carbonate | | 30.0 g |
| N-ethyl-N-(β-menthanesulfonamidoethyl)-3-methyl-4-aminoaniline Sulfate | | 5.0 g |
| Hydroxylamine Sulfate | | 4.0 g |
| Brightening Agent (WHITEX 4B, product by Sumitomo Chemical) | | 1.0 g |
| Water to make | | 1000 ml |
| pH (25° C.) | | 10.20 |
| Bleach-fixing Solution: | | |
| Water | | 400 ml |
| Ammonium Thiosulfate (55 wt % aqueous solution) | | 150 ml |
| Ammonium Ethylenediaminetetraacetato/Iron (III).$2H_2O$ | | 55.0 g |
| Disodium Ethylenediaminetetraacetate | | 5.0 g |
| Water to make | | 1000 ml |
| pH (25° C.) | | 6.70 |
| Rinsing with Water: Countercurrent rinsing system. | | |

As is obvious from the above-mentioned explanation, a silver halide color photographic material having excellent rapid processability and color reproducibility, which forms a color image with high color-fastness, is provided by the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material having a photographic layer constitution on a support, the photographic layer constitution being comprised of a yellow coupler-containing silver halide emulsion layer, a magenta coupler-containing silver halide emulsion layer and a cyan coupler-containing silver halide emulsion layer formed on the support in this order; wherein the magenta coupler is a 2-equivalent 5-pyrazolone coupler represented by formula (II) below or a 2-equivalent pyrazoloazole coupler represented by formula (III) below, a non-light-sensitive layer is provided between the yellow coupler-containing silver halide emulsion layer and the magenta coupler-containing silver halide emulsion layer and it contains at least one compound represented by formula (I) in an amount of from $2.75\times10^{-4}$ to $1.5\times10^{-3}$ mol/m2, and the molar ratio of the silver halide in the yellow coupler-containing silver halide emulsion layer to the yellow coupler contained in the yellow coupler-containing silver halide emulsion layer is from 1.5 to 3.5:

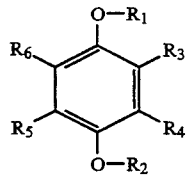

(I)

where $R_1$ and $R_2$ each represents a hydrogen atom, a precursor which is cleaved under alkaline conditions to form a hydrogen atom, or $R_1$ and $R_3$, and/or $R_2$ and $R_4$ are combined to form a closed ring by bonding —$OR_1$ with $R_3$ and/or —$OR_2$ with $R_4$, respectively, to form —$OCOCH_2CH_2$—; $R_3$, $R_4$, $R_5$ and $R_6$ each represents a hydrogen atom, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxy group, a substituted or unsubstituted arylthio group, a substituted or unsubstituted nitrogen-containing heterocyclic thio group, a substituted or unsubstituted aryloxy group, a substituted or unsubstituted acyl group, a substituted or unsubstituted acylamino group, a substituted or unsubstituted alkylamino group, a substituted or unsubstituted alkoxycarbonyl group, a substituted or unsubstituted aryloxycarbonyl group, a carbamoyl group, a sulfamoyl group, or a sulfonic acid or carboxylic acid group which may be in a form of salt thereof; provided that when $R_3$, $R_4$, $R_5$ and $R_6$ are all hydrogen atoms at the same time, $R_1$ and $R_2$ must not be hydrogen atoms at the same time;

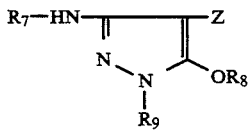

(II)

where $R_7$ and $R_9$ each represents a substituted or unsubstituted phenyl group;

$R_8$ represents a hydrogen atom, or an aliphatic or aromatic acyl group;

Z represents a group capable of being released by a coupling reaction with an oxidation product of a color developing agent;

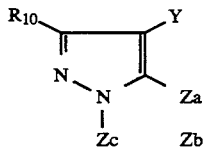

(III)

where $R_{10}$ represents a hydrogen atom or a substituent; Y represents a group capable of being released by a coupling reaction with an oxidation product of an aromatic primary amine developing agent;

Za, Zb and Zc each represents a methine group, a substituted methine group or a group of =N— or —NH—;

one of the Za—Zb bond and Zb—Zc bond is a double bond and the other is a single bond, and when Za—Zb is a carbon carbon double bond, it may be a part of an aromatic ring; and the compound of formula (III) may be in a form of a dimer or higher polymer formed at the position of $R_1$ or X; and when Za, Zb or Zc is a substituted methine group, the compound of formula (III) may also be in a form of a dimer or higher polymer formed at the position of the substituted methine group.

2. The silver halide color photographic light-sensitive material as in claim 1, wherein $R_1$ and $R_2$ each represents a substituted or unsubstituted aliphatic or aromatic acyl group.

3. The silver halide color photographic light-sensitive material as in claim 1, wherein the total number of carbon atoms in $R_3$, $R_4$, $R_5$ and $R_6$ is at least 12.

4. The silver halide color photographic light-sensitive material as in claim 1, wherein the molar ratio of the silver halide in the yellow coupler-containing silver halide emulsion layer to the yellow coupler therein is from 1.8 to 3.2.

5. The silver halide color photographic light-sensitive material as in claim 4, wherein the molar ratio of the silver halide in the yellow coupler-containing silver halide emulsion layer to the yellow coupler therein is from 2.0 to 2.8.

6. The silver halide color photographic light-sensitive material as in claim 1, wherein said substituent represented by $R_{10}$ is a group selected from the group consisting of a substituted or unsubstituted alkyl group, a substituted or unsubstituted alkoxy group, a substituted or unsubstituted aryloxy group, and a ureido gorup.

7. The silver halide color photographic light-sensitive material as in claim 1, whrein the yellow coupler is a 2-equivalent yellow coupler represented by formula (IV):

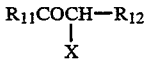

(IV)

where $R_{11}$ represents an substituted alkyl group, a substituted alkyl group, an unsubstituted aryl group, or a substituted aryl group;

$R_{12}$ represents a cyano group or a substituted N-phenylcarbamoyl group; and

X represents a group capable of being released by a coupling reaction with an oxidation product of an aromatic primary amine developing agent.

8. The silver halide color photographic light-sensitive material as in claim 1, wherein the cyan coupler is at least one of compounds represented by the following formula (V) or (VI):

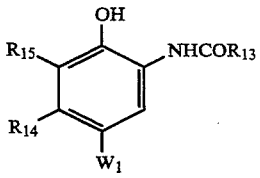

(V)

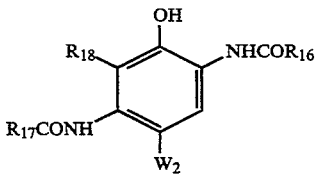

(VI)

where $R_{13}$, $R_{16}$ and $R_{17}$ each represents an aliphatic group aromatic group, a heterocyclic group or an aromatic or heterocyclic amino group, which may further be substituted;

$R_{14}$ represents an aliphatic group, which may be substituted;

$R_{15}$ and $R_{18}$ each represents a hydrogen atom, a halogen atom, an aliphatic group, an aliphatic oxy group or an acylamino group, which may be substituted;

$R_{14}$ and $R_{15}$ may be bonded to each other to form a 5-, 6- or 7-membered ring to be a part of a condensed ring;

$R_{17}$ and $R_{18}$ may be bonded to each other to form a 5-, 6- or 7-membered ring to be a part of a condensed ring; and the compound of formula (V) or (VI) may be in a form of a dimer or higher polymer formed at the position of $R_{13}$, $R_{14}$, $R_{15}$ and/or $W_1$, or at the position of $R_{16}$, $R_{17}$, $R_{18}$ and/or $W_2$; and $W_1$ and $W_2$ each represents a hydrogen atom or a group capable of being released by a coupling reaction with an oxidation product of a color developing agent.

9. The silver halide color photographic light-sensitive material as in claim 1, wherein the silver halide in each of the silver halide emulsion layers is composed of silver chloride, silver bromide or silver chlorobromide which does not substantially contain silver iodide.

10. The silver halide color photographic light-sensitive material as in claim 9, wherein said silver halide contains 90 mol % or more silver chloride.

11. The silver halide color photographic light-sensitive material as in claim 1, wherein the amount of the magenta coupler in said magenta coupler-containing layer is from 0.005 to 4 mol per mol of silver halide.

12. The silver halide color photographic light-sensitive material as in claim 1, wherein the amount of the cyan coupler in said cyan coupler-containing layer is from 0.005 to 4 mol per mol of silver halide.

13. The silver halide color photographic light-sensitive material as in claim 1, wherein the amount of each of the cyan, magenta and yellow couplers coated on the support is from $2\times10^{-5}$ mol/m$^2$ to $1\times10^{-2}$ mol/m$^2$.

* * * * *